US009791207B2

(12) United States Patent
Kim et al.

(10) Patent No.: US 9,791,207 B2
(45) Date of Patent: Oct. 17, 2017

(54) REFRIGERATOR

(71) Applicant: SAMSUNG ELECTRONICS CO., LTD., Suwon-si, Gyeonggi-do (KR)

(72) Inventors: Joong Ho Kim, Gwangju (KR); Youn Tae Shin, Gwangju (KR); Wan Hyeong Lee, Gwangju (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 194 days.

(21) Appl. No.: 14/640,088

(22) Filed: Mar. 6, 2015

(65) Prior Publication Data

US 2015/0260447 A1 Sep. 17, 2015

(30) Foreign Application Priority Data

Mar. 11, 2014 (KR) ..... 10-2014-0028616

(51) Int. Cl.

| | |
|---|---|
| ***F21V 33/00*** | (2006.01) |
| ***F25D 27/00*** | (2006.01) |
| ***F25D 23/02*** | (2006.01) |
| ***E05D 7/00*** | (2006.01) |
| ***F25D 23/06*** | (2006.01) |

(Continued)

(52) U.S. Cl.

CPC ..... *F25D 27/005* (2013.01); *E05D 7/00* (2013.01); *F21V 33/0044* (2013.01); *F25D 23/028* (2013.01); *F25D 23/065* (2013.01); *F25D 23/08* (2013.01); *F25D 27/00* (2013.01); *G08B 5/36* (2013.01); *E05Y 2800/71* (2013.01); *E05Y 2900/31* (2013.01); *F21W 2131/305* (2013.01);

(Continued)

(58) Field of Classification Search

CPC ..... F25D 27/005; E05D 7/00
USPC ..... 312/405, 292; 362/92
See application file for complete search history.

(56) References Cited

U.S. PATENT DOCUMENTS 5,787,724 A * 8/1998 Pohl ..... B67D 1/0858 16/386
7,905,614 B2 * 3/2011 Aoki ..... F25D 11/02 312/116

(Continued)

FOREIGN PATENT DOCUMENTS

| | | |
|---|---|---|
| CN | 103233639 | 8/2013 |
| JP | 11-83306 | 3/1999 |

(Continued)

OTHER PUBLICATIONS

European Search Report issued Jul. 28, 2015 in corresponding European Patent Application No. 15157859.8.

*Primary Examiner* — Andrew Coughlin
*Assistant Examiner* — Matthew Peerce
(74) *Attorney, Agent, or Firm* — Staas & Halsey LLP

(57) ABSTRACT

A refrigerator having a structure in which, when a first door or a second door is opened, a lamp installed at sidewalls of an opening in the first door emits light so that food stored in a door guard disposed in the opening can be illuminated. The refrigerator includes a main body having a storage compartment; a first door that is rotatably disposed in front of the main body and opens/closes the storage compartment, and has an opening formed therein, where at least one door guard is disposed in the opening; a second door that is rotatably disposed in front of the first door, opens/closes the opening, and is rotated in the same direction as the first door; and a lamp installed at the sidewalls of the opening.

15 Claims, 55 Drawing Sheets

(51) Int. Cl.
*F25D 23/08* (2006.01)
*G08B 5/36* (2006.01)
*F21W 131/305* (2006.01)

(52) U.S. Cl.
CPC .... *F25D 2201/12* (2013.01); *F25D 2323/023* (2013.01); *F25D 2323/024* (2013.01)

(56) References Cited

U.S. PATENT DOCUMENTS

| | | | | |
|---|---|---|---|---|
| 2005/0178131 | A1 | 8/2005 | Ryu et al. | |
| 2006/0254302 | A1* | 11/2006 | Byrne | B65G 1/08 62/378 |
| 2007/0180890 | A1* | 8/2007 | Steinich | E05D 11/00 73/11.01 |
| 2010/0072870 | A1* | 3/2010 | Hwang | F25D 23/025 312/405 |
| 2012/0250301 | A1* | 10/2012 | Tung | F21V 31/00 362/223 |
| 2013/0033163 | A1 | 2/2013 | Kang | |

FOREIGN PATENT DOCUMENTS

| | | | |
|---|---|---|---|
| KR | 10-2007-0027386 | | 3/2007 |
| KR | 10-2013-0015986 | | 2/2013 |
| WO | WO 2009/020756 | A1 | 2/2009 |
| WO | WO 2011/081279 | A1 | 7/2011 |
| WO | WO 2014/175639 | A1 | 10/2014 |

* cited by examiner

REFRIGERATOR

CROSS-REFERENCE TO RELATED APPLICATIONS

This application claims the benefit of Korean Patent Application No. 10-2014-0028616, filed on Mar. 11, 2014 in the Korean Intellectual Property Office, the disclosure of which is incorporated herein by reference.

BACKGROUND

1. Field

Embodiments of the present disclosure relate to a refrigerator having a double door.

2. Description of the Related Art

In general, a refrigerator is an apparatus that keeps food fresh by including a main body including an inner case and an outer case, a storage compartment formed by the inner case, and a cold air supplying unit for supplying cold air to the storage compartment.

The temperature of the storage compartment is maintained to be in a predetermined range required to keep food fresh.

A front side of the storage compartment of the refrigerator is disposed to be opened, and the opened front side is closed by a door so that the temperature of the storage compartment can be maintained at normal times.

The storage compartment is partitioned off by a barrier wall into upper and lower portions. The refrigerator door that opens/closes a refrigerator compartment disposed on the upper portion of the storage compartment is configured of a side by side type door that is rotatably coupled to the main body, and the refrigerator door that opens/closes a freezer compartment disposed on the lower portion of the storage compartment is a drawer type door that slides in a forward/backward direction.

A lamp is installed in the storage compartment and emits light when the door is opened, so that a user can easily identify food stored in the storage compartment.

Since the lamp is installed in the storage compartment, even when the door is opened and the lamp emits light, the user cannot easily identify food inside a door guard disposed at a rear side of the door.

SUMMARY

Therefore, it is an aspect of the present disclosure to provide a refrigerator having an improved structure in which, when a first door or a second door is opened, a lamp installed at sidewalls of an opening in the first door emits light so that visibility of food stored in a door guard disposed in the opening can be improved.

Additional aspects of the disclosure will be set forth in part in the description which follows and, in part, will be apparent from the description, or may be learned by practice of the disclosure.

In accordance with one aspect of the present disclosure, a refrigerator includes: a main body having a storage compartment; a first door that is rotatably disposed in front of the main body, opens/closes the storage compartment, and has an opening formed therein, wherein at least one door guard is disposed in the opening; a second door that is rotatably disposed in front of the first door, opens/closes the opening, and is rotated in the same direction as the first door; a hinge unit that is coupled to an upper portion of the main body and causes the first door to be rotatably coupled to the main body; at least one lamp installation hole disposed in sidewalls of the opening; at least one lamp fixing member disposed in the sidewalls of the opening in a position corresponding to the at least one lamp installation hole; at least one lamp fixed to the at least one lamp fixing member through the at least one lamp installation hole from an outside of the sidewalls of the opening; an opening/closing detection sensor that is disposed in the hinge unit, detects whether the first door is opened/closed, and causes the at least one lamp to emit light when the first door is opened; and a sensor detection unit that is disposed in an upper portion of the second door in a position corresponding to the opening/closing detection sensor, transfers the result of detection regarding whether the second door is opened/closed, to the opening/closing detection sensor, and causes the at least one lamp to emit light when the second door is opened.

The first door may include a cabinet that constitutes an exterior, an internal injection-molded body that constitutes the sidewalls of the opening, and an insulating material foamed between the cabinet and the internal injection-molded body, and the insulating material may be foamed between the cabinet and the internal injection-molded body after the at least one lamp fixing member is disposed.

The at least one lamp fixing member may include a seating portion on which the at least one lamp is seated, a plurality of fixing hooks that fix the at least one lamp seated on the seating portion, ribs that are disposed on upper and right and left side edges of the at least one lamp fixing member so as to prevent the insulating material from penetrating into the seating portion, and a wire guide portion that guides a wire for supplying power so that the at least one lamp emits light.

The hinge unit may include a first hinge shaft that causes the first door to be rotatably coupled to the main body, and a first hinge hole into which the first hinge shaft is inserted, may be disposed in an upper portion of the first door.

A hinge cover that covers the hinge unit may be disposed in a top end of the main body, and electronic apparatus components may be accommodated in the hinge cover.

The wire for supplying power so that the at least one lamp emits light, may be connected to the electronic apparatus components and may be guided into the main body through the first hinge hole, and the wire guided into the main body may be guided by the wire guide portion and may be connected to the at least one lamp.

When the first door is opened, the opening/closing detection sensor may detect that the first door is opened, and may cause the at least one lamp to emit light so that food stored in the at least one door guard can be identified, and when the first door is closed, the opening/closing detection sensor may detect that the first door is closed, and may cut off power supplied to the at least one lamp.

The opening/closing detection sensor may detect a distance at which the sensor detection unit is spaced apart from the opening/closing detection sensor.

When the second door is opened, the sensor detection unit may be spaced apart from the opening/closing detection sensor, and the opening/closing detection sensor may detect that the sensor detection unit is spaced apart from the opening/closing detection sensor, and may cause the at least one lamp to emit light so that food stored in the at least one door guard can be identified, and when the second door is closed, the sensor detection unit may approach the opening/closing detection sensor, and the opening/closing detection sensor may detect that the sensor detection unit approaches the opening/closing detection sensor, and may cut off power supplied to the at least one lamp.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
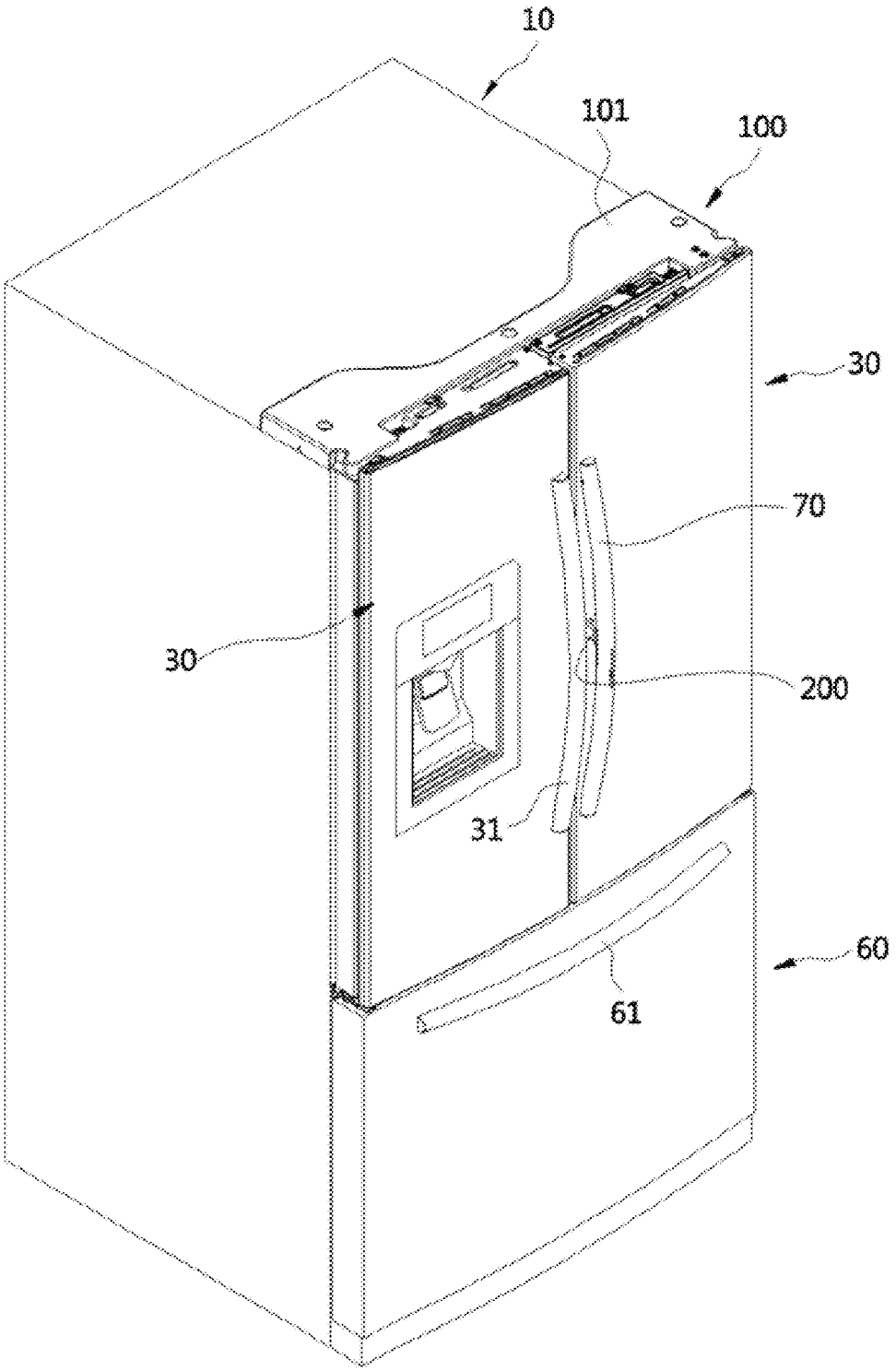
FIG. 1 is a perspective view of a refrigerator in accordance with an embodiment of the present disclosure.

Reference will now be made in detail to the embodiments of the present disclosure, examples of which are illustrated in the accompanying drawings, wherein like reference numerals refer to like elements throughout.

With respect to a front side and a rear side that will be described below, a front side of a main body 10 of a refrigerator is referred to as the front side, and a rear side of the main body 10 of the refrigerator is referred to as the rear side.

Figure 2:
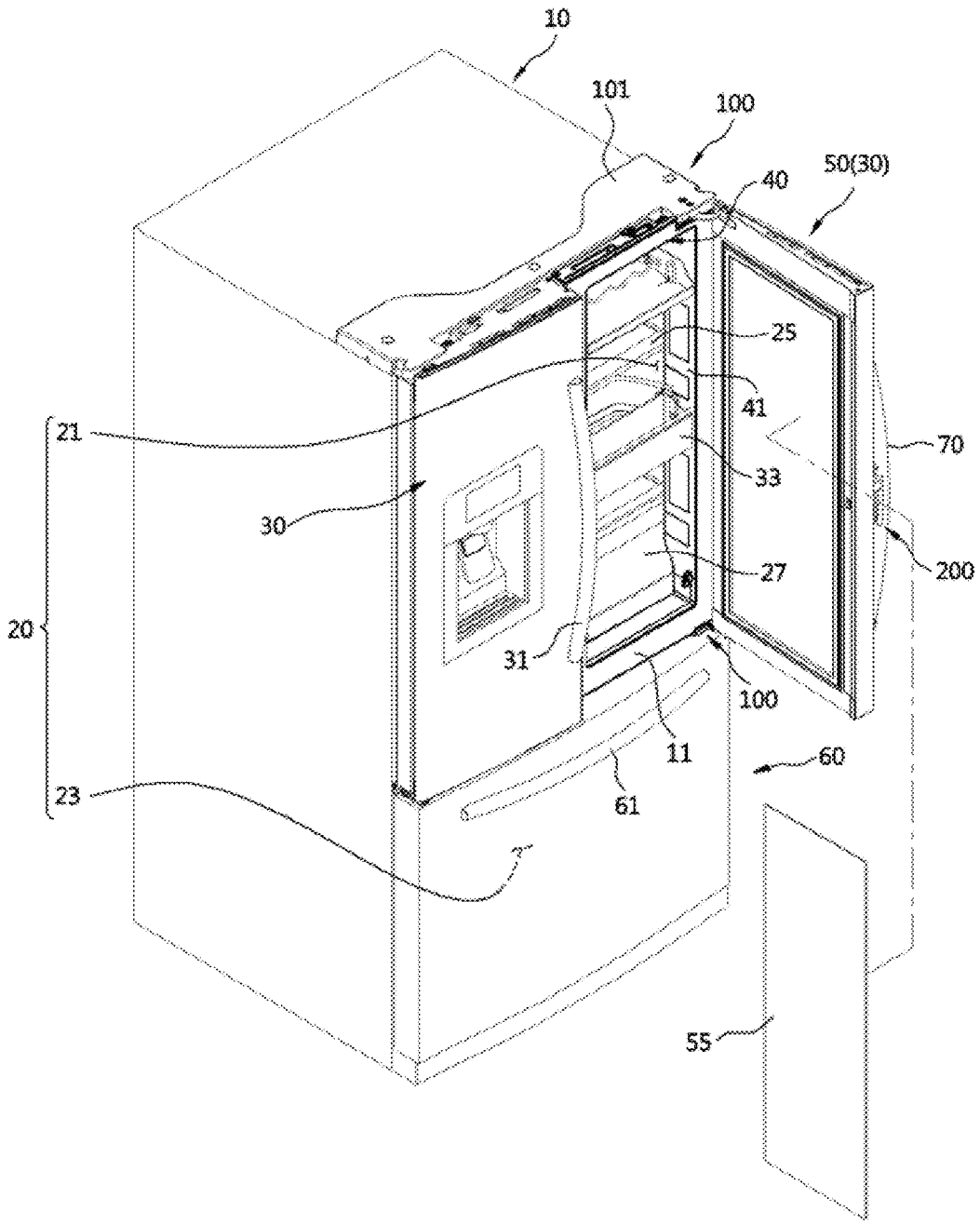
FIG. 2 is a perspective view of a state in which only a second door of FIG. 1 is opened.
Figure 3:
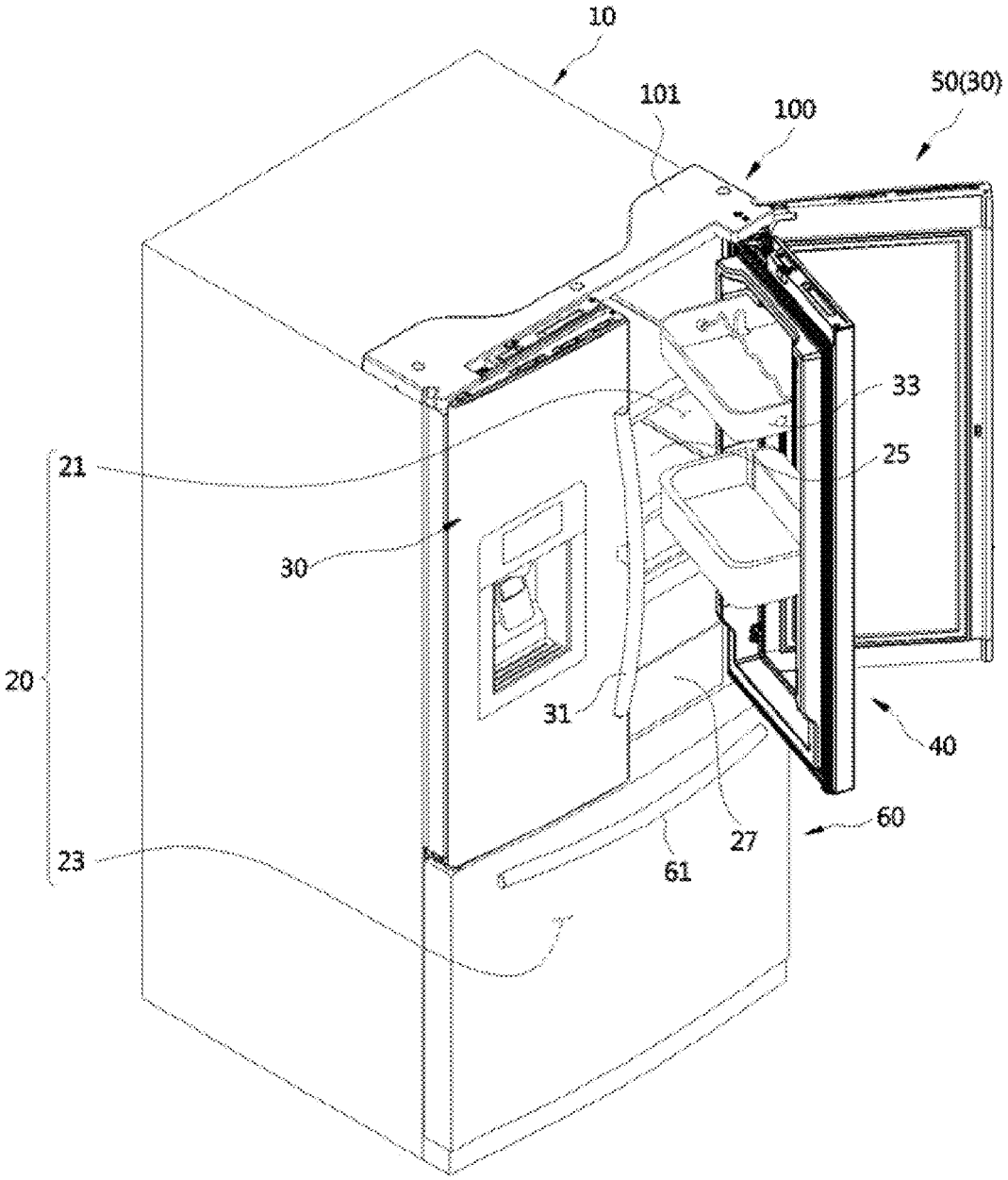
FIG. 3 is a perspective view of a state in which a first door and the second door of FIG. 1 are opened.

As illustrated in FIGS. 1 through 3, the refrigerator includes the main body 10 that constitutes an exterior of the refrigerator, a storage compartment 20 disposed in the main body 10 in such a way that a front side of the storage compartment 20 is opened, and doors 30 and 60 that open/close the storage compartment 20.

The main body 10 includes an inner case (not shown) that constitutes the storage compartment 20, an outer case (not shown) that constitutes an exterior of the main body 10, and a cold air supplying unit (not shown) that supplies cold air to the storage compartment 20.

The cold air supplying unit may include a compressor, a condenser, an expansion valve, an evaporator, a blower fan, and a cold air duct. An insulating material (not shown) is foamed between the inner case and the outer case of the main body 10 so as to prevent cold air of the storage compartment 20 from being discharged to the outside.

A machine compartment (not shown) in which the compressor that compresses a refrigerant and the condenser that condenses the compressed refrigerant are installed, is provided in a lower side of the rear of the main body 10.

The storage compartment 20 is partitioned off by a barrier wall 11 into upper and lower portions. A refrigerator compartment 21 is disposed in an upper portion of the main body 10, and a freezer compartment 23 is disposed in a lower portion of the main body 10.

A plurality of shelves 25 may be disposed in the refrigerator compartment 21 and may partition off the refrigerator compartment 21 into a plurality of portions. A plurality of storage containers 27 in which food is stored, may be disposed.

The refrigerator compartment 21 is opened/closed by a pair of refrigerator compartment doors 30 rotatably coupled to the main body 10. The freezer compartment 23 is opened/closed by a freezer compartment door 60 that slides in a forward/backward direction.

Handles 31 and 61 are disposed on the refrigerator compartment door 30 and the freezer compartment door 60 so that a user may open/close the refrigerator compartment door 30 and the freezer compartment door 60 by grasping the handles 31 and 61.

The refrigerator compartment door 30 disposed on the right of the drawing of the pair of refrigerator compartment doors 30 may have a structure of a double door.

The right refrigerator compartment door 30 having the structure of the double door includes a first door 40 that is rotatably disposed in front of the main body 10 and opens/closes the refrigerator compartment 21, and a second door 50 that is rotatably disposed in front of the first door 40 and rotated in the same direction as the first door 40.

An opening 41 is disposed in the first door 40, and a plurality of door guards 33 are disposed in the opening 41.

The opening 41 disposed in the first door 40 is opened/closed by the second door 50 disposed in front of the first door 40.

A cooling plate 55 may be disposed on a rear side of the second door 50 and may be formed of an aluminum (Al) material.

Since the cooling plate 55 is formed of the Al material, when the second door 50 is closed, the cooling plate 55 may be uniformly cooled by thermal conduction caused by cold air inside the refrigerator compartment 21 so that the temperature of the entire refrigerator compartment 21 may be uniform.

The material used to form the cooling plate 55 is not limited to the Al material but may be formed of a different metal material having good thermal conduction efficiency.

Since one side of the refrigerator compartment door 30 has the structure of the double door, when the plurality of door guards 33 disposed in the opening 41 of the first door 40 are used, only the second door 50 is opened without the need of opening the whole of the refrigerator compartment door 30 so that cold air discharge caused by opening/closing of the refrigerator compartment door 30 may be minimized and the energy reduction effect may be achieved.

A handle 70 to which a latch unit 200 that causes the first door 40 and the second door 50 to be selectively opened/closed, is coupled, is disposed on the second door 50. This will be described later.

The first door 40 and the second door 50 are rotatably coupled to the main body 10 and the first door 40, respectively, using a hinge unit 100.

As illustrated in FIGS. 4 and 5 and FIGS. 13 and 14, the hinge unit 100 may include a first upper hinge 110 that is coupled to the upper portion of the main body 10 so that the first door 40 may be rotatably coupled to the main body 10, a second upper hinge 120 that is coupled to an upper portion of the first door 40 so that the second door 50 may be rotatably coupled to the first door 40, a first lower hinge 130 that is coupled to the lower portion of the main body 10 corresponding to a lower portion of the first door 40 so that the first door 40 may be rotatably coupled to the main body 10, and a second lower hinge 140 that is coupled to the lower portion of the first door 40 so that the second door 50 may be rotatably coupled to the first door 40.

Figure 4:
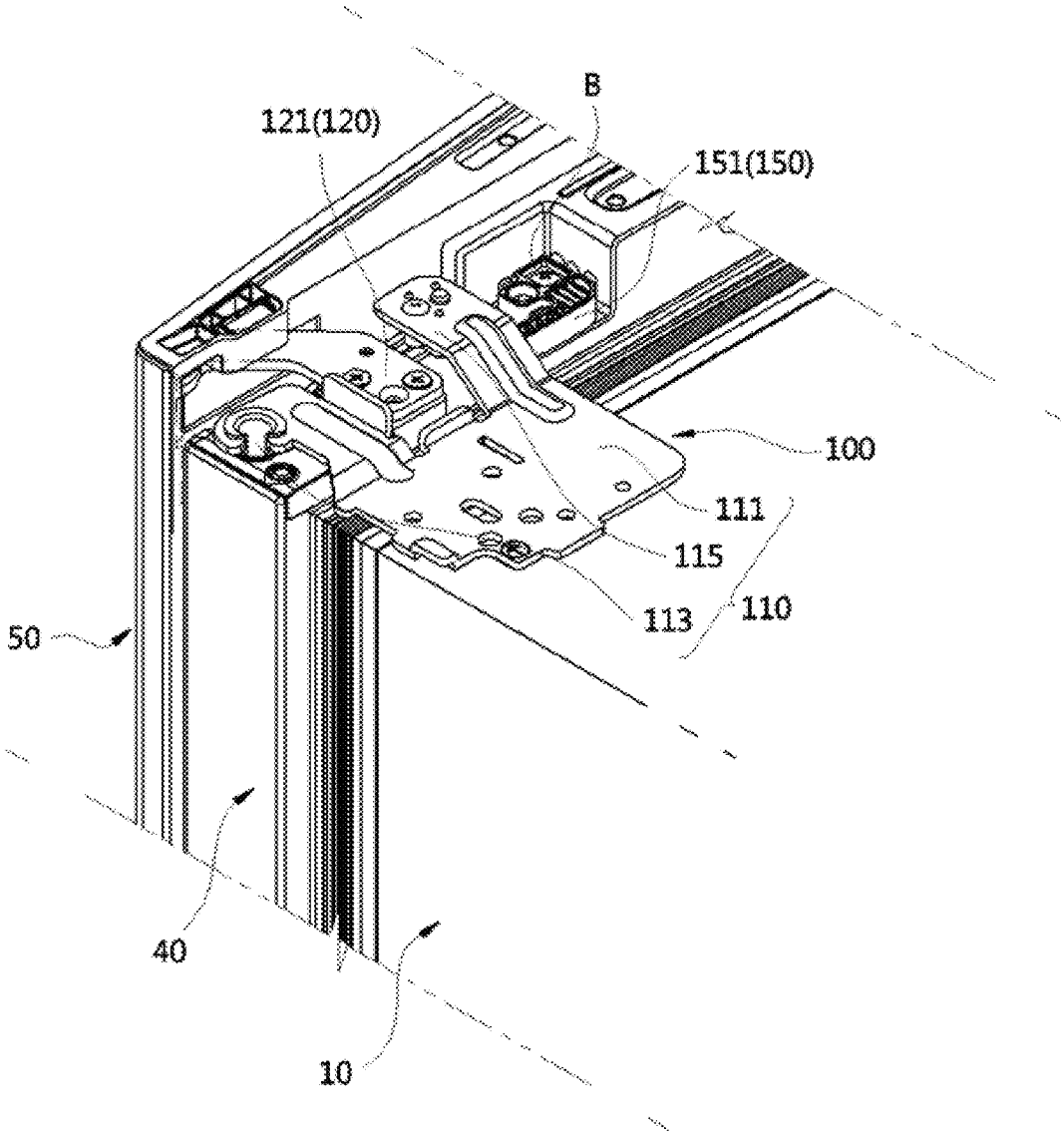
FIG. 4 is a view of a state in which a hinge unit and a first elastic lever are coupled to an upper portion of the refrigerator in accordance with the embodiment of the present disclosure.
Figure 5:
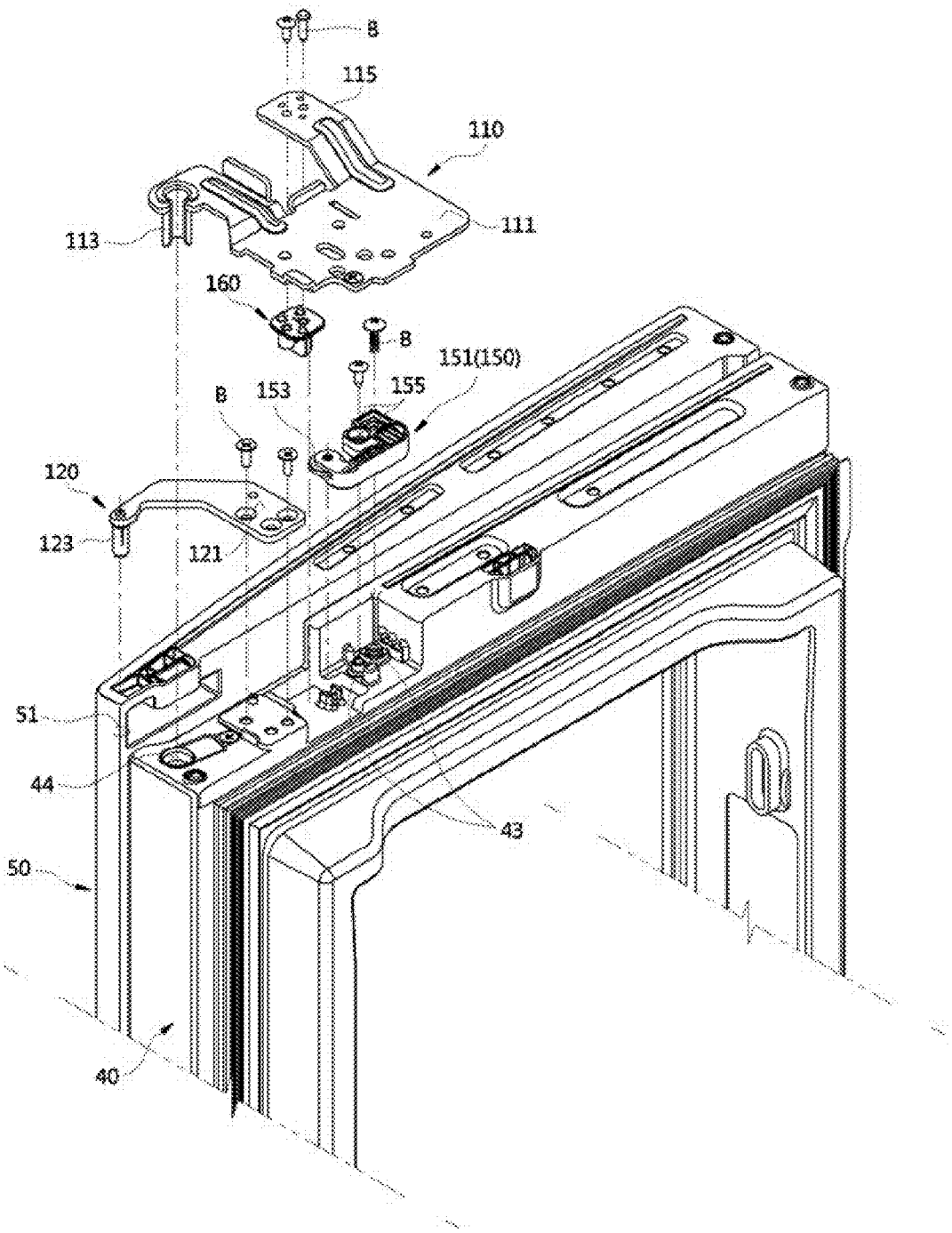
FIG. 5 is a view of a state in which the hinge unit, the first elastic lever, and a cam member of FIG. 4 are disassembled.
Figure 6:
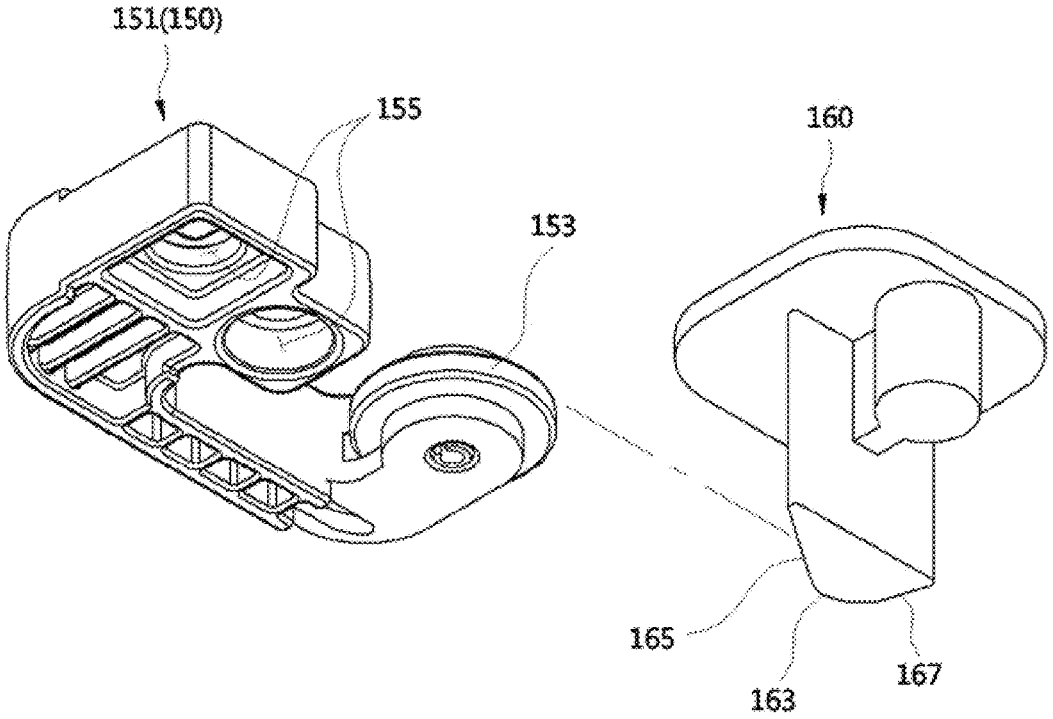
FIG. 6 is a perspective view of the first elastic lever and the cam member in accordance with the embodiment of the present disclosure.

As illustrated in FIGS. 4 through 6, the first upper hinge 110 includes a first coupling portion 111 coupled to the main body 10, a first hinge shaft 113 that causes the first door 40 to be rotatably coupled to the main body 10, and a cam member coupling portion 115 which extends from the first coupling portion 111 toward the first door 40 and to which a cam member 160 that will be described below is coupled.

The first coupling portion 111 is coupled to the upper portion of the main body 10 by using a fastening member B. The first hinge shaft 113 is disposed in a portion that extends from the first coupling portion 111 toward the first door 40 and is rotatably inserted into a first hinge hole 44 disposed in the upper portion of the first door 40.

Thus, the first door 40 is rotated about the first hinge shaft 113 to open/close the refrigerator compartment 21.

The second upper hinge 120 includes a second coupling portion 121 coupled to the upper portion of the first door 40 and a second hinge shaft 123 that causes the second door 50 to be rotatably coupled to the first door 40.

The second coupling portion 121 is coupled to the upper portion of the first door 40 by using the fastening member B. The second hinge shaft 123 is disposed in a portion that extends from the second coupling portion 121 toward the second door 50 and is rotatably inserted into a second hinge hole 51 disposed in an upper portion of the second door 50.

The second hinge hole 51 disposed in the upper portion of the second door 50 and the second hinge shaft 123 inserted into the second hinge hole 51 are disposed not to be exposed to the outside in view of sides or the upper portion of the main body 10, have aesthetic appeal, and be able to prevent foreign substances, such as dust, from penetrating into the second hinge hole 51 through the sides or the upper portion of the main body 10.

Thus, the second door 50 is rotated about the second hinge shaft 123 so as to open/close the opening 41 disposed in the first door 40.

An elastic lever 150 is disposed in the first door 40 so as to transfer an elastic force in a direction in which the first door 40 is closed, so that the first door 40 may be in close contact with the main body 10 when it is closed.

The elastic lever 150 includes a first elastic lever 151 that is disposed in the upper portion of the first door 40 and transfers an elastic force in the direction in which the first door 40 is closed, so that the first door 40 may be in close contact with the main body 10 when it is closed and thus leakage of cold air may be prevented, and a second elastic lever 157 that is disposed in the lower portion of the first door 40 and transfers the elastic force in the direction in which the first door 40 is closed, so that the first door 40 may be in close contact with the main body 10 when it is closed and thus leakage of cold air may be prevented.

Since the elastic levers 151 and 157 are disposed in the upper and lower portions of the first door 40 and are in close contact with the main body 10 when the first door 40 is closed, leakage of cold air may be prevented in both the upper and lower portions of the first door 40.

The first elastic lever 151 is disposed to be bent in a '⊏' shape to have elasticity. A second fastening hole 155 fastened into a first coupling hole 43 disposed in the upper portion of the first door 40 is disposed at one side of the first elastic lever 151 by using the fastening member B. A roller 153 is disposed at the other side of the first elastic lever 151 so as to be in contact with a cam surface 161 of the cam member 160 and to move along a shape of the cam surface 161 when the first door 40 is closed.

The roller 153 is maintained to not be in contact with the cam surface 161 of the cam member 160 in a state in which the first door 40 is fully opened, and when the roller 153 is in contact with the cam surface 161 while the first door 40 is closed, the first elastic lever 151 is compressed and accumulates an elastic force.

When the first door 40 is closed in a state in which the roller 153 is in contact with the cam surface 161, the roller 153 moves along the shape of the cam surface 161 and transfers the accumulated elastic force in a direction in which the first door 40 is closed, so that the first door 40 may be in close contact with the main body 10.

A description of the second elastic lever 157 will be provided below.

The cam member 160 is coupled to the cam member coupling portion 115 that extends from the first coupling portion 111 of the first upper hinge 110 toward the first door 40. When the first door 40 is closed, the cam member 160 is in contact with the first elastic lever 151 and has the cam surface 161 on which the first elastic lever 151 accumulates the elastic force and then transfers the elastic force to the first door 40.

The cam surface 161 includes an inflexion point 163 that is a base point when the first door 40 is opened/closed, and a first contact surface 165 and a second contact surface 167 respectively disposed at lower and upper sides of the inflexion point 163 so as to have opposite inclined surfaces based on the inflexion point 163.

In a state in which the first door 40 is fully opened, the roller 153 of the first elastic lever 151 is not in contact with the cam surface 161 of the cam member 160, and while the first door 40 is closed, the roller 153 is in contact with the first contact surface 165 of the cam surface 161.

The roller 153 that contacts the first contact surface 165 is sequentially in contact with the first contact surface 165, the inflexion point 163, and the second contact surface 167 while the first door 40 is closed, and moves so that the first elastic lever 151 accumulates the elastic force and transfers the elastic force to the first door 40 in the direction in which the first door 40 is closed, so that the first door 40 may be in close contact with the main body 10.

Next, an operation in which the first door 40 is in close contact with the main body 10 by the first elastic lever 151 and the cam member 160 when the first door 40 is closed, will be described with reference to FIGS. 7 through 12.

Figure 7:
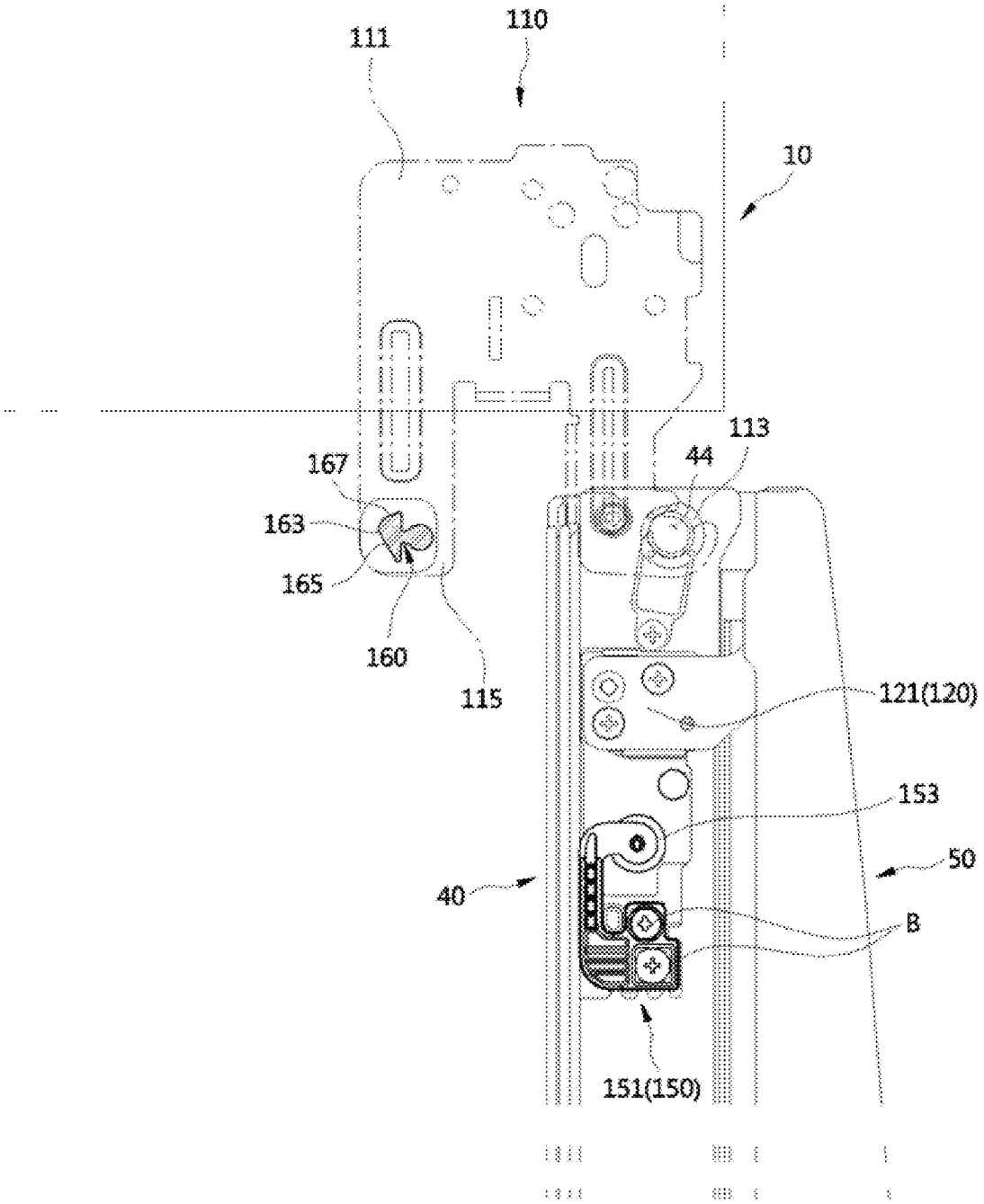
FIG. 7 is a view of a state in which the first door and the second door of the refrigerator in accordance with the embodiment of the present disclosure are opened together.

As illustrated in FIG. 7, in a state in which the first door 40 is fully opened, the first elastic lever 151 is maintained not to be in contact with the cam surface 161 of the cam member 160.

Figure 8:
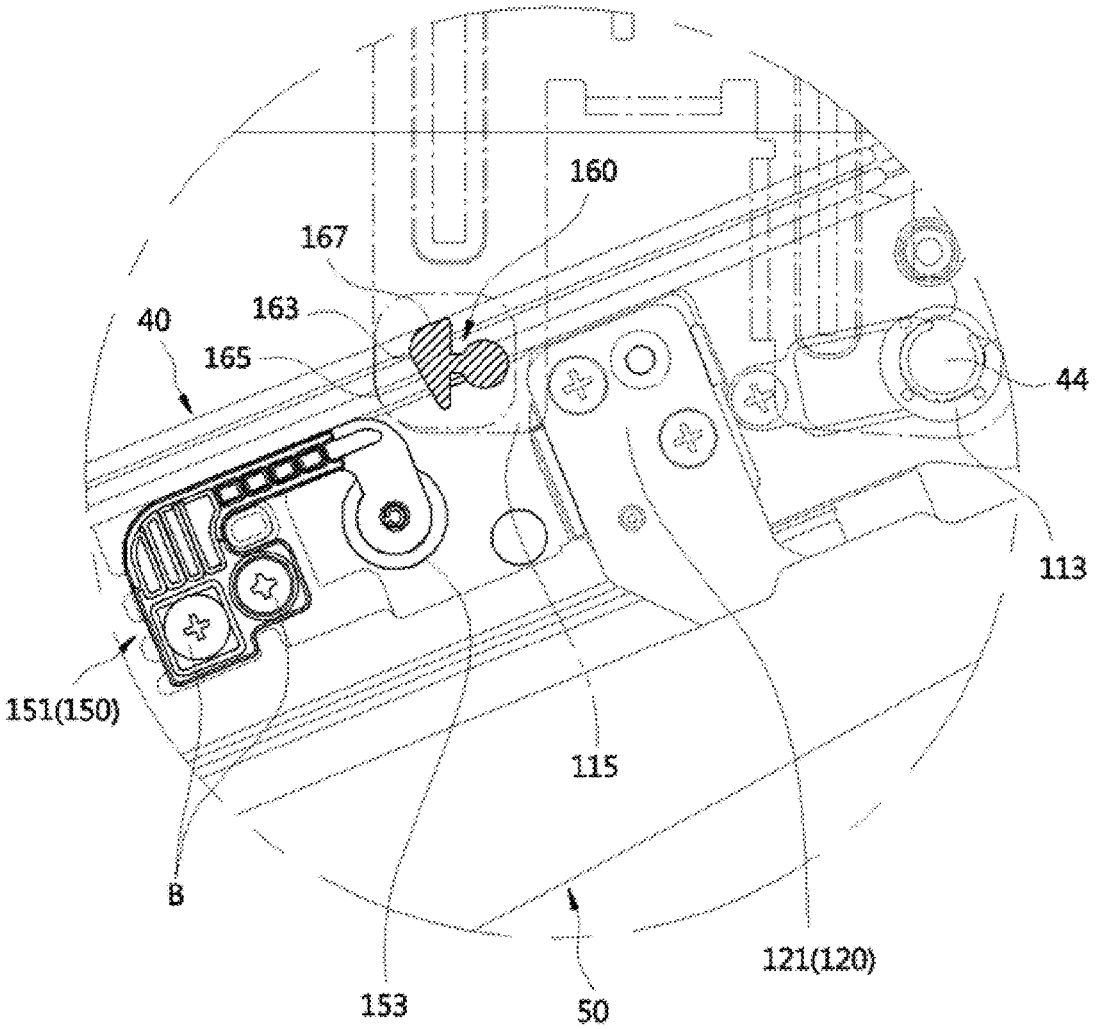
FIGS. 8 through 12 are views of an operation of closing the first door and the second door in the state of FIG. 7.
Figure 9:
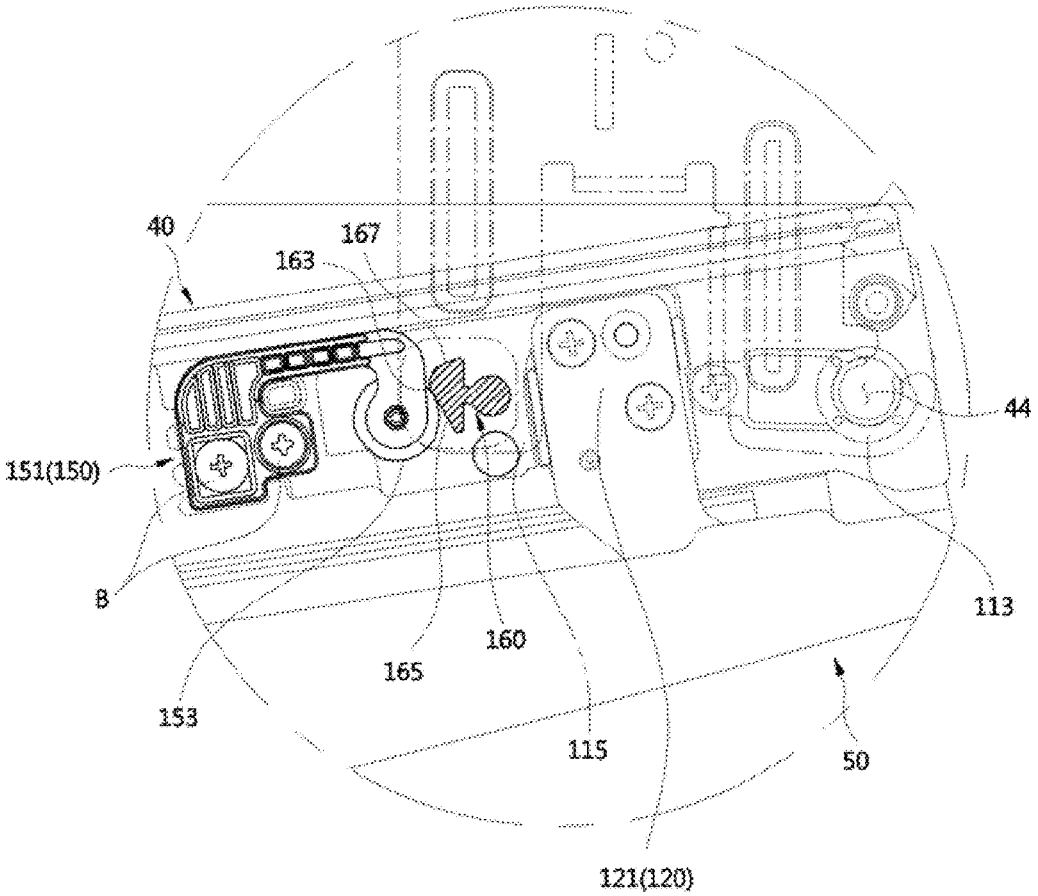

When, in the state in which the first door 40 is fully opened, as illustrated in FIGS. 8 and 9, the first door 40 is somewhat closed, the roller 153 of the first elastic lever 151 is in contact with the cam surface 161 of the cam member 160.

Figure 10:
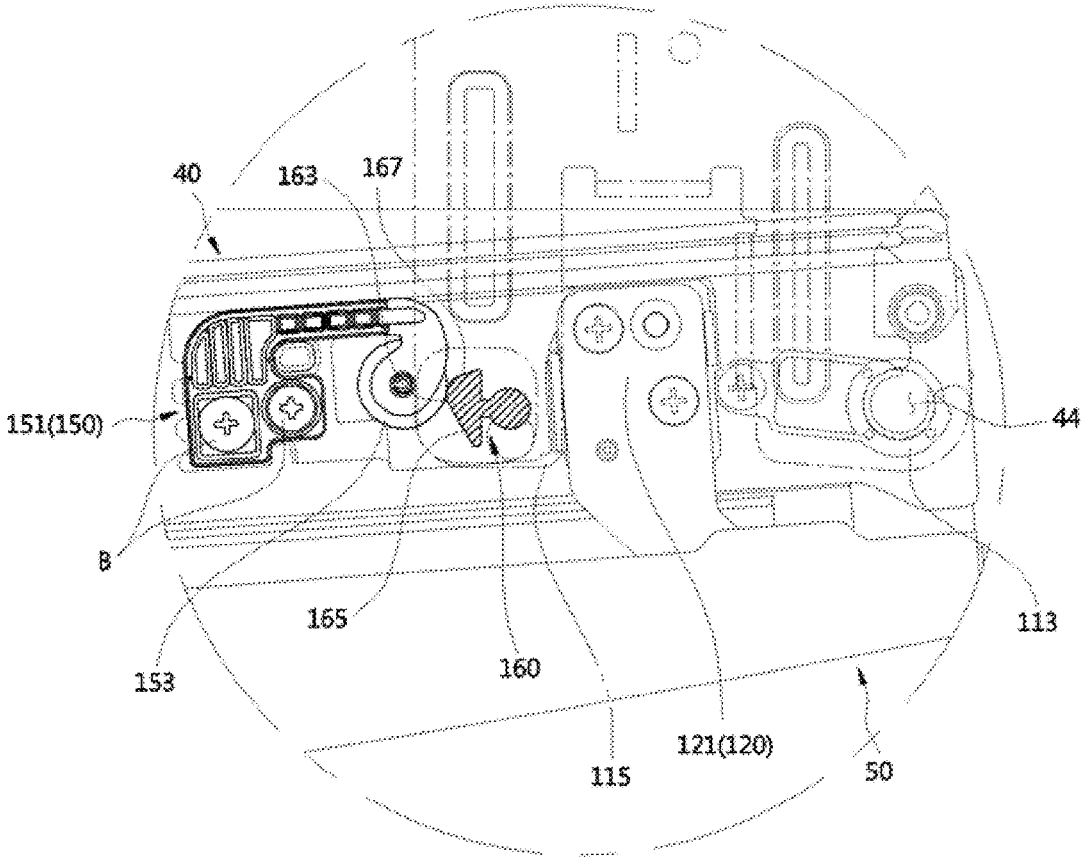

The roller 153 is primarily in contact with the first contact surface 165 of the cam surface 161. When, in a state in which the roller 153 is in contact with the first contact surface 165, the roller 153 is pushed in the direction in which the first door 40 is closed, as illustrated in FIG. 10, as the roller 153 moves toward the lower portion of the first contact surface 165, the first elastic lever 151 is compressed and accumulates the elastic force.

Figure 11:
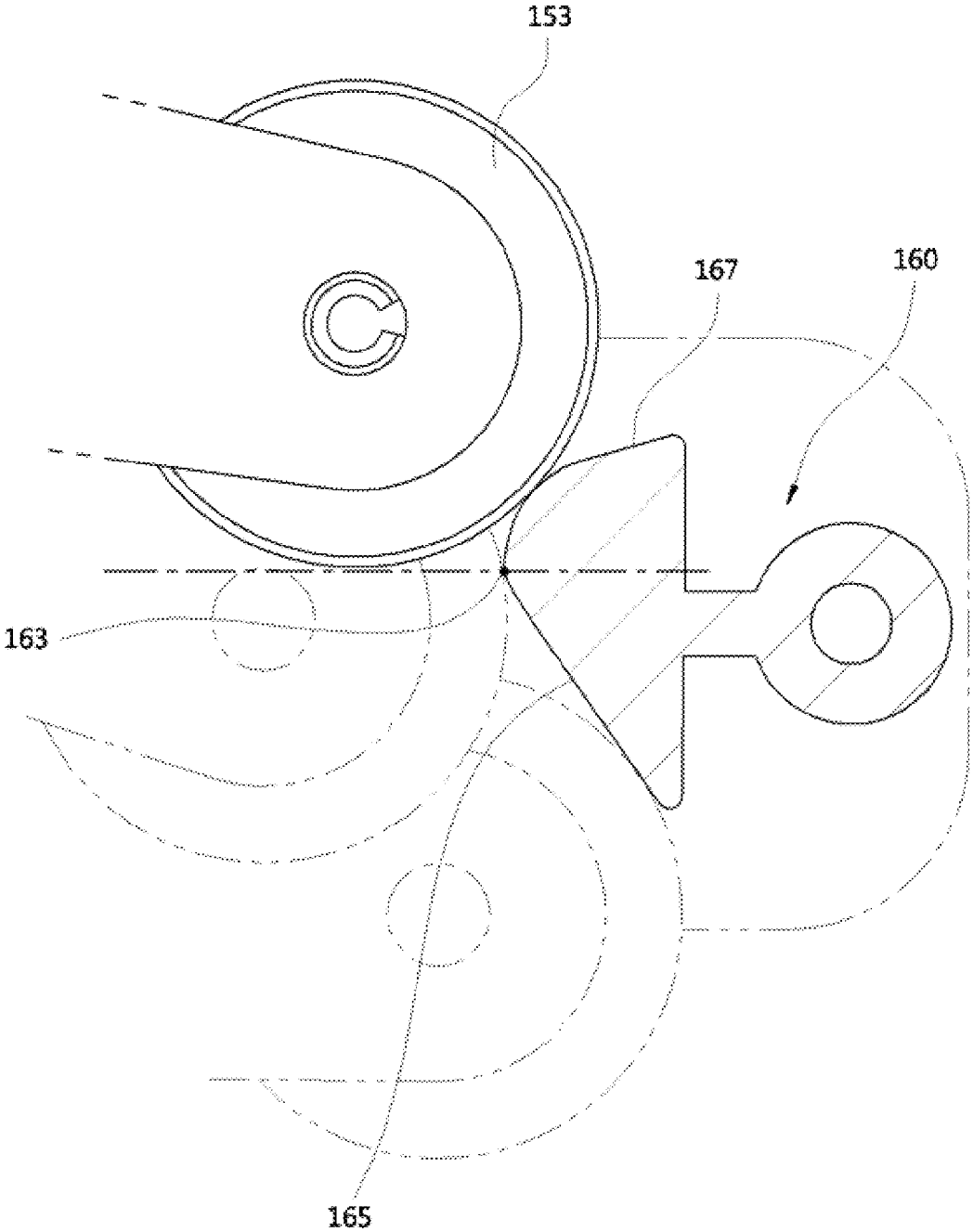

When, in a state in which the first elastic lever 151 accumulates the elastic force, the roller 153 is further pushed in the direction in which the first door 40 is closed, as illustrated in FIG. 11, the roller 153 moves upward along the first contact surface 165 of the cam surface 161, passes through the inflexion point 163, and moves toward the second contact surface 167.

Figure 12:
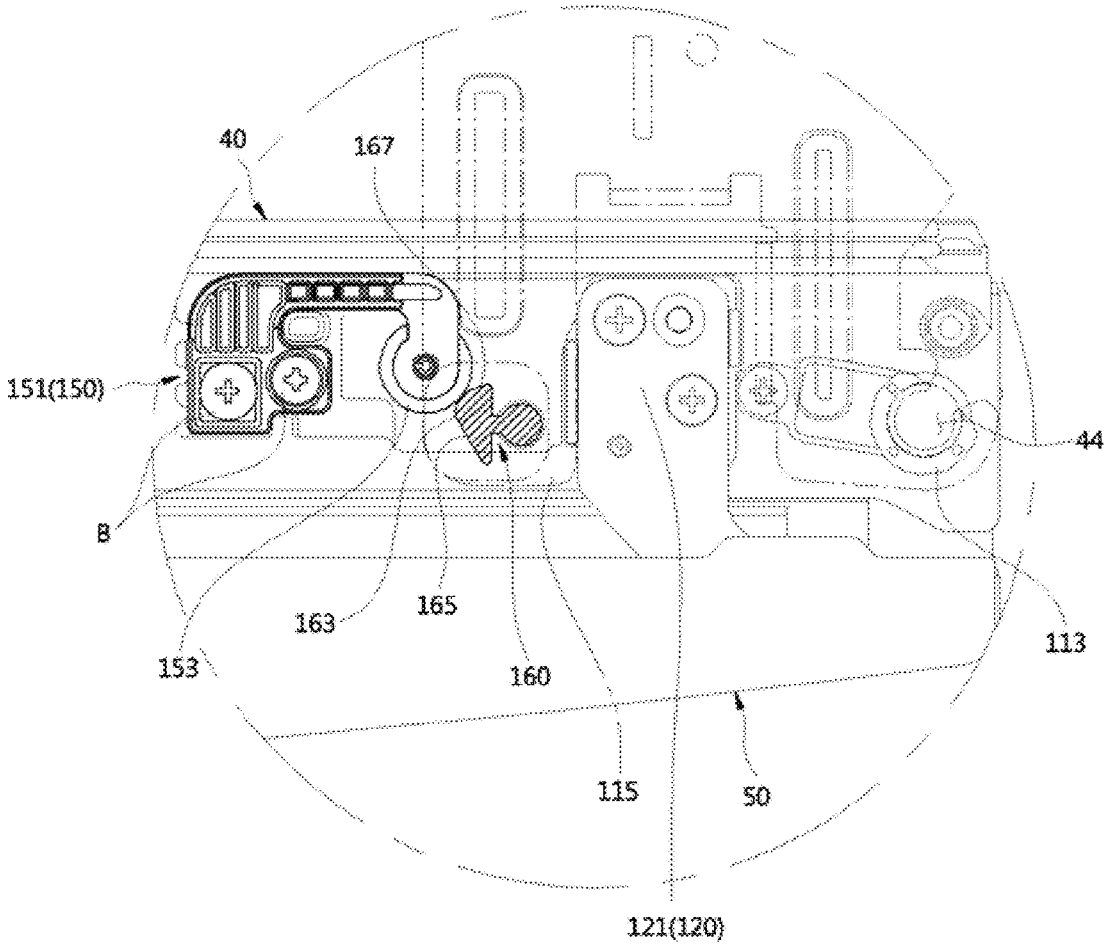

As the roller 153 moves toward the second contact surface 167 of the cam surface 161 and is supported on the second contact surface 167, the first elastic lever 151 transfers the accumulated elastic force to the first door 40, and the first door 40 is fully closed by the transferred elastic force, as illustrated in FIG. 12.

When the first door 40 is closed, the first door 40 receives an elastic force in the direction in which the first door 40 is closed, by the elastic force that remains in the first elastic lever 151 and is maintained to be fully in close contact with the main body 10.

Although not shown, when the first door 40 is opened, the roller 153 is sequentially in contact with the second contact surface 167 of the cam surface 161, the inflexion point 163, and the first contact surface 165 and moves. Before the roller 153 passes through the inflexion point 163, the first door 40 is maintained in a closed state. Thus, even when the other-side refrigerator compartment door 30 is rapidly closed, the first door 40 may be maintained in the closed state.

The above-described operations may be applied to both a case where the first door 40 is closed together with the second door 50 or only the first door 40 is closed.

Figure 13:
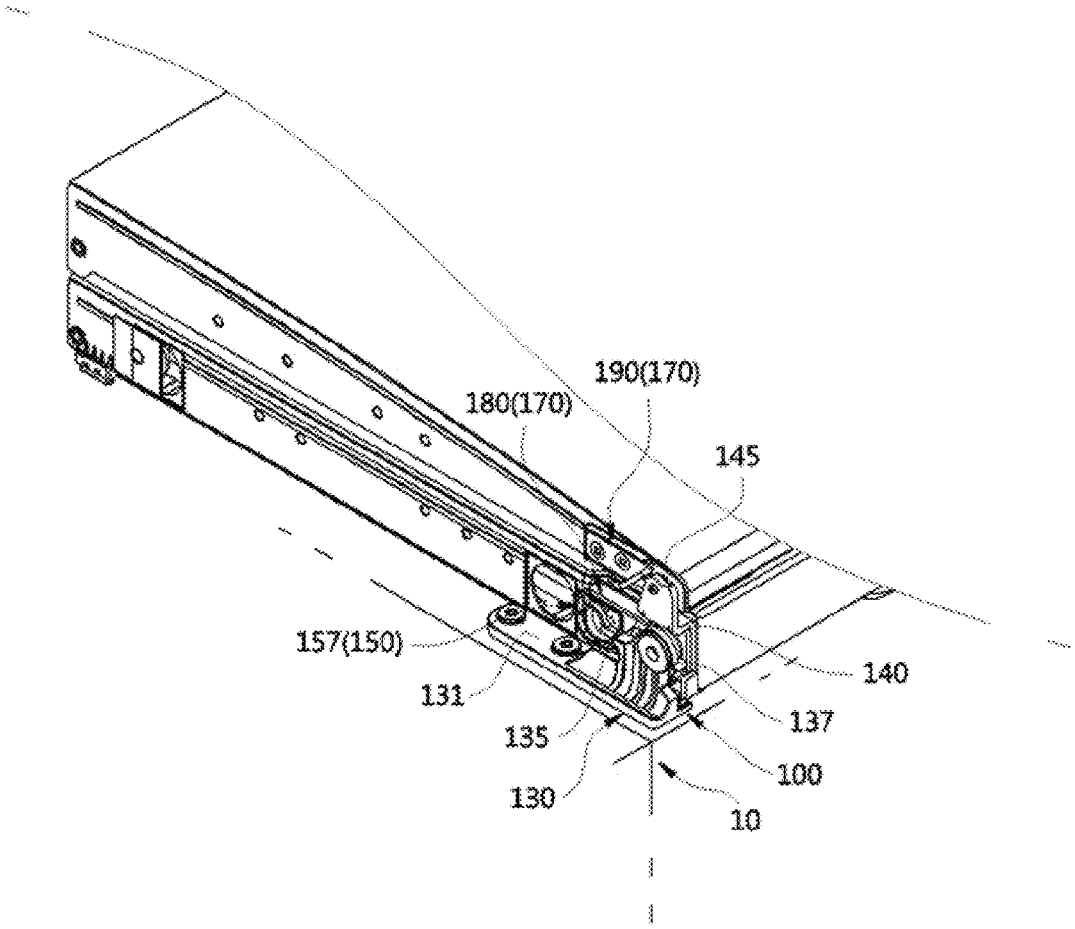
FIG. 13 is a view of a state in which the hinge unit, a second elastic lever, and a stopping member are coupled to a lower portion of the refrigerator in accordance with the embodiment of the present disclosure.
Figure 14:
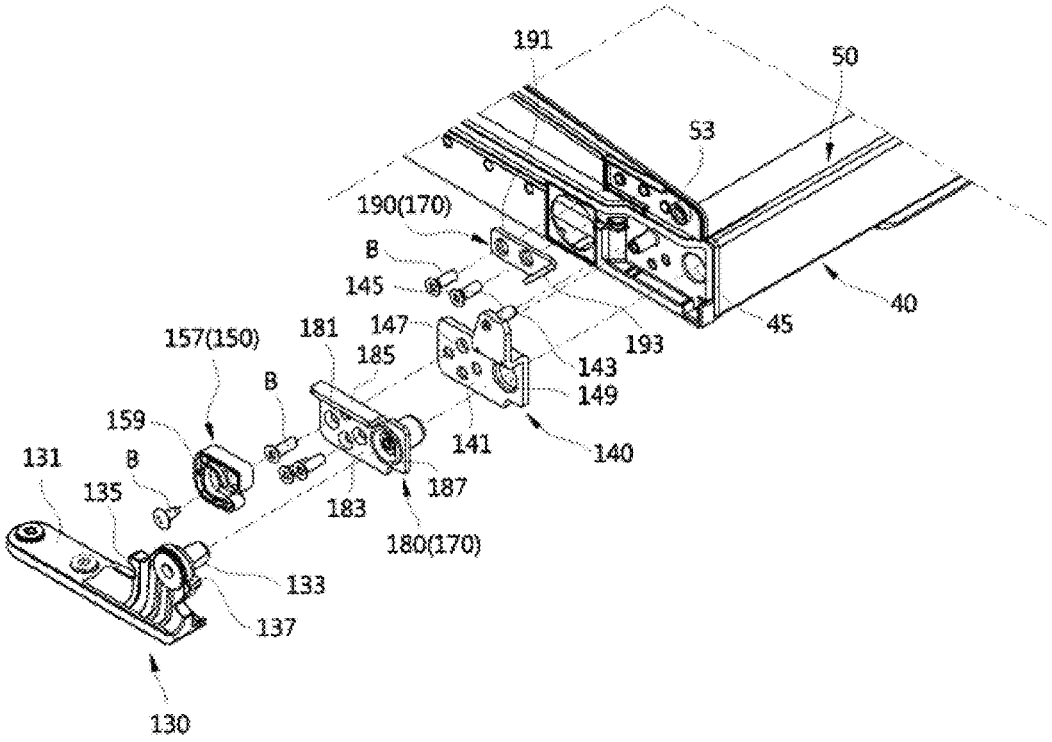
FIG. 14 is a view of a state in which the hinge unit, the second elastic lever, and the stopping member of FIG. 13 are disassembled.

As illustrated in FIGS. 13 and 14, the first lower hinge 130 includes a third coupling portion 131 coupled to the main body 10, a third hinge shaft 133 that causes the first door 40 to be rotatably coupled to the main body 10, an elastic lever contact portion 135 that is in contact with the second elastic lever 157 that will be described later when the first door 40 is closed and by which the second elastic lever 157 accumulates the elastic force and causes the elastic force accumulated on the first door 40 to be transferred, and a first contact portion 137 that is in contact with a first stopping member 180 that will be described later when the first door 40 is opened and that limits an angle at which the first door 40 is opened.

The third coupling portion 131 is coupled to the main body 10 by the fastening member B, and the third hinge shaft 133 is disposed in a portion that extends from the third coupling portion 131 to the first door 40 and is rotatably inserted into a third hinge hole 45 disposed in the lower portion of the first door 40.

Thus, the first door 40 is rotated about the third hinge shaft 133 to open/close the refrigerator compartment 21.

The second elastic lever 157 is disposed to be bent in the '⊏' shape to have elasticity. One side of the second elastic lever 157 is coupled to a hole 47 inside a protrusion 46 disposed in the lower portion of the first door 40 by the fastening member B, and the other side of the second elastic lever 157 is in contact with the elastic lever contact portion 135 of the first lower hinge 130 when the first door 40 is closed.

The other side of the second elastic lever 157 is maintained to not be in contact with the elastic lever contact portion 135 of the first lower hinge 130 in a state in which the first door 40 is fully opened, and while the first door 40 is closed, if the second elastic lever 157 is in contact with the elastic lever contact portion 135, the second elastic lever 157 is compressed and accumulates the elastic force.

When the first door 40 is closed in a state in which the other side of the second elastic lever 157 is in contact with the elastic lever contact portion 135, the other side of the second elastic lever 157 moves along the surface of the elastic lever contact portion 135 and transfers the accumulated elastic force in the direction in which the first door 40 is closed, so that the first door 40 may be in close contact with the main body 10.

Since the elastic levers 151 and 157 are disposed in the upper and lower portions of the first door 40 and are in close contact with the main body 10 when the first door 40 is closed, both the upper and lower portions of the first door 40 may be in close contact with the main body 10 so that leakage of cold air may be effectively prevented.

The second lower hinge 140 includes a fourth coupling portion 141 coupled to the first door 40, a fourth hinge shaft 143 that causes the second door 50 to be rotatably coupled to the first door 40, a second contact portion 145 that is in contact with a second stopping member 190 that will be described later when the second door 50 is opened and that limits an angle at which the second door 50 is opened, a first insertion hole 147 inserted into and fixed to the protrusion 46 that protrudes from the lower portion of the first door 40, and a first penetration hole 149 that is disposed so that the third hinge shaft 133 of the first lower hinge 130 penetrates into the fourth coupling portion 141.

The protrusion 46 that protrudes to fix the second lower hinge 140 is disposed in the lower portion of the first door 40, and the hole 47 is disposed in the protrusion 46 so that the second lower hinge 140 may be fastened into the hole 47 by using the fastening member B. A fourth hinge hole 53 into which the fourth hinge shaft 143 is rotatably inserted, is disposed in the lower portion of the second door 50.

The first insertion hole 147 of the second lower hinge 140 is disposed in the fourth coupling portion 141. When the first insertion hole 147 is inserted and fixed into the protrusion 46 of the first door 40, the second lower hinge 140 is coupled to the lower portion of the first door 40 by using the fastening member B.

A stopping member 170 is disposed in the lower portion of the first door 40 and the lower portion of the second door 50 so as to limit an angle at which the first door 40 is opened, and an angle at which the second door 50 is opened, and to prevent the first door 40 and the second door 50 from being excessively opened.

The stopping member 170 includes the first stopping member 180 that is coupled to the lower portion of the first door 40 and limits the angle at which the first door 40 is opened, and the second stopping member 190 that is coupled to the lower portion of the second door 50 and limits the angle at which the second door 50 is opened.

The first stopping member 180 includes a second insertion hole 181 inserted into and fixed to the protrusion 46 disposed in the lower portion of the first door 40, a first fixed portion 183 fixed to the lower portion of the first door 40 by using the fastening member B, a first stopper 185 that is in contact with the first contact portion 137 of the first lower hinge 130 when the first door 40 is opened and that stops the first door 40 not to be further opened, and a second penetration hole 187 disposed in the first fixed portion 183 so that the third hinge shaft 133 of the first lower hinge 130 penetrates into the second penetration hole 187.

The first penetration hole 149 disposed in the second lower hinge 140 and the second penetration hole 187 disposed in the first stopping member 180 are disposed in a position corresponding to the third hinge hole 45 disposed in the lower portion of the first door 40 so that the third hinge shaft 133 of the first lower hinge 130 may penetrate into the second penetration hole 187 and the first penetration hole 149 and may be rotatably coupled to the third hinge hole 45.

Since the third hinge shaft 133 of the first lower hinge 130 is configured to penetrate into the second lower hinge 140, the first lower hinge 130 and the second lower hinge 140 may be fastened together to the lower portion of the first door 40 having a small width.

Figure 15:
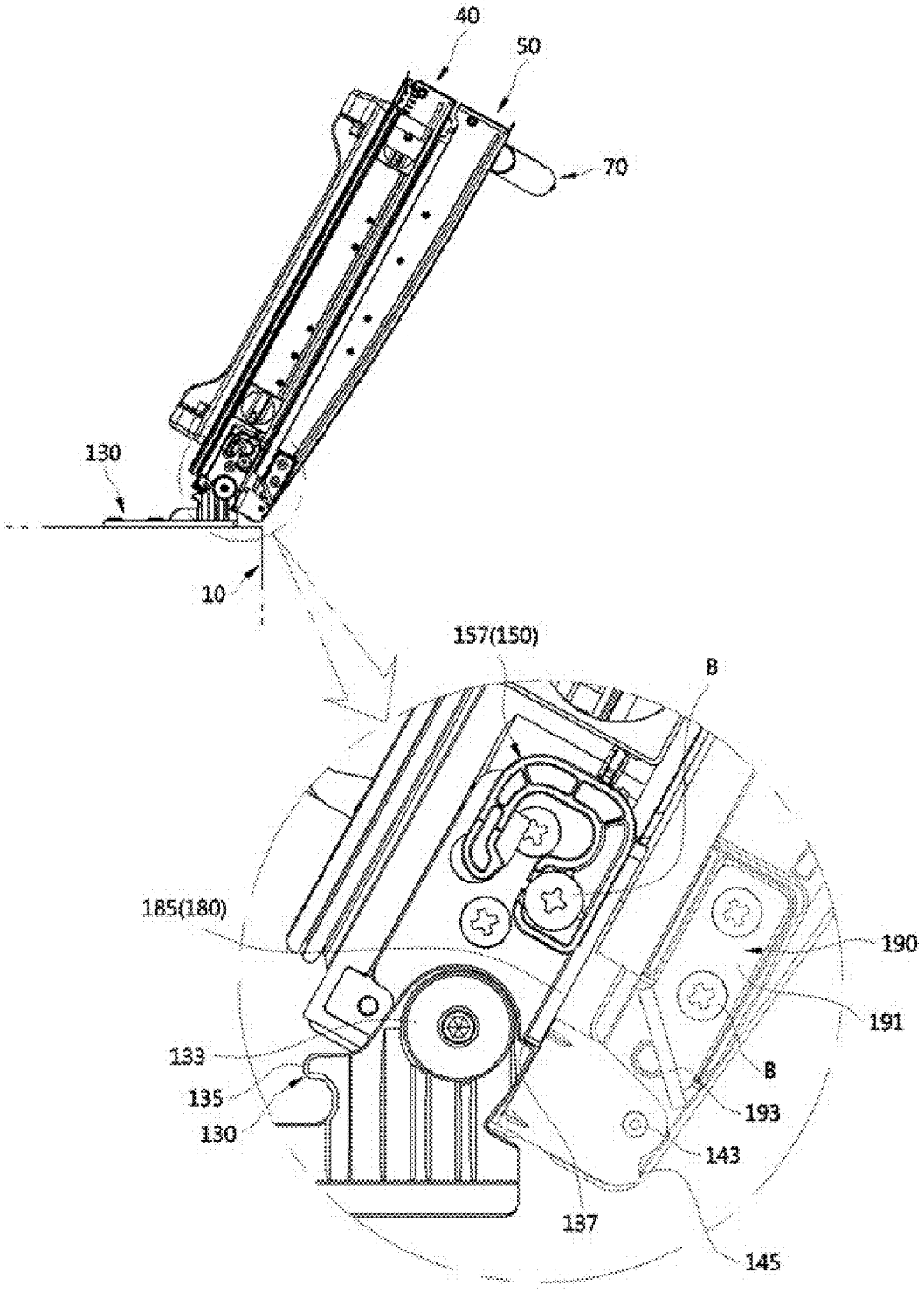
FIG. 15 is a view of a state in which an opened angle of the first door of the refrigerator in accordance with the embodiment of the present disclosure is limited.

As illustrated in FIG. 15, when the first door 40 is opened, the first stopping member 180 fixed to the lower portion of the first door 40 is rotated together with the first door 40, and when the first stopper 185 is in contact with the first contact portion 137, rotation of the first door 40 is stopped and thus the first door 40 is not opened any more.

The second stopping member 190 includes a second fixed portion 191 fixed to the lower portion of the second door 50 by using the fastening member B, and a second stopper 193 that, when the second door 50 is opened, is in contact with the second contact portion 145 of the second lower hinge 140 and stops the second door 50 not to be opened any more.

Figure 16:
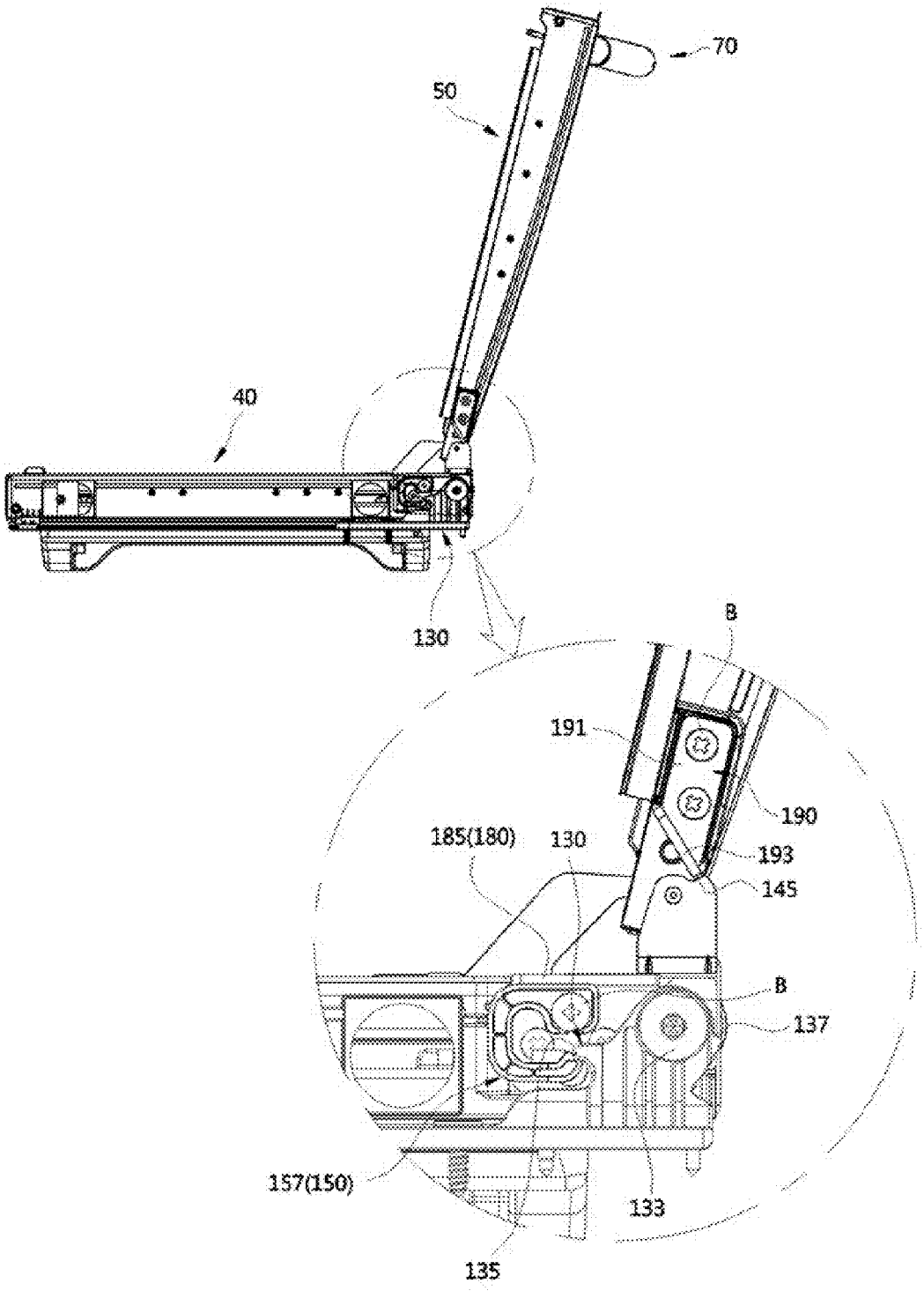
FIG. 16 is a view of a state in which an opened angle of the second door of the refrigerator in accordance with the embodiment of the present disclosure is limited.

As illustrated in FIG. 16, when the second door 50 is opened, the second stopping member 190 fixed to the lower portion of the second door 50 is rotated together with the second door 50, and when the second stopper 193 is in contact with the second contact portion 145, rotation of the second door 50 is stopped and thus the second door 50 is not opened any more.

As illustrated in FIGS. 13 and 14, a configuration in which the second lower hinge 140, the first stopping member 180, and the second elastic lever 157 are coupled to the lower portion of the first door 40, will be described in detail. First, the first insertion hole 147 of the second lower hinge 140 is inserted into and fixed to the protrusion 46 disposed to protrude from the lower portion of the first door 40.

When the second lower hinge 140 is fixed to the lower portion of the first door 40, the first stopping member 180 is placed in a lower portion of the second lower hinge 140 so that the second insertion hole 181 of the first stopping member 180 may be inserted into and fixed to the protrusion 46.

When the second lower hinge 140 and the first stopping member 180 are fixed to the lower portion of the first door 40, the second lower hinge 140 and the first stopping member 180 are coupled to the lower portion of the first door 40 by using the fastening member B.

When the second lower hinge 140 and the first stopping member 180 are coupled to the lower portion of the first door 40, the second elastic lever 157 is placed in the lower portion of the first stopping member 180 so that a third insertion hole 159 may be inserted into the protrusion 46 and may fix the second elastic lever 157.

When the second elastic lever 157 is fixed, the fastening member B is inserted into the third insertion hole 159 and is fastened into the hole 47 disposed in the protrusion 46 so that the second elastic lever 157 may be coupled to the lower portion of the first door 40.

Next, an operation in which, when the first door 40 is closed, the first door 40 is closed to be in close contact with the main body 10 by the second elastic lever 157 and the elastic lever contact portion 135 of the first lower hinge 130, will be described with reference to FIGS. 17 through 20.

Figure 17:
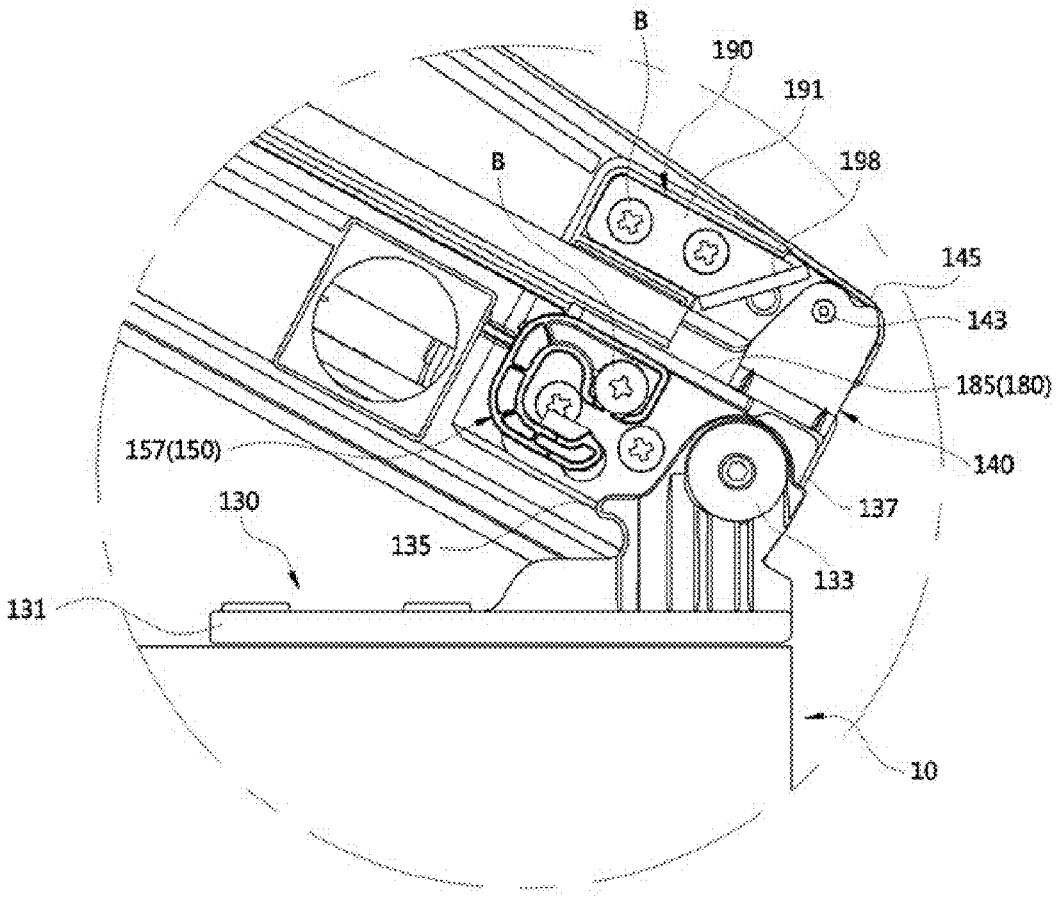
FIGS. 17 through 20 are views of an operation of closing the first door and the second door of the refrigerator in accordance with the embodiment of the present disclosure.

As illustrated in FIG. 17, in a state in which the first door 40 is opened, the second elastic lever 157 is maintained not to be in contact with the elastic lever contact portion 135 of the first lower hinge 130.

Figure 18:
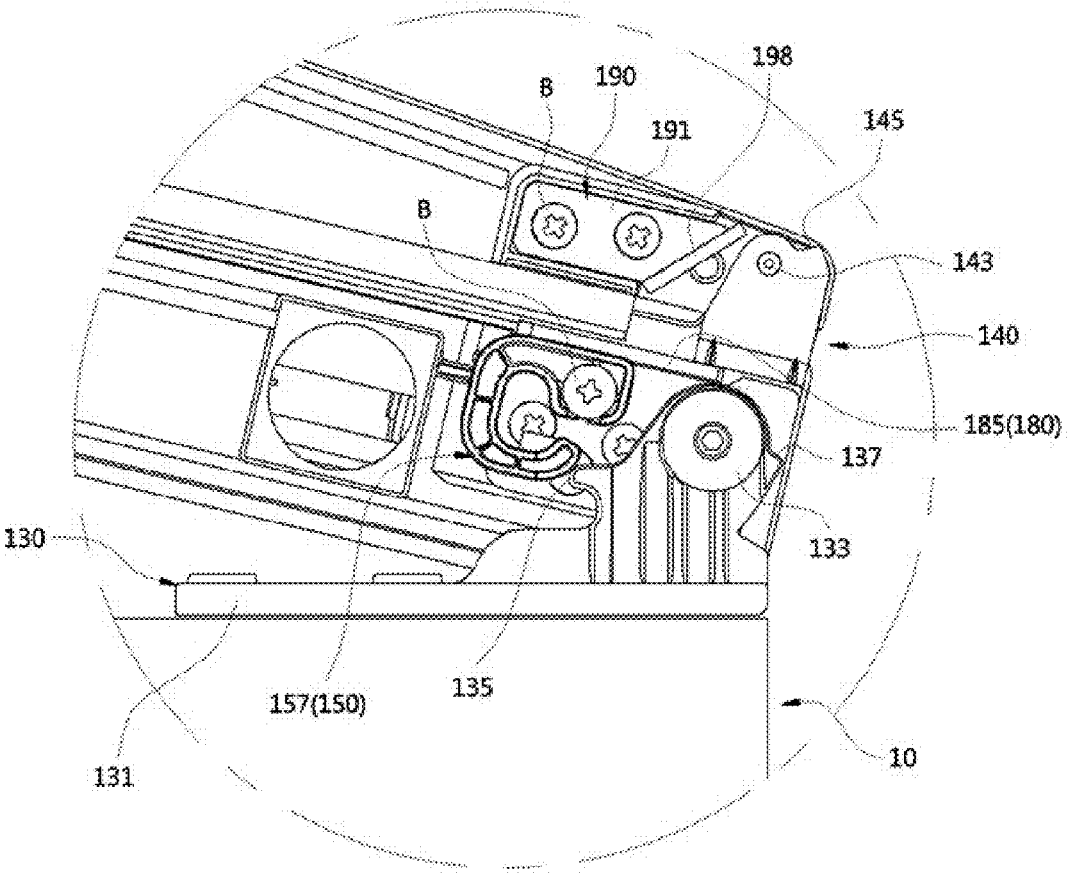

When, in a state in which the first door 40 is opened, as illustrated in FIG. 18, the first door 40 is somewhat closed, the other side of the second elastic lever 157 is in contact with the elastic lever contact portion 135.

Figure 19:
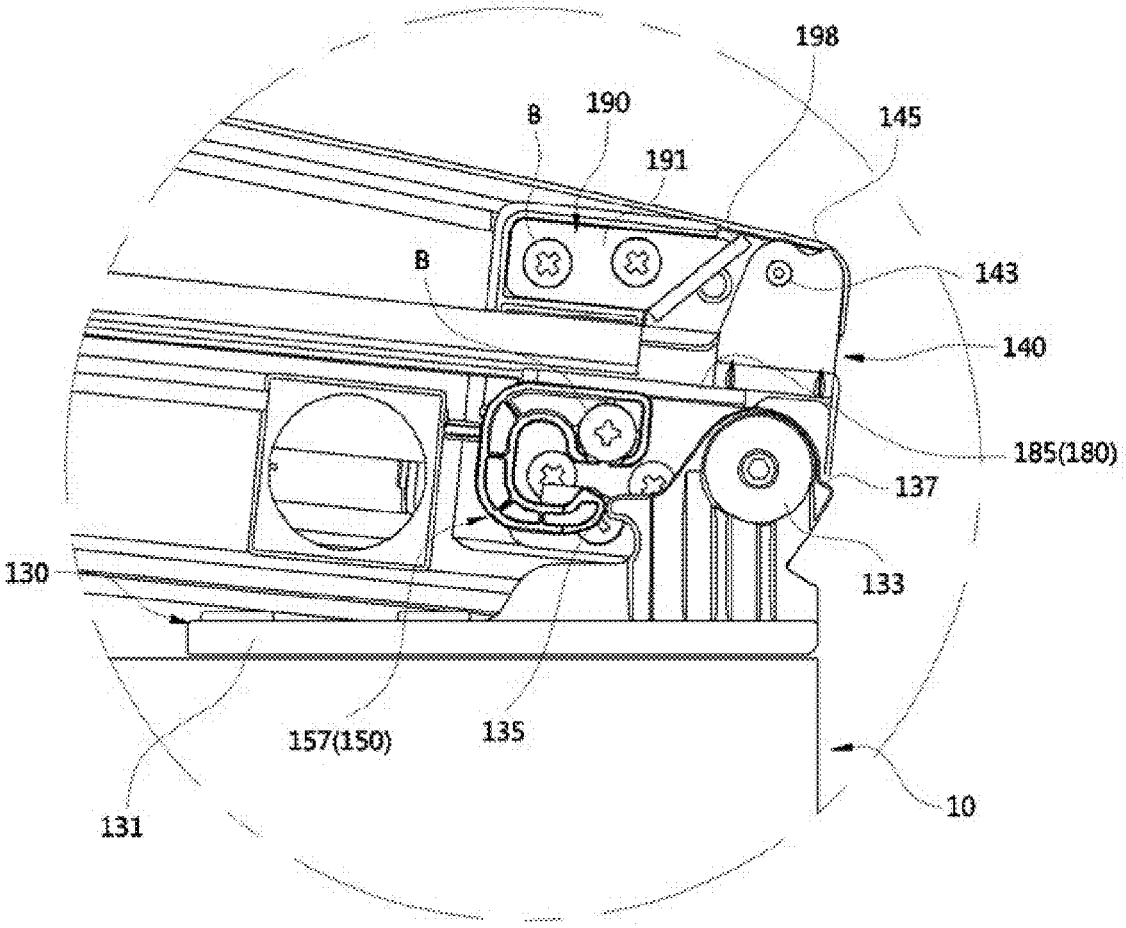

When, in a state in which the other side of the second elastic lever 157 is in contact with the elastic lever contact portion 135, as illustrated in FIG. 19, the second elastic lever 157 is pushed in the direction in which the first door 40 is closed, the other side of the second elastic lever 157 is compressed by the elastic lever contact portion 135, and the second elastic lever 157 accumulates an elastic force.

When, in a state in which the second elastic lever 157 accumulates the elastic force, the second elastic lever 157 is further pushed in the direction in which the first door 40 is closed, as illustrated in FIG. 19, the other side of the second elastic lever 157 moves along the surface of the elastic lever contact portion 135 and passes the elastic lever contact portion 135.

Figure 20:
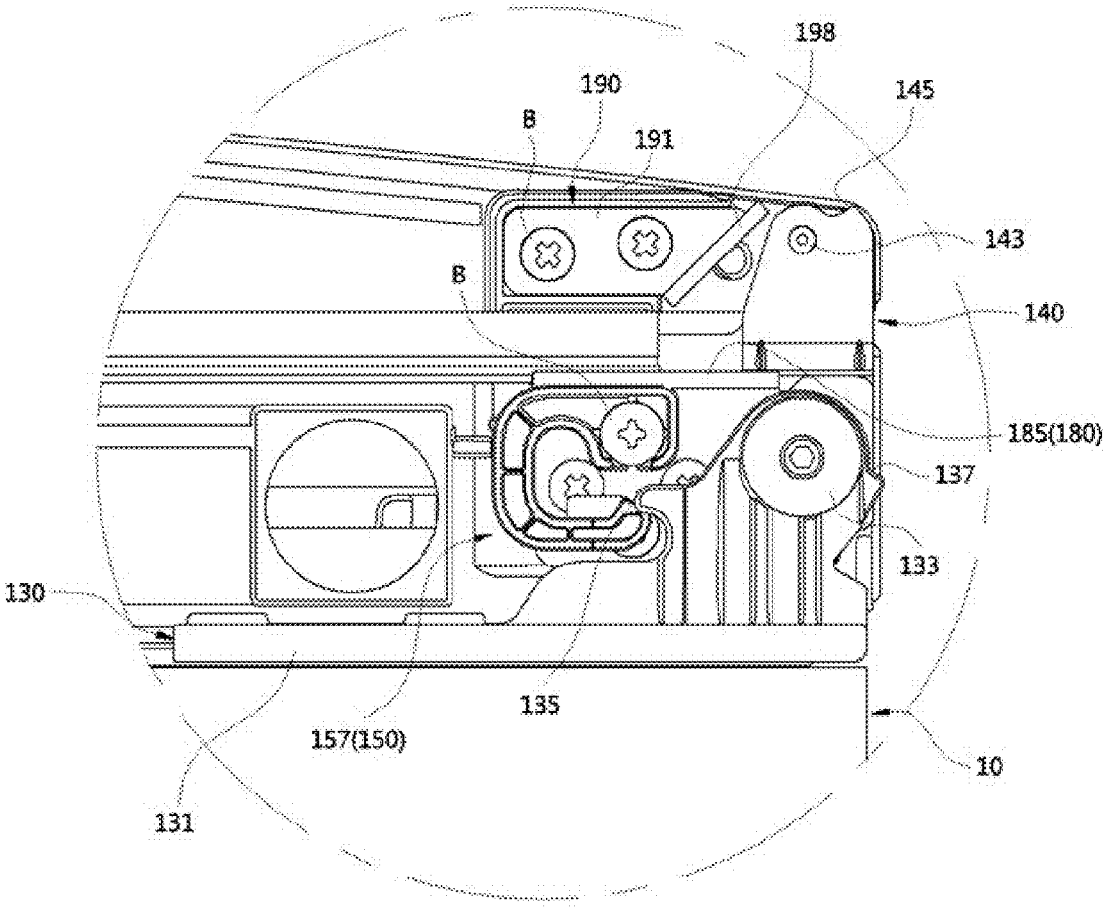

The other side of the second elastic lever 157 passes the elastic lever contact portion 135 and is supported by the elastic lever contact portion 135, and the second elastic lever 157 transfers the accumulated elastic force to the first door 40, and due to the transferred elastic force, the first door 40 is fully closed, as illustrated in FIG. 20.

When the first door 40 is closed, the first door 40 receives the elastic force in the direction in which the first door 40 is closed, due to the elastic force that remains in the second elastic lever 157 and is maintained to be fully in close contact with the main body 10.

Although not shown, when the first door 40 is opened, the other side of the second elastic lever 157 is in contact with the elastic lever contact portion 135 in an opposite direction to the direction in which the first door 40 is closed, moves along the surface of the elastic lever contact portion 135, and passes the elastic lever contact portion 135. Since the first door 40 is maintained in the closed state before the other side of the second elastic lever 157 passes the elastic lever contact portion 135, the first door 40 may be maintained in the closed state even when the other-side refrigerator compartment door 30 is rapidly closed.

As illustrated in FIGS. 1 through 3, the second door 50 includes the handle 70 to which the latch unit 200 that selectively opens/closes the first door 40 and the second door 50, is coupled.

The handle 70 is coupled to a front side of the second door 50. The latch unit 200 is coupled to a rear side of the handle 70 so that the second door 50 is fixed to the first door 40 and fixing of the second door 50 is released.

Figure 21:
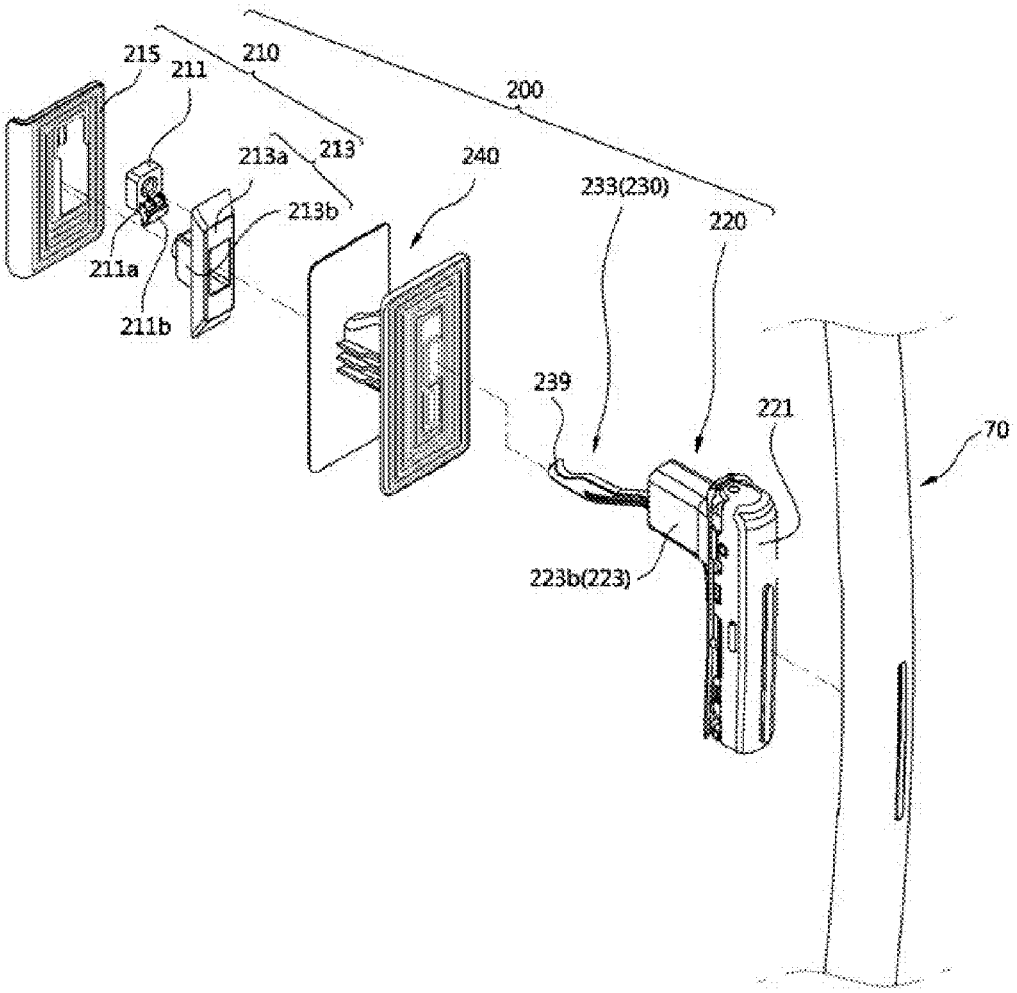
FIG. 21 is an exploded perspective view of a latch unit coupled to a handle in accordance with the embodiment of the present disclosure.
Figure 22:
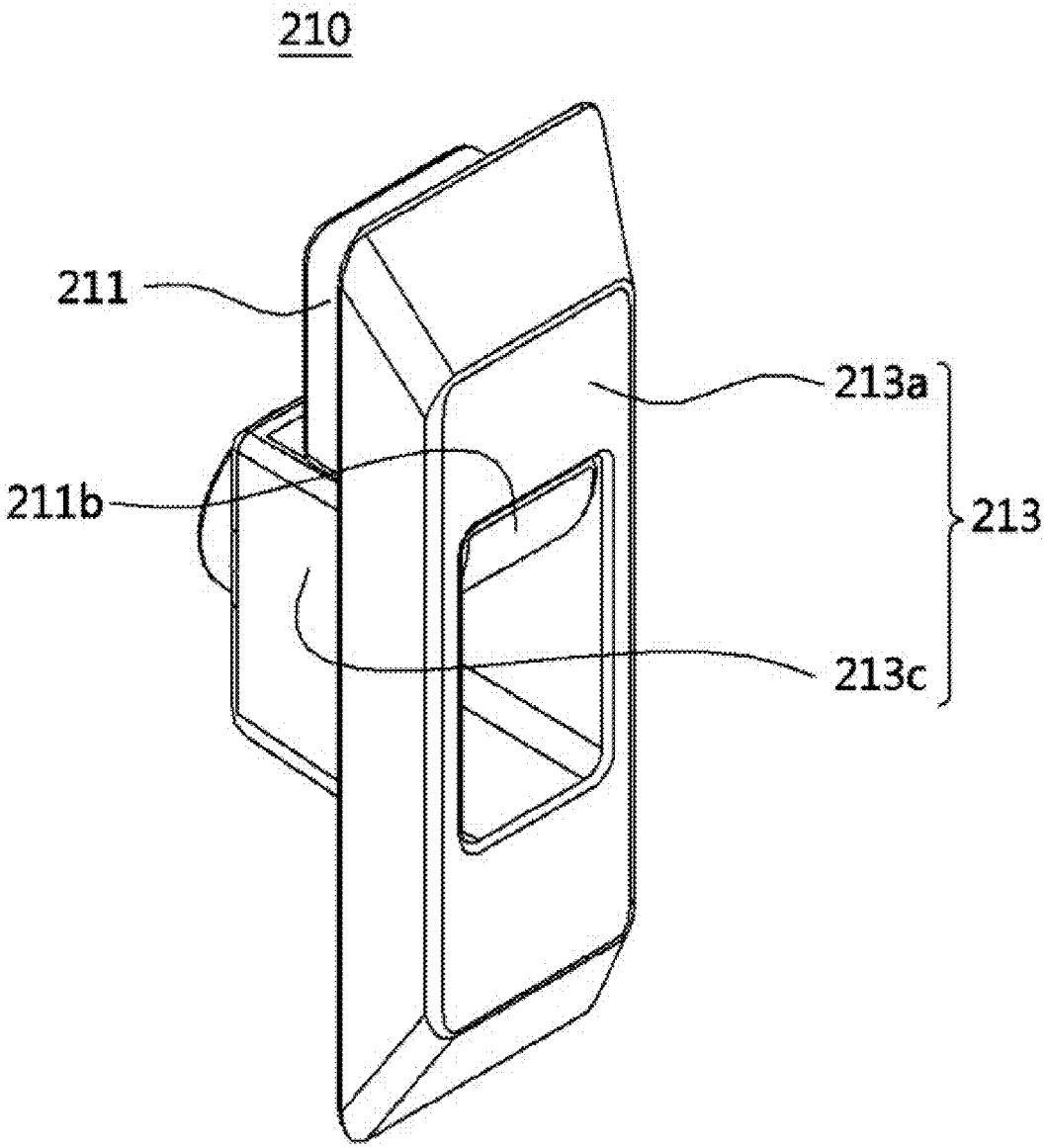
FIG. 22 is a view of a fixing unit in accordance with an embodiment of the present disclosure.
Figure 23:
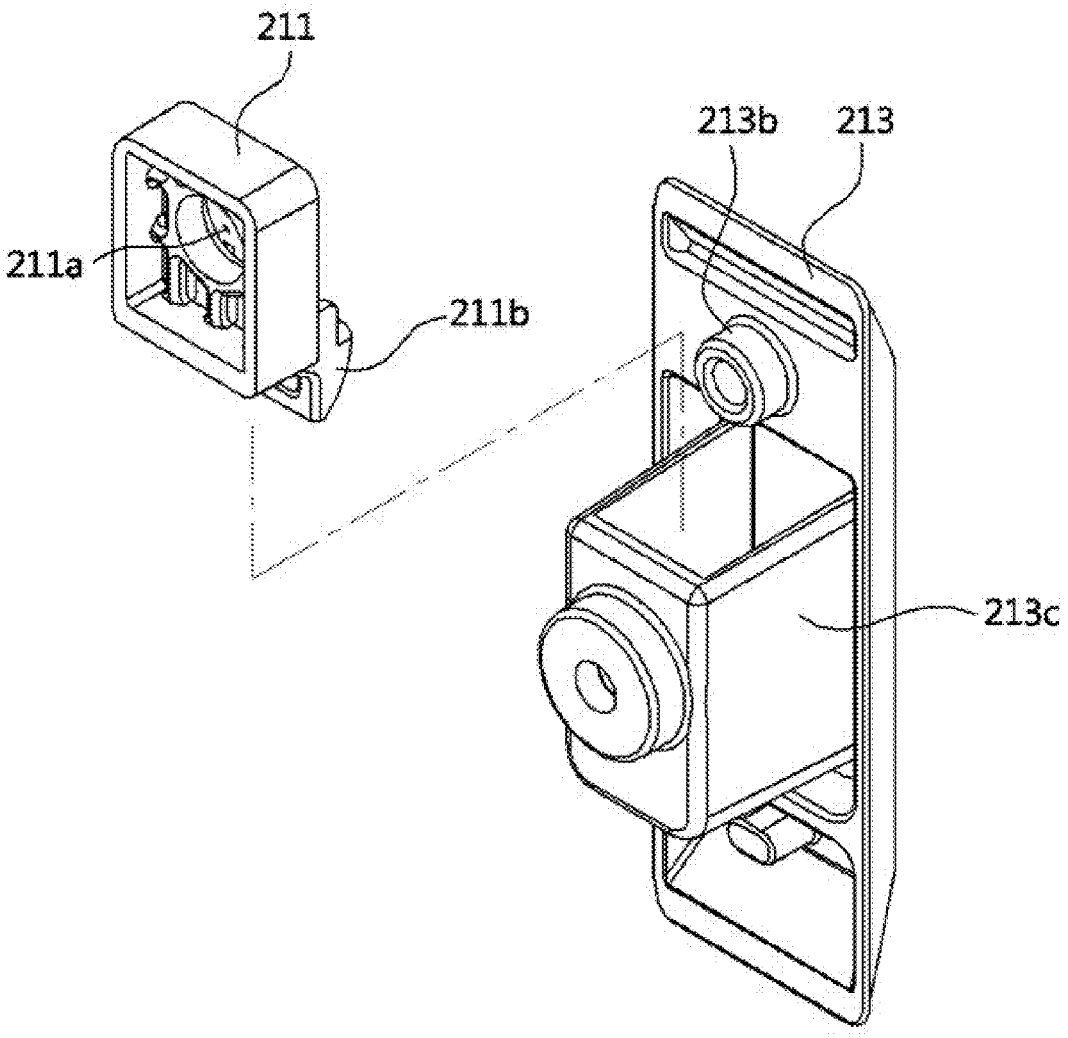
FIG. 23 is a view of a hanging portion of FIG. 22 is disassembled.
Figure 24:
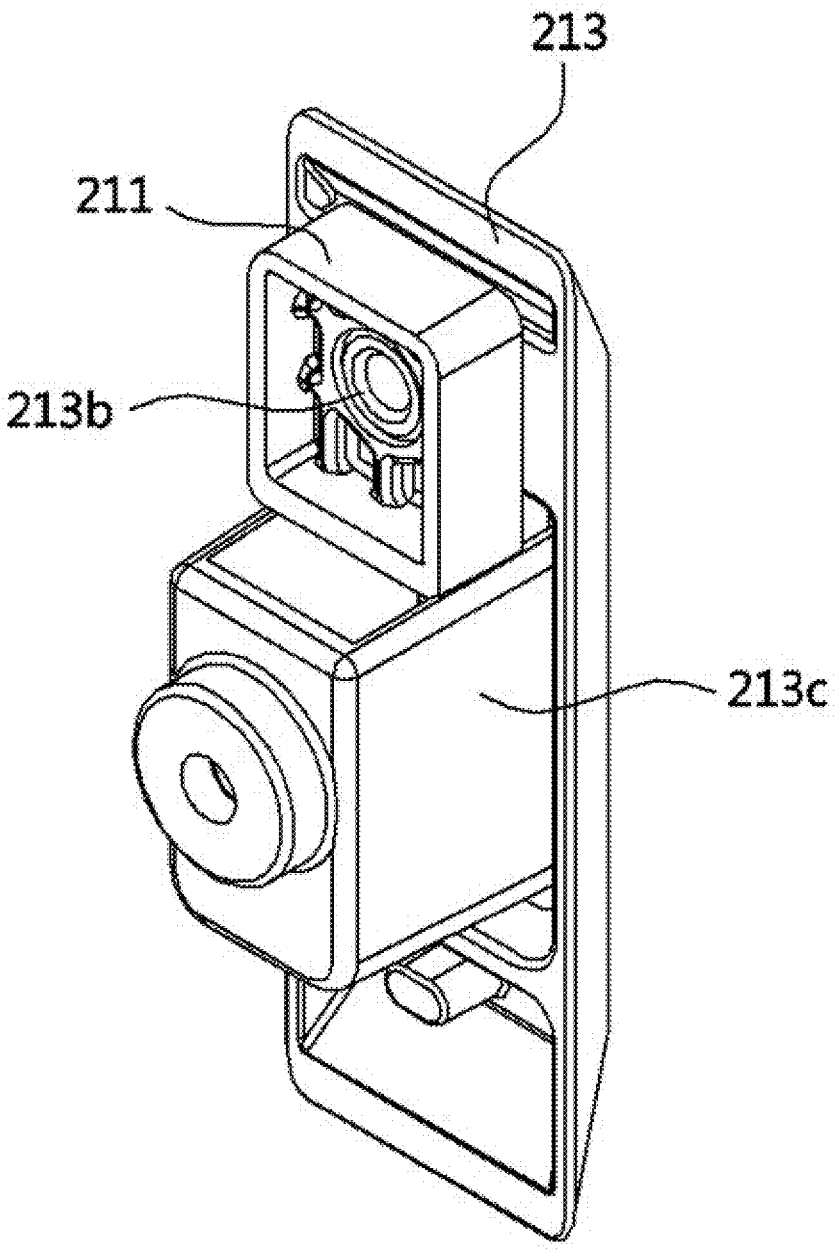
FIG. 24 is a rear view of the fixing unit illustrated in FIG. 22.
Figure 25:
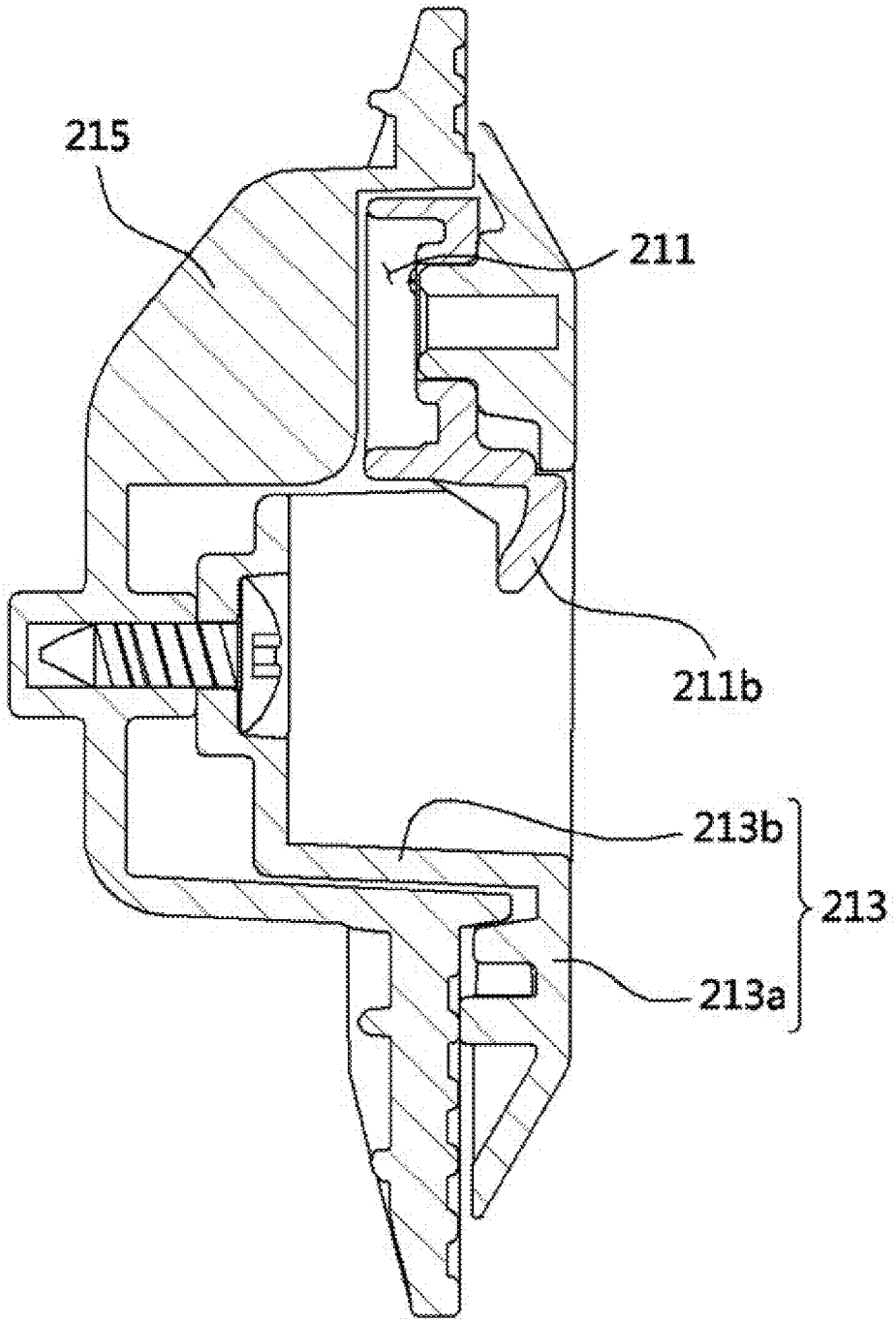
FIG. 25 is a cross-sectional view of the fixing unit in accordance with the embodiment of the present disclosure.

As illustrated in FIG. 21, the latch unit 200 includes a fixing unit 210 buried in the front side of the first door 40, a support 220 that is accommodated in and coupled to the rear side of the handle 70, a handle lever 230 including a first handle lever 231 coupled to the support 220 and a second handle lever 233 that is connected to the first handle lever 231 (see FIG. 26) and is hung in the fixing unit 210 or hanging of the second handle lever 233 is released, and a guide 240 which is buried in the second door 50 and through which the handle lever 230 penetrates into the second door 50 from the support 220 and is hung in the fixing unit 210 and hanging of the guide 240 is released.

As illustrated in FIGS. 22 through 25, the fixing unit 210 includes a hanging portion 211 in which the second handle lever 233 is hung and hanging of which is released, a flow prevention portion 213 that prevents the hanging portion 211 from flowing inside the first door 40, and a cover 215 that is coupled to a rear side of the flow prevention portion 213 and prevents an insulating material U (see FIG. 31) filled in the first door 40 from penetrating into a space formed between the insulating material U and the flow prevention portion 213.

The hanging portion 211 includes a fixing hole 211*a* fixed to the flow prevention portion 213, and a hanging hook 211*b* which is disposed at a lower portion of the fixing hole 211*a* and in which the second handle lever 233 is hung and hanging of which is released.

The flow prevention portion 213 includes a front side portion 213*a* exposed to an outside of a front side of the first door 40, a fixing protrusion 213*b* which protrudes from a rear side of the front side portion 213*a* and into which the fixing hole 211*a* is inserted, and an accommodation portion 213*c* that protrudes from the rear side of the front side portion 213*a* so that an accommodation space may be formed in the rear side of the front side portion 213*a*.

When the fixing protrusion 213*b* is disposed at an upper portion of the accommodation portion 213*c* and the accommodation portion 213*c* in which the accommodation space is formed, is disposed so that front and top sides of the accommodation portion 213*c* may be opened and thus the fixing hole 211*a* of the hanging portion 211 is inserted into the fixing protrusion 213*b* and the hanging portion 211 is fixed to the flow prevention portion 213, the hanging hook 211*b* is accommodated in the accommodation portion 213*c* through the opened top side of the accommodation portion

213*c*, and the hanging hook 211*b* accommodated in the accommodation portion 213*c* is exposed to the outside through the opened front side of the accommodation portion 213*c* so that the second handle lever 233 may be hung in the hanging hook 211*b* and hanging of the second handle lever 233 may be released.

When seen from the opened front side of the accommodation portion 213*c*, the hanging hook 211*b* is placed in the upper portion of the accommodation portion 213*c*, and a front end of the second handle lever 233 is accommodated in the accommodation portion 213*c* through the opened front side of the accommodation portion 213*c* and moves in a vertical direction and thus, a hanging protrusion 239 disposed on the front end of the second handle lever 233 is hung in the hanging hook 211*b* and hanging of the hanging protrusion 239 is released.

The cover 215 is coupled to the rear side of the flow prevention portion 213 and prevents the insulating material U filled in the first door 40 from penetrating into the space formed between the insulating material U and the flow prevention portion 213. The cover 215 supports the rear side of the hanging portion 211 so that the hanging portion 211 fixed when the fixing protrusion 213*b* of the flow prevention portion 213 fixing hole is inserted into the fixing hole 211*a* fixing protrusion may be prevented from escaping from the fixing protrusion 213*b*.

Figure 26:
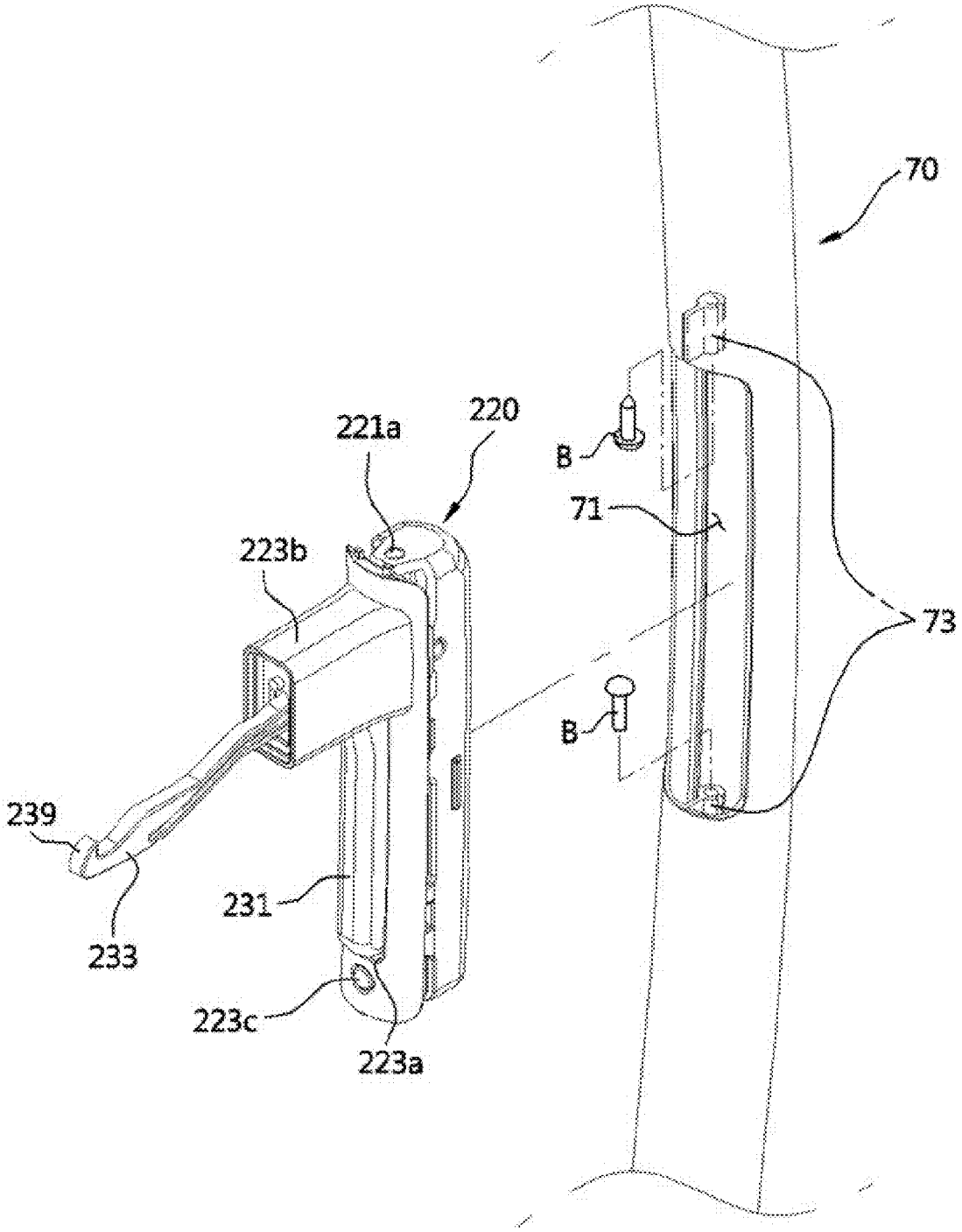
FIG. 26 is a view of a state in which a support is coupled to the handle, in accordance with an embodiment of the present disclosure.
Figure 27:
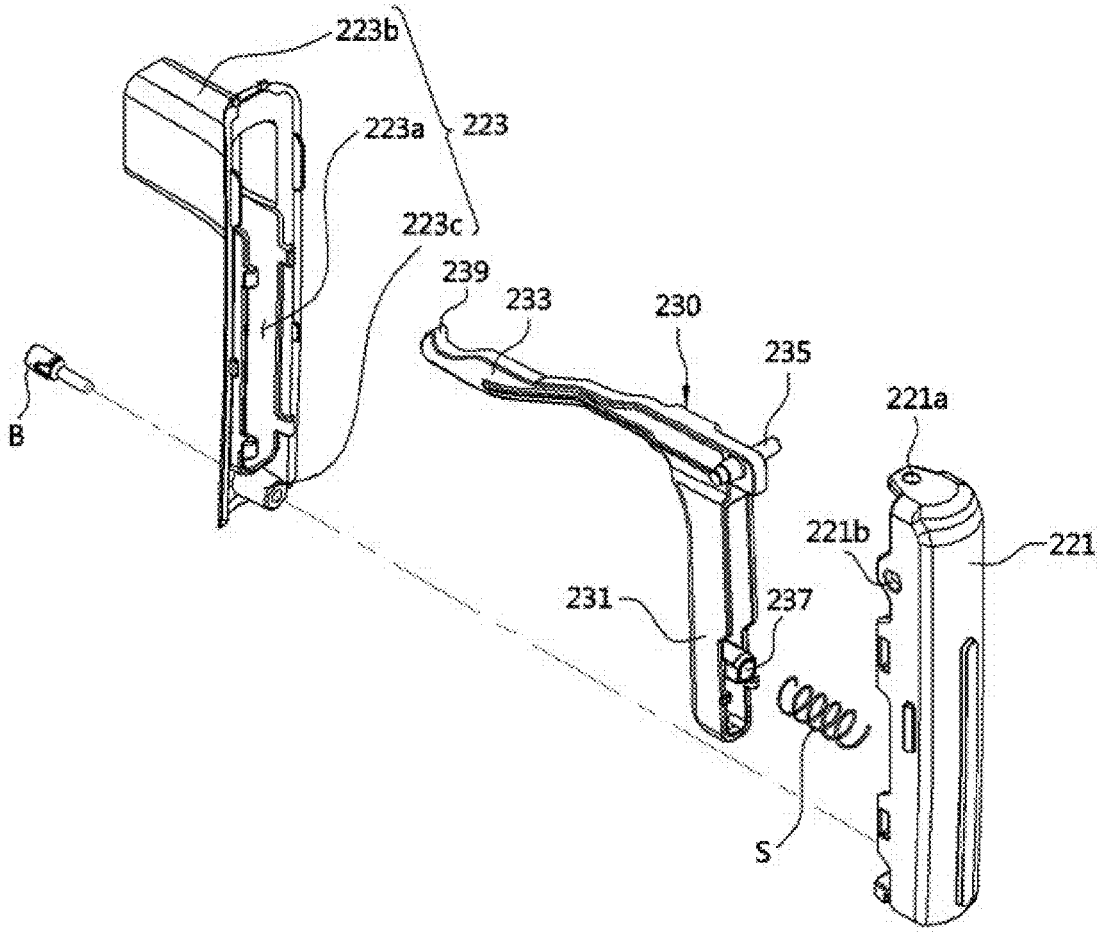
FIG. 27 is an exploded perspective view of the support and a handle lever in accordance with an embodiment of the present disclosure.
Figure 28:
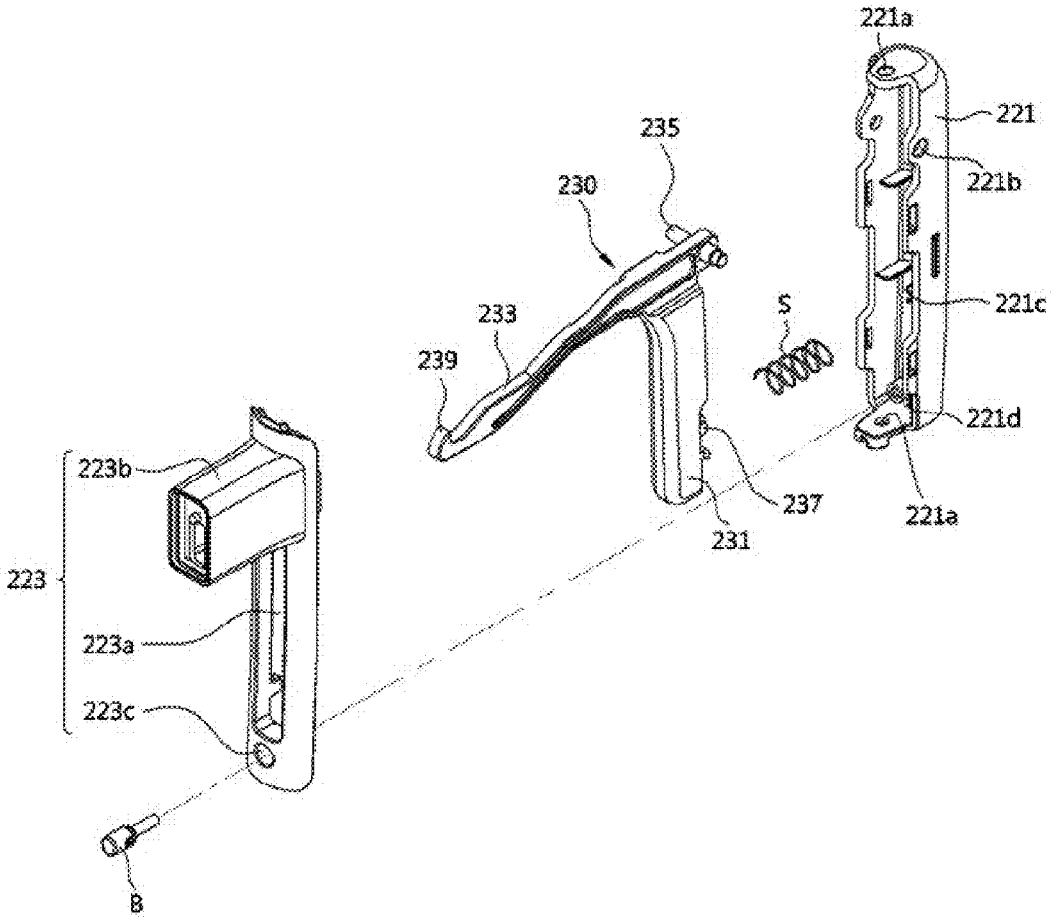
FIG. 28 is a view of FIG. 27 at a different angle.

As illustrated in FIGS. 26 through 28, the support 220 is accommodated in and coupled to the rear side of the handle 70, and a support accommodation portion 71 in which the support 220 is accommodated, is disposed in the rear side of the handle 70.

The support 220 includes a housing 221 which is accommodated in and coupled to the support accommodation portion 71 and a rear side of which is opened, and a rear cover 223 coupled to the opened rear side of the housing 221.

A first coupling hole 73 into which the housing 221 is coupled, is disposed in the support accommodation portion 71, and a second coupling hole 221*a* is disposed in a position of the housing 221 corresponding to the first coupling hole 73 so that the housing 221 may be coupled to the support accommodation portion 71 by the fastening member B.

A rotation hole 221*b* into which a rotation shaft 235 of the handle lever 230 that will be described later is rotatably coupled, a first support portion 221*c* that supports one side of a spring S elastically supporting the first handle lever 231, and a third coupling hole 221*d* into which the rear cover 223 is coupled, are disposed in the housing 221.

The rear cover 223 includes an opening 223*a* opened so that the rear side of the first handle lever 231 that will be described later may be exposed to the outside, a guide portion 223*b* that guides the second handle lever 233 not to be exposed to the outside, and a fourth coupling hole 223*c* disposed in a position corresponding to the third coupling hole 221*d* disposed in the housing 221.

The rear side of the first handle lever 231 is exposed to the outside through the opening 223*a* of the rear cover 223 and thus, a user may pressurize the rear side of the first handle lever 231 exposed to the outside forward by grasping the handle 70.

The guide portion 223*b* causes the second handle lever 233 coupled to the housing 221 not to be exposed to the outside in the space between the handle 70 and the second door 50 to pass through the second door 50 so that the second handle lever 233 may be hung in the fixing unit 210 disposed in the first door 40 and hanging of the second handle lever 233 may be released.

The guide portion 223*b* is disposed to have a sufficient space in the vertical direction so that the second handle lever 233 may be moved in the vertical direction. The guide portion 223*b* communicates with the guide 240 buried in the second door 50.

The rear cover 223 is coupled to the housing 221 by using the fastening member B through the third coupling hole 221*d* disposed in the housing 221 and the fourth coupling hole 223*c* disposed in the rear cover 223.

The handle lever 230 is rotatably coupled to the support 220 and is hung in the fixing unit 210, and hanging of the handle lever 230 is released.

The rotation shaft 235 is disposed in the handle lever 230. The rotation shaft 235 is rotatably coupled to the rotation hole 221*b* disposed in the housing 221 of the support 220 so that the handle lever 230 may be rotated.

The handle lever 230 includes the first handle lever 231 disposed to be rotated about the rotation shaft 235 in the forward/backward direction, and a second handle lever 233 that is linked to the first handle lever 231, is rotated about the rotation shaft 235 in the vertical direction when the first handle lever 231 is rotated in the forward/backward direction, and is hung in the hanging portion 211 of the fixing unit 210 and hanging of the second handle lever 233 is released.

When seen from the rotation shaft 235, the first handle lever 231 is disposed to extend from the rotation shaft 235 downward so that the front side of the first handle lever 231 is accommodated in the housing 221 of the support 220.

The rear side of the first handle lever 231 is exposed to the outside through the opening 223*a* of the rear cover 223 coupled to the rear side of the housing 221 so that the user may pressurize the first handle lever 231 forward by grasping the handle 70.

A second support portion 237 that supports the spring S is disposed in a lower portion of the first handle lever 231, and both sides of the spring S are supported by the first support portion 221*c* disposed in the housing 221 and the second support portion 237 of the first handle lever 231.

Since the spring S is disposed in the lower portion of the first handle lever 231, when the user pressurizes the first handle lever 231, the first handle lever 231 is rotated about the rotation shaft 235 rearward and compresses the spring S and accumulates an elastic force.

When the user takes their hand off from the first handle lever 231 in a state in which the first handle lever 231 is pressurized, the first handle lever 231 is rotated about the rotation shaft 235 rearward by the accumulated elastic force of the spring S and is returned to its original position.

When seen from the rotation shaft 235, the second handle lever 233 is disposed to extend from the rotation shaft 235 rearward.

The second handle lever 233 is guided by the guide portion 223*b* of the rear cover 223 and the guide 240 buried in the second door 50 and extends so that the second handle lever 233 may be hung in the fixing unit 210 buried in the front side of the first door 40 and hanging of the second handle lever 233 may be released.

The second handle lever 233 is connected to the first handle lever 231. When the user pressurizes the first handle lever 231 to be rotated about the rotation shaft 235 forward, the second handle lever 233 is rotated about the rotation shaft 235 downward.

The hanging protrusion 239 is disposed on an end of the second handle lever 233. The hanging protrusion 239 causes the second handle lever 233 to be hanging-released from the hanging hook 211*b* of the fixing unit 210 when the second handle lever 233 is rotated about the rotation shaft 235 downward.

Figure 29:
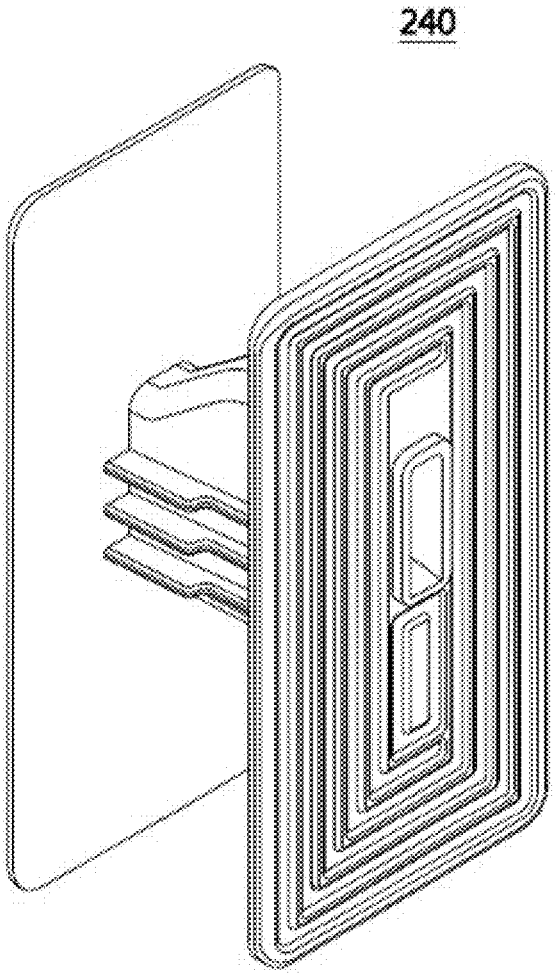
FIG. 29 is a view of a guide in accordance with an embodiment of the present disclosure.
Figure 31:
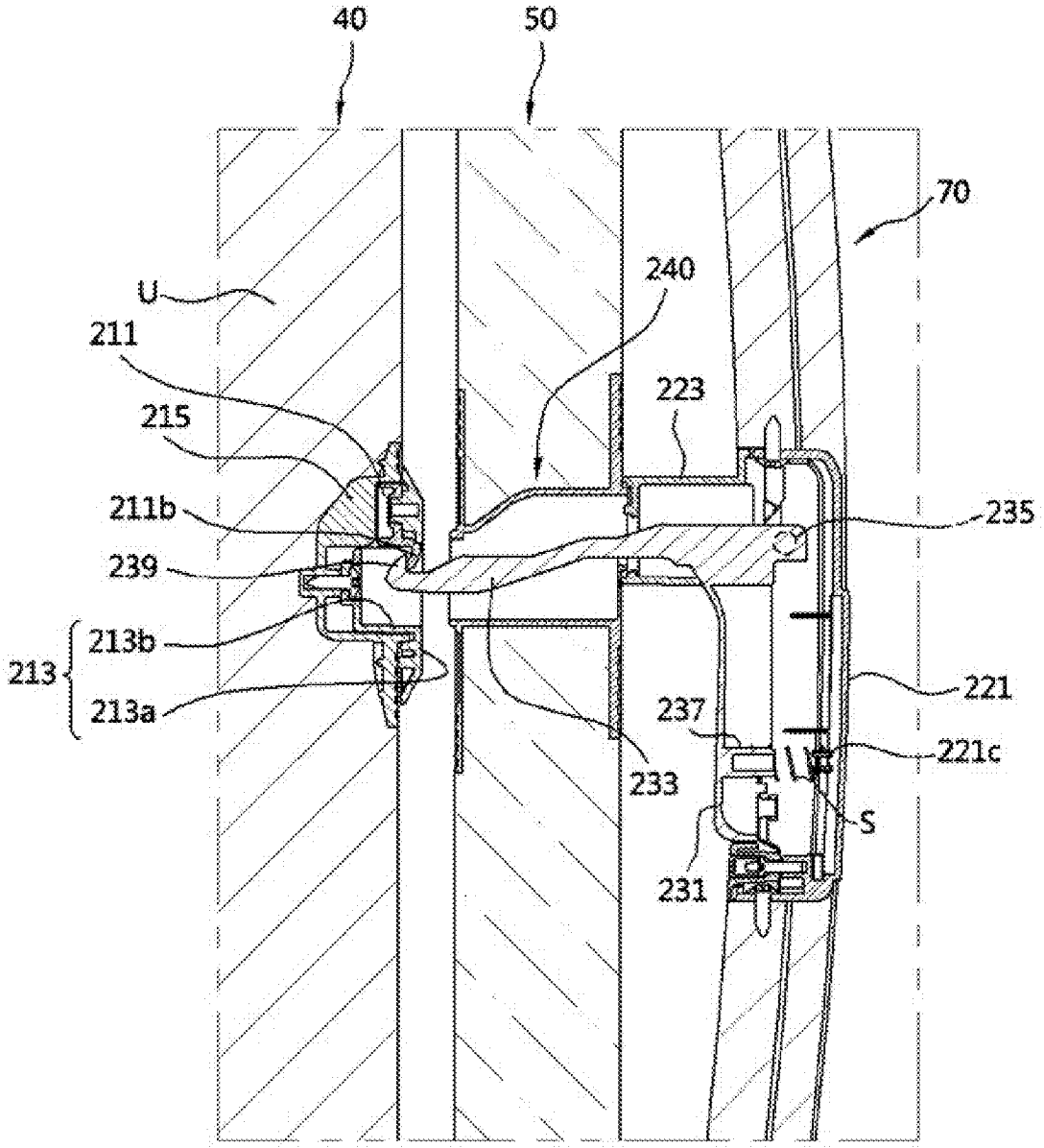
FIG. 31 is a cross-sectional view of a state in which the second door is fixed to the first door by using the latch unit in accordance with the embodiment of the present disclosure.

As illustrated in FIGS. 29 and 31, the guide 240 is buried in the second door 50, communicates with the guide portion 223*b* disposed in the rear cover 223 of the support 220, and guides the second handle lever 233 to pass through the second door 50.

Figure 30:
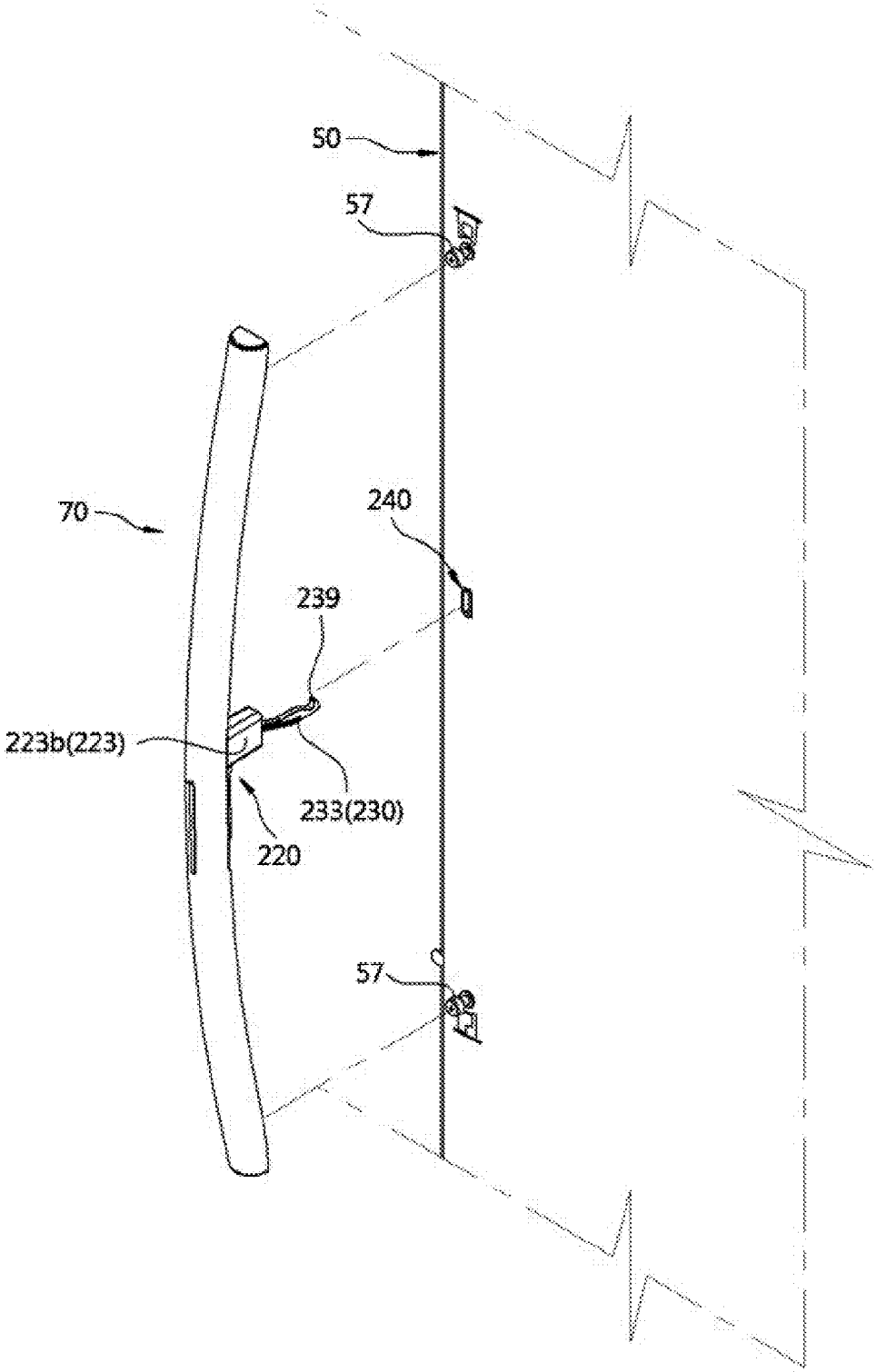
FIG. 30 schematically illustrates a state in which the second door is coupled to the handle in accordance with the embodiment of the present disclosure.

As described above, the latch unit 200 includes the housing 221 coupled to the handle 70, the handle lever 230 coupled to the housing 221, the fixing unit 210 buried in the first door 40, and the guide 240 buried in the second door 50. As illustrated in FIG. 30, both ends of the handle 70 are configured to be inserted into and coupled to the coupling member 57 disposed at the front side of the second door 50 by using a sliding method. Thus, even when the refrigerator is put on the market in a state in which the handle 70 is separated from the second door 50 without the need of coupling the handle 70 to the second door 50, the user may easily couple the handle 70 to the second door 50 and use the refrigerator.

Since the housing 221 and the handle lever 230 of the latch unit 200 are coupled to the handle 70 and the fixing unit 210 and the guide 240 are buried in the first door 40 and the second door 50, respectively, by coupling the handle 70 to the second door 50, the latch unit 200 may be used without performing a separate assembly operation so that the refrigerator may be put on the market in the state in which the handle 70 is separated from the second door 50 and then the user may couple the handle 70 to the second door 50 and use the refrigerator.

Since the refrigerator may be put on the market in the state in which the handle 70 is separated from the second door 50, the refrigerator may be easily transported, and damage of the handle 70 when the refrigerator is transported may be prevented.

Next, an operation of the latch unit 200 will be described with reference to FIGS. 31 through 34.

As illustrated in FIG. 31, when both the first door 40 and the second door 50 are closed, the hanging protrusion 239 of the second handle lever 233 is hung in the hanging hook 211*b* of the fixing unit 210. Thus, the second door 50 is fixed to the first door 40, and the user opens the second door 50 by grasping the handle 70 so that the first door 40 and the second door 50 may be opened together.

Figure 32:
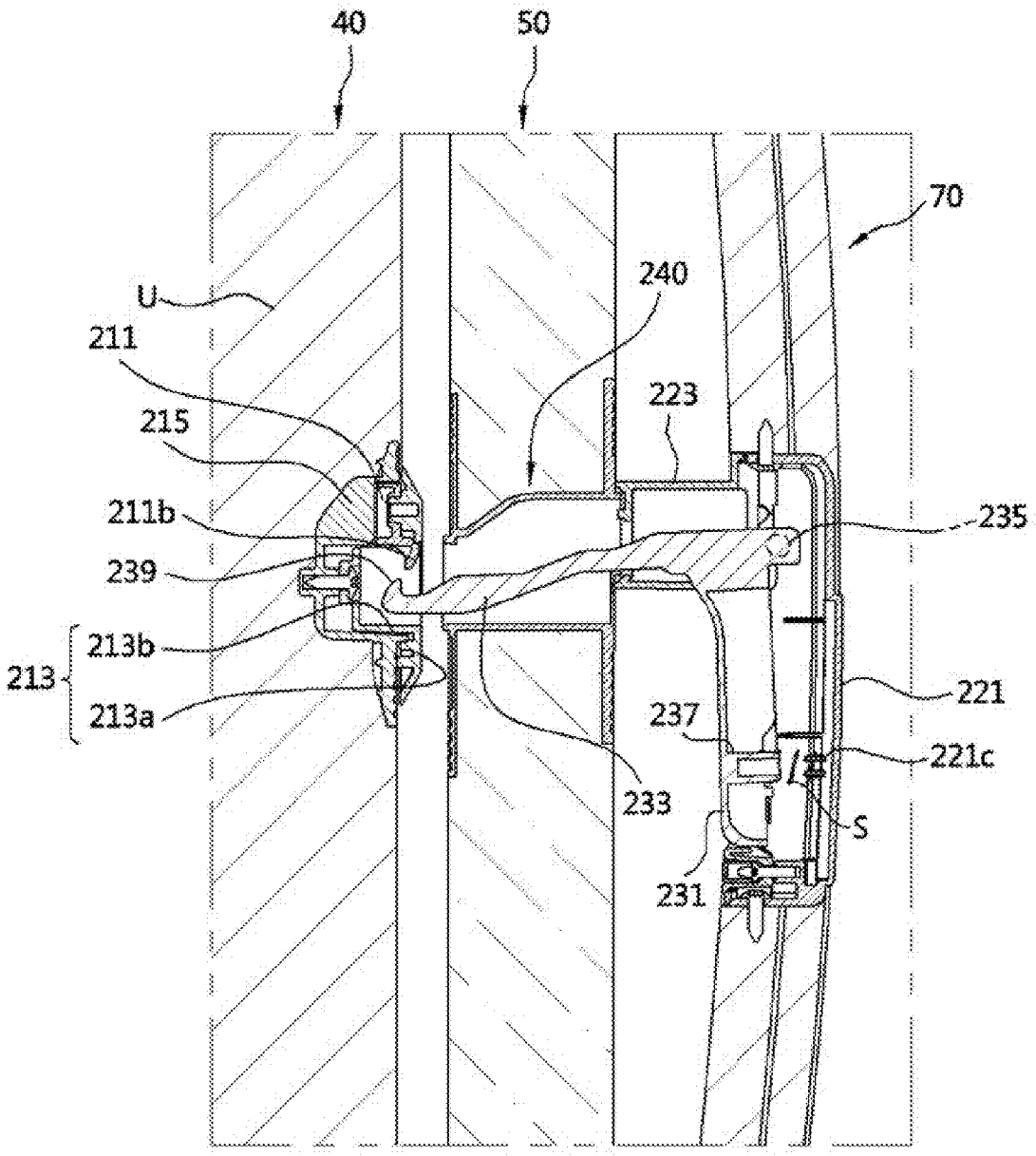
FIG. 32 is a cross-sectional view of a state in which fixing of the second door is released from the first door by using the latch unit in accordance with the embodiment of the present disclosure.

As illustrated in FIG. 32, when the user pressurizes the first handle lever 231 forward, the first handle lever 231 is rotated about the rotation shaft 235 forward, and the second handle lever 233 is rotated about the rotation shaft 235 downward.

Figure 33:
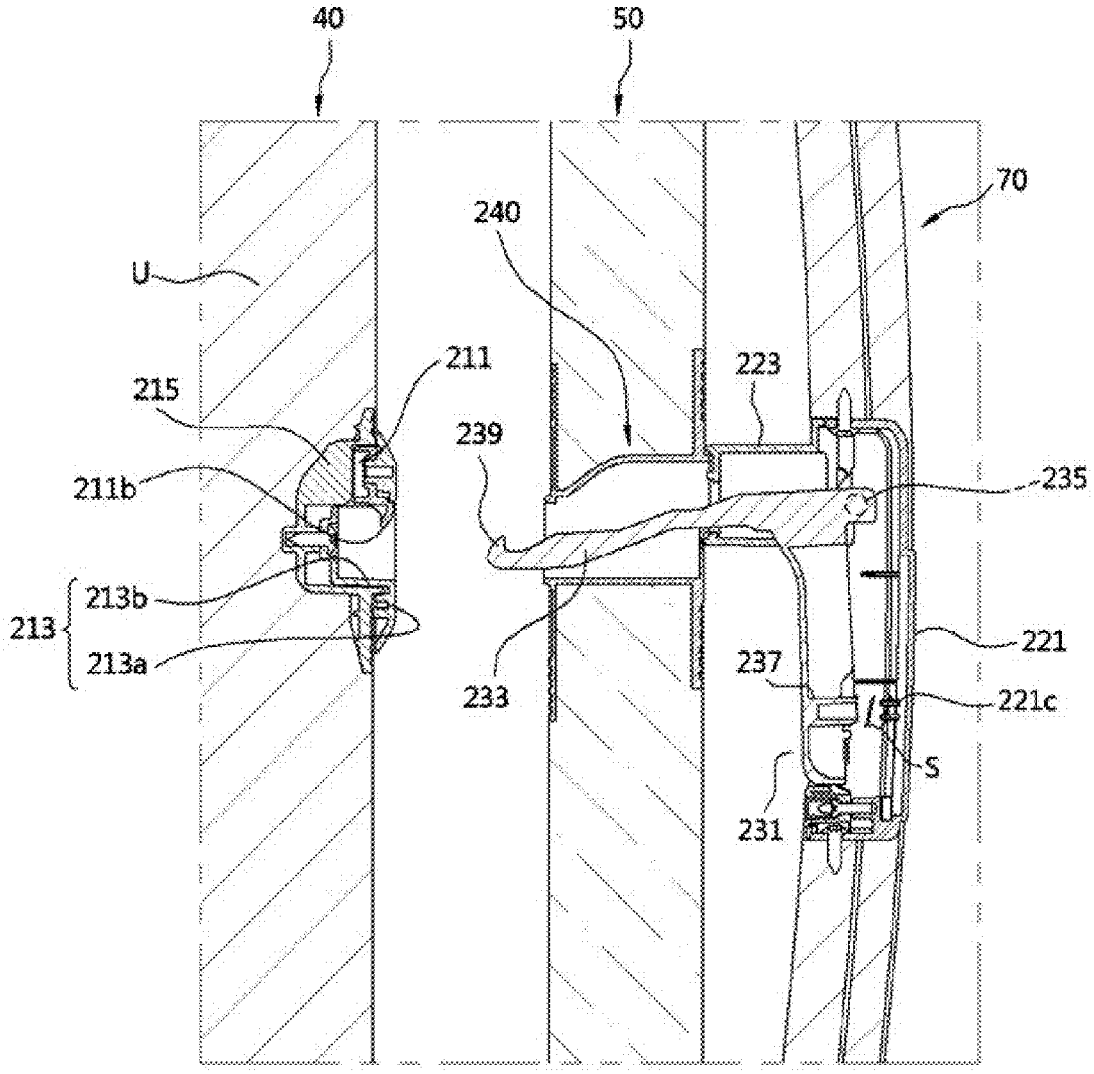
FIG. 33 is a cross-sectional view of a state in which the second door is opened in the state of FIG. 32.

When the second handle lever 233 is rotated about the rotation shaft 235 downward, hanging of the hanging protrusion 239 disposed on the end of the second handle lever 233 is released from the hanging hook 211*b*. Thus, when fixing of the second door 50 to the first door 40 is released and the user opens the second door 50 by grasping the handle 70, as illustrated in FIG. 33, only the second door 50 is opened.

Figure 34:
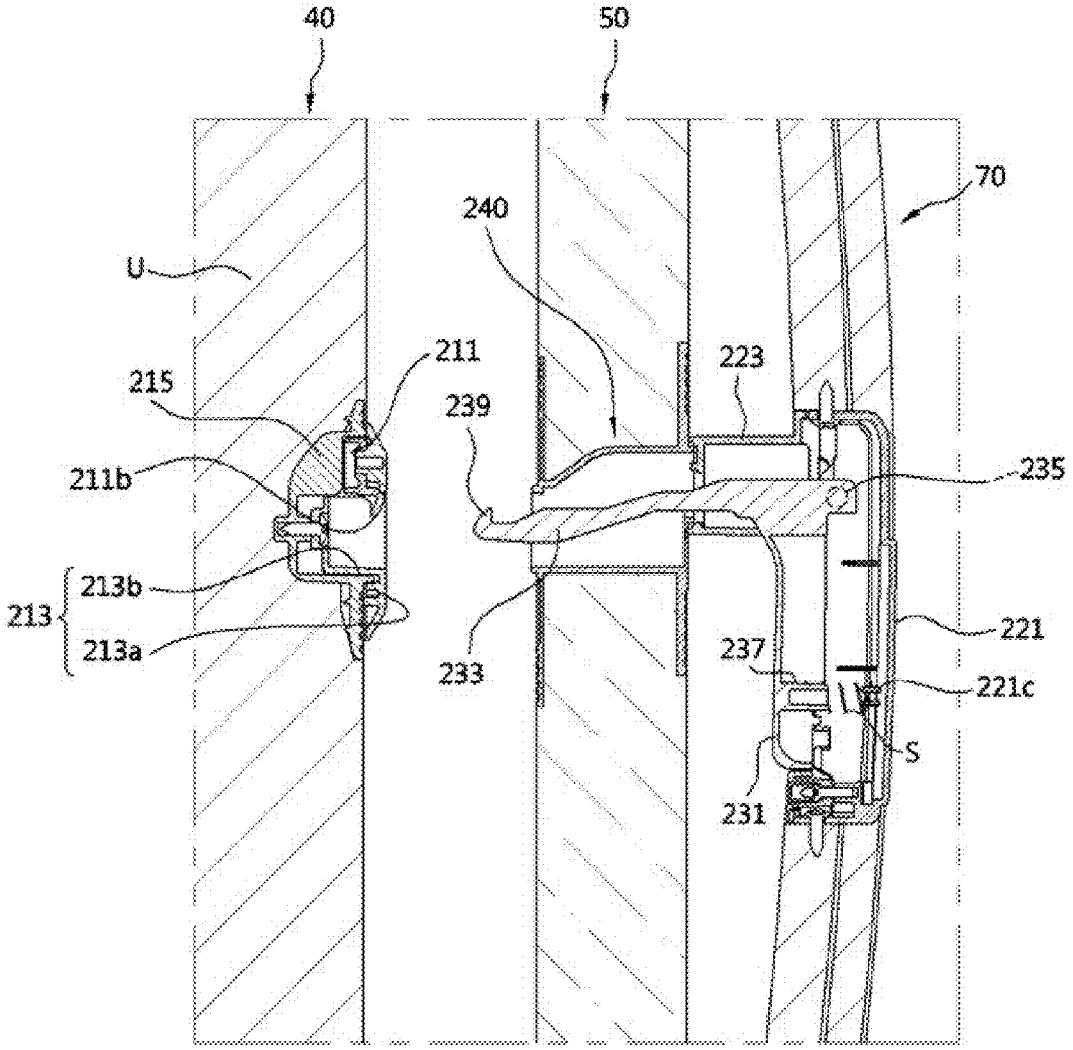
FIG. 34 is a cross-sectional view of a state in which a force applied to a first handle lever is removed from the state of FIG. 33.

When the user takes their hand off from the handle 70 in a state in which only the second door 50 is opened, as illustrated in FIG. 34, the first handle lever 231 is rotated about the rotation shaft 235 rearward by the elastic force of the spring S, and the second handle lever 233 is rotated about the rotation shaft 235 upward and is returned to its original state.

Although not shown, when the user closes the second door 50 in the state in which only the second door 50 is opened, if the user pressurizes the first handle lever 231 by grasping the handle 70, the first handle lever 231 is rotated about the rotation shaft 235 forward, and the second handle lever 233 is rotated about the rotation shaft 235 downward. Thus, when the second door 50 is closed in the above state, the hanging protrusion 239 of the second handle lever 233 is accommodated in the accommodation portion 213*c* of the fixing unit 210.

When the user takes their hand off from the second handle lever 233 in a state in which the hanging protrusion 239 of the second handle lever 233 is accommodated in the accommodation portion 213*c*, due to the elastic force of the spring S, the first handle lever 231 is rotated about the rotation shaft 235 rearward, and the second handle lever 233 is rotated about the rotation shaft 235 upward, and the hanging protrusion 239 is hung in the hanging hook 211*b*.

When the second door 50 is closed in the state in which only the second door 50 is opened, if the user closes the second door 50 by grasping the handle 70 without pressurizing the first handle lever 231, the hanging protrusion 239 of the second handle lever 233 is in contact with the hanging hook 211*b*.

When the second door 50 is further pushed to be closed in a state in which the hanging protrusion 239 is in contact with the hanging hook 211*b*, the second handle lever 233 is rotated about the rotation shaft 235 downward, and the second door 50 is closed in a state in which the first handle lever 231 is rotated about the rotation shaft 235 forward.

When the second door 50 is closed, the first handle lever 231 is rotated about the rotation shaft 235 rearward due to the elastic force of the spring S, the second handle lever 233 is rotated about the rotation shaft 235 upward, and the hanging protrusion 239 is hung in the hanging hook 211*b*.

Figure 35:
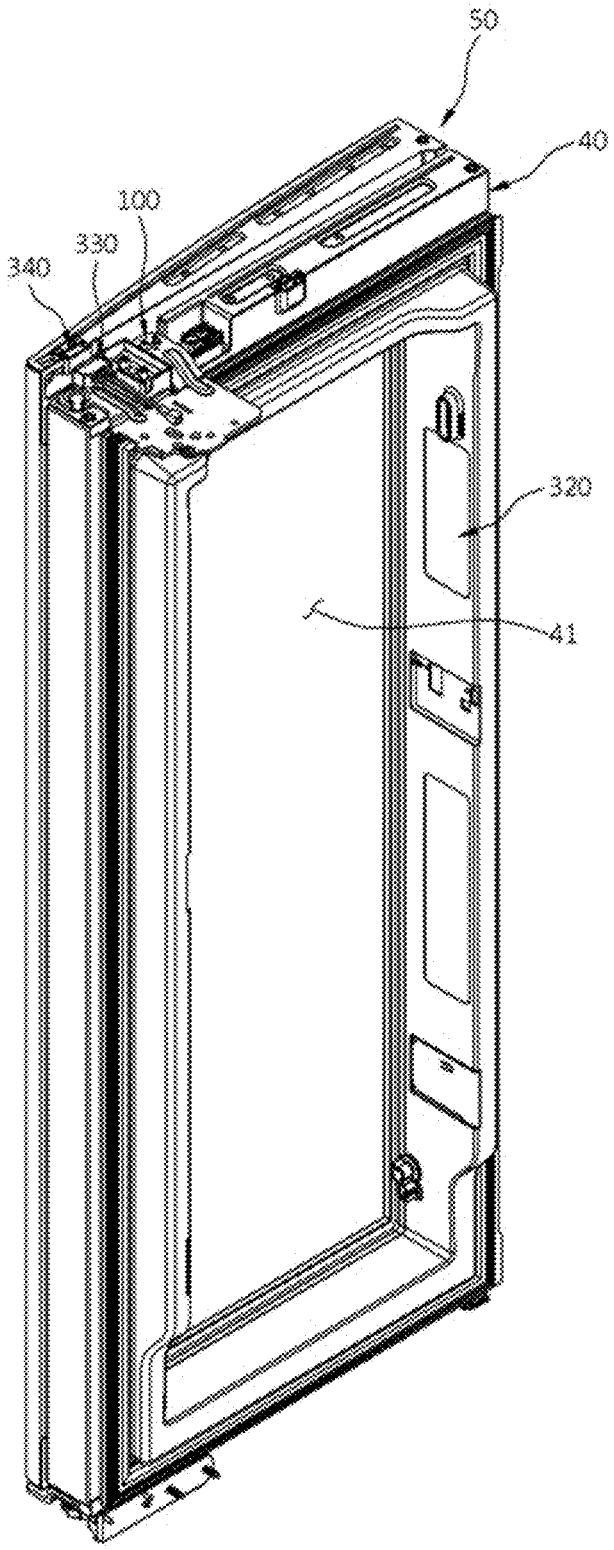
FIG. 35 is a view of a state in which a lamp is installed at sidewalls of an opening of the first door in accordance with the embodiment of the present disclosure.
Figure 36:
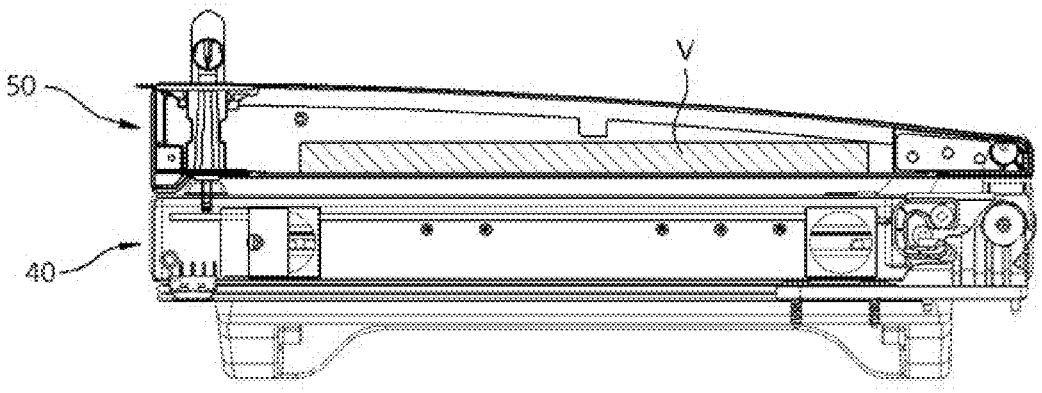
FIG. 36 is a view of a state in which a vacuum insulation panel (VIP) is filled in the second door in accordance with the embodiment of the present disclosure.
Figure 37:
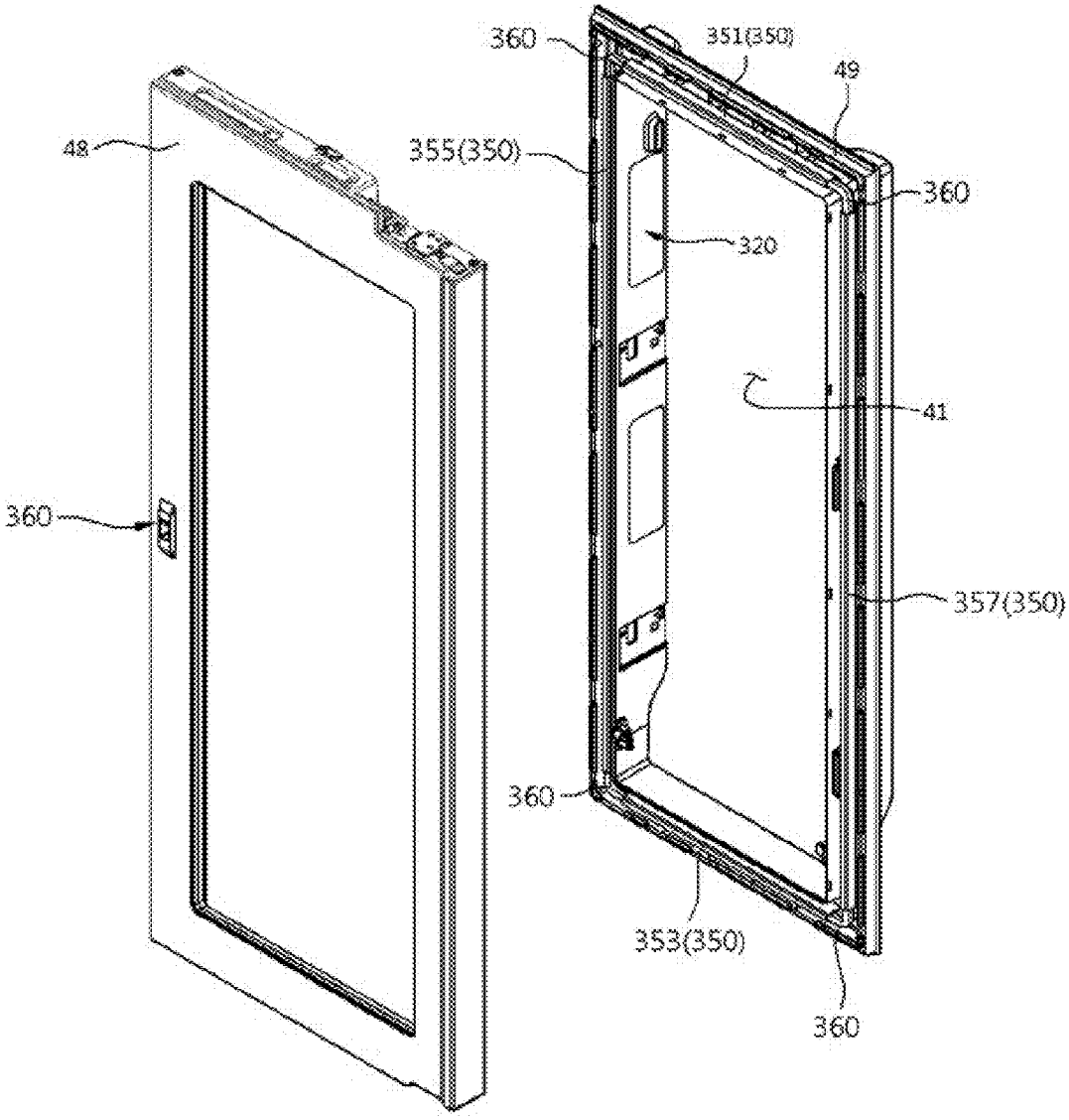
FIG. 37 is a view of a state in which a reinforcement frame is coupled to an internal injection-molded body of the first door in accordance with the embodiment of the present disclosure.

As illustrated in FIG. 2, when only the second door 50 is opened and the first door 40 is closed, at least one lamp 320 may be installed at sidewalls of the opening 41, as illustrated in FIG. 35, so that the user may easily identify food stored in the door guard 33 disposed in the opening 41 of the first door 40.

As illustrated in FIG. 2 and FIGS. 36 through 41, since the refrigerator compartment door 30 having the double door structure of the pair of refrigerator compartment doors 30 includes the first door 40 and the second door 50, both the first door 40 and the second door 50 have small thicknesses.

The insulating material U is filled in the second door 50. As a larger amount of insulating material U is filled in the second door 50, an insulating property of the second door 50 is improved. Thus, the thickness of the second door 50 needs to be increased so as to improve the insulating property of the second door 50 having a small thickness. However, for the reason of aesthetic appeal, the pair of refrigerator compartment doors 30 are required to be balanced. Thus, instead of increasing the thickness of the second door 50, a vacuum insulation panel (VIP) V may be filled in the second door 50 so as to supplement the insulating property of the insulating material U.

The first door 40 includes a cabinet 48 that constitutes an exterior, and an internal injection-molded body 49 that constitutes the sidewalls of the opening 41. The insulating material U is foamed between the cabinet 48 and the internal injection-molded body 49.

Since the first door 40 has a small thickness and is disposed in a rectangular shape having the opening 41, insulating performance of the first door 40 may be reduced, and rigidity of the first door 40 is lowered so that the first door 40 may be deformed by the weight of the first door 40 and a load of a material stored in the door guard 33 disposed in the opening 41.

In order to supplement lowered rigidity of the first door 40, a reinforcement frame 350 may be disposed between the cabinet 48 and the internal injection-molded body 49.

The reinforcement frame 350 includes an upper reinforcement frame 351 that is disposed at a front side of the internal injection-molded body 49, supplements rigidity of the first door 40, and is coupled to an upper portion of the internal injection-molded body 49, a lower reinforcement frame 353 coupled to a lower portion of the internal injection-molded body 49, a first side reinforcement frame 355 disposed at the left side of the first door 40 that is a portion to which the handle 70 is coupled, of both sides of the reinforcement frame 350, and a second side reinforcement frame 357 disposed at the right side of the first door 40 that is an opposite side to the left side of the first door 40.

The upper reinforcement frame 351 and the lower reinforcement frame 353 are inserted into and coupled to coupling ribs 49*a* disposed in the upper and lower portions of the internal injection-molded body 49, respectively.

In order to fix the first side reinforcement frame 355 and the second side reinforcement frame 357 disposed on both sides of the reinforcement frame 350, fixing members 360 bent in a '¬' shape are inserted into and coupled to both ends of each of the upper reinforcement frame 351 and the lower reinforcement frame 353.

One side of each of the fixing members 360 disposed in the upper portion of the internal injection-molded body 49 is inserted into and coupled to the upper reinforcement frame 351. The other side of each of the fixing members 360 is inserted into and coupled to a top end of the first side reinforcement frame 355 and a top end of the second side reinforcement frame 357.

One side of each of the fixing members 360 disposed in the lower portion of the internal injection-molded body 49 is inserted into and coupled to the lower reinforcement frame 353. The other side of each of the fixing members 360 is inserted into and coupled to a bottom end of the first side reinforcement frame 355 and a bottom end of the second side reinforcement frame 357.

Thus, the first side reinforcement frame 355 and the second side reinforcement frame 357 may be fixed to the upper reinforcement frame 351 and the lower reinforcement frame 353 by using the fixing members 360.

Since the fixing units 210 of the latch unit 200 coupled to the handle 70 are buried in the left side of the first door 40 in which the first side reinforcement frame 355 is disposed, an auxiliary reinforcement frame 359 may be additionally disposed so as to further reinforce rigidity.

The auxiliary reinforcement frame 359 may be inserted into and fixed to fixing ribs 48*a* disposed on the right side of the cabinet 48 and may be disposed to be placed at an outer side than the first side reinforcement frame 355.

Although not shown, like in the second door 50, the VIP V may be filled in the first door 40 so as to improve an insulating property of the first door 40.

Figure 38:
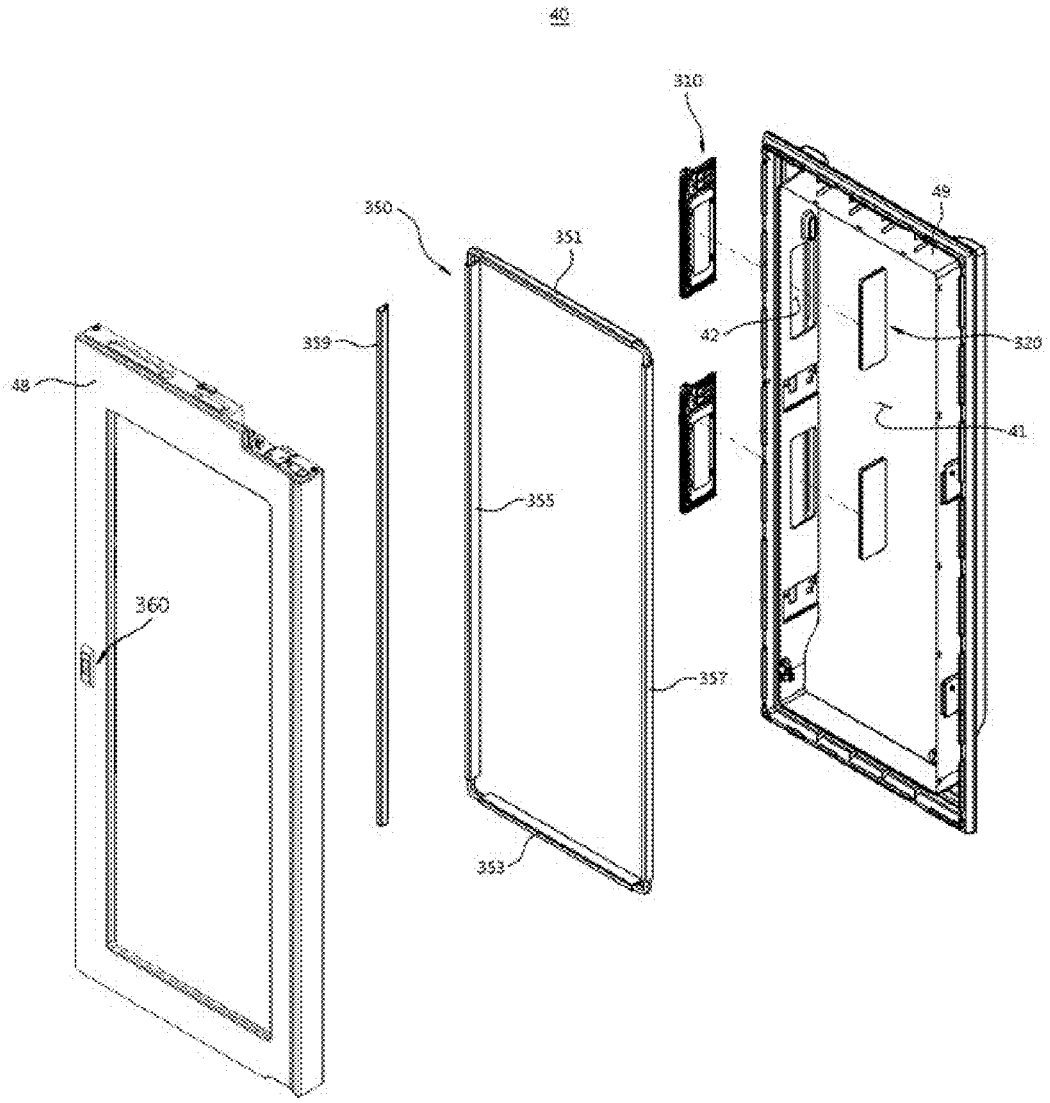
FIG. 38 is an exploded perspective view of the first door in accordance with the embodiment of the present disclosure.
Figure 39:
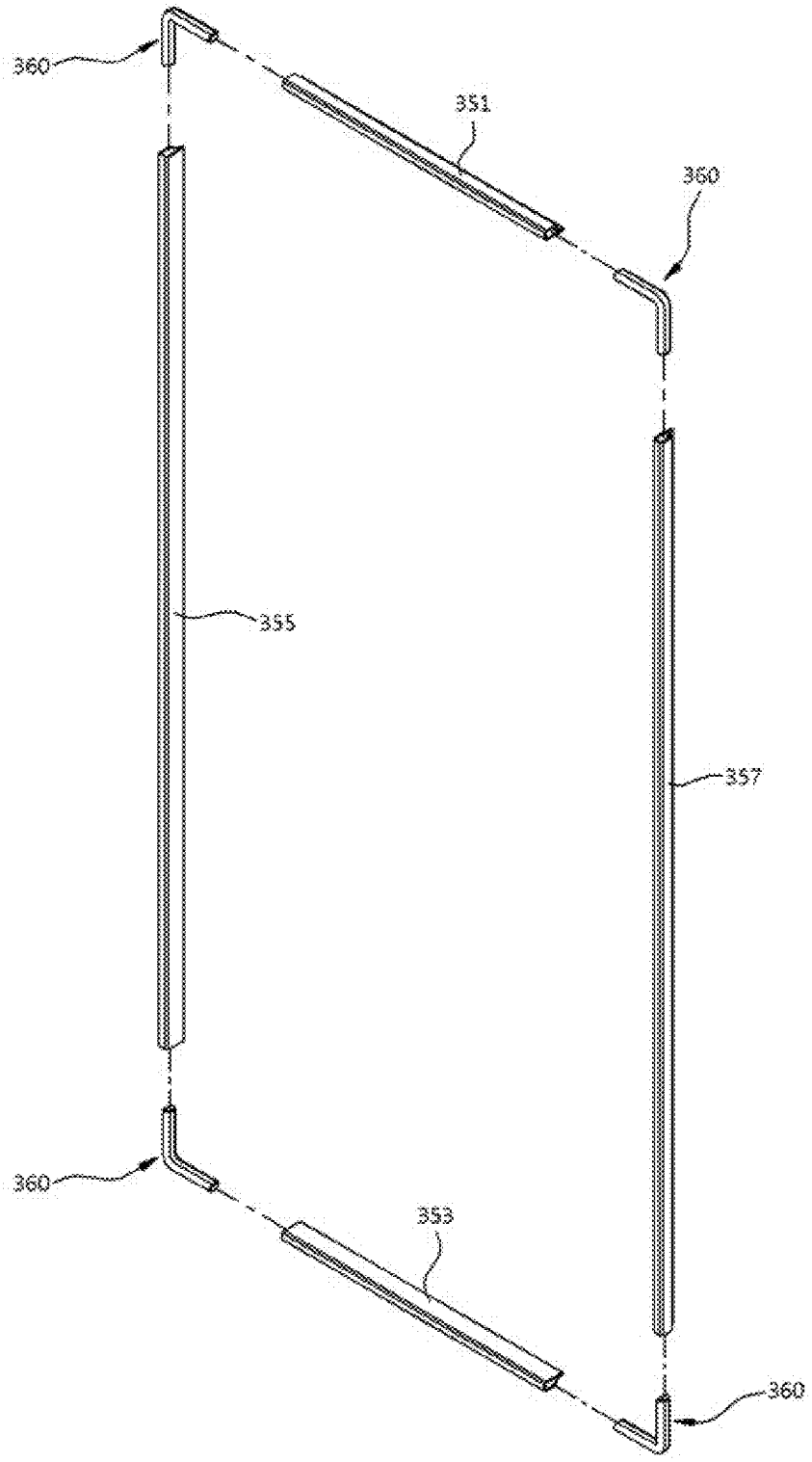
FIG. 39 is a view of the reinforcement frame in accordance with the embodiment of the present disclosure.
Figure 40:
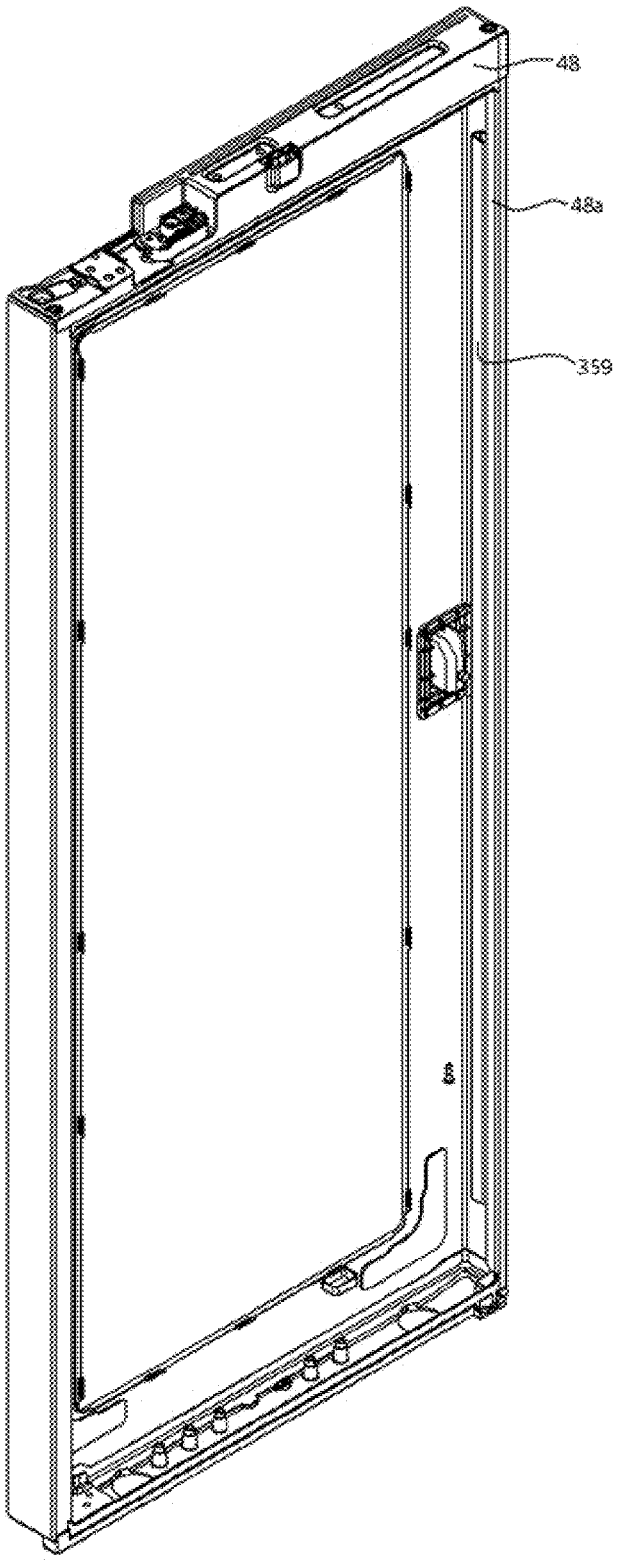
FIG. 40 is a view of a state in which an auxiliary reinforcement frame is coupled to a cabinet, in accordance with the embodiment of the present disclosure.
Figure 41:
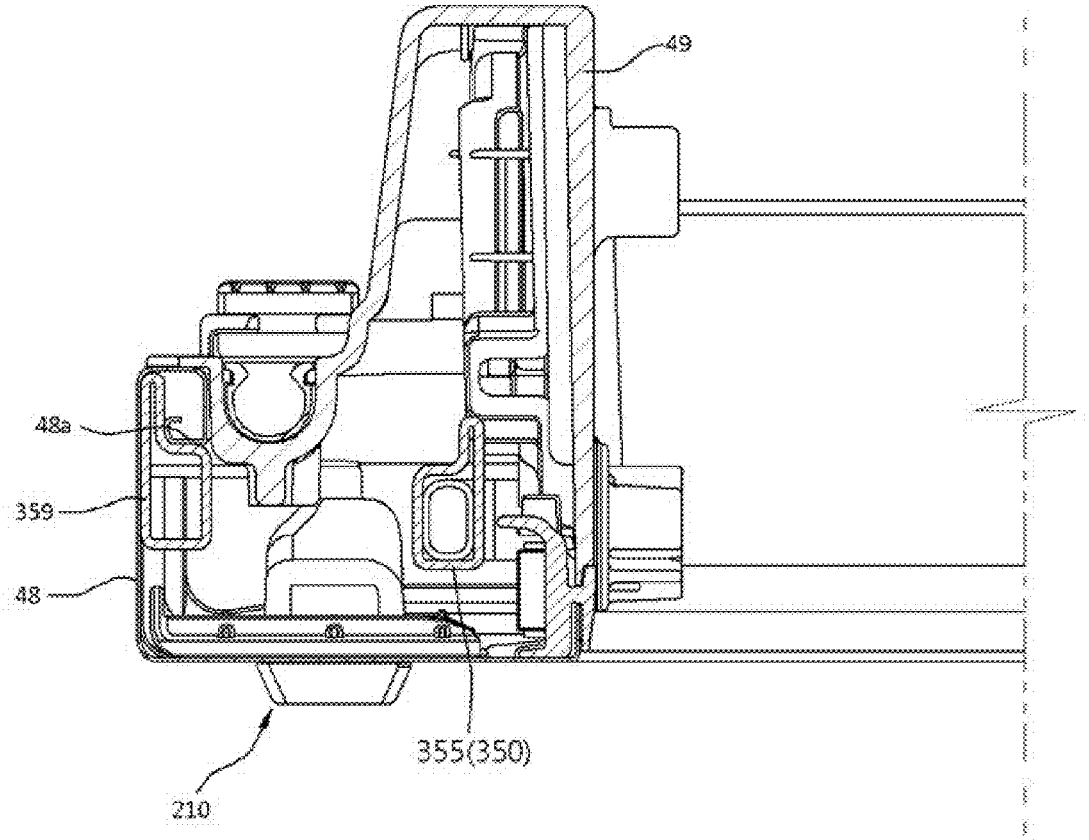
FIG. 41 is a cross-sectional view of a state in which the reinforcement frame in accordance with the embodiment of the present disclosure is disposed in the first door.
Figure 42:
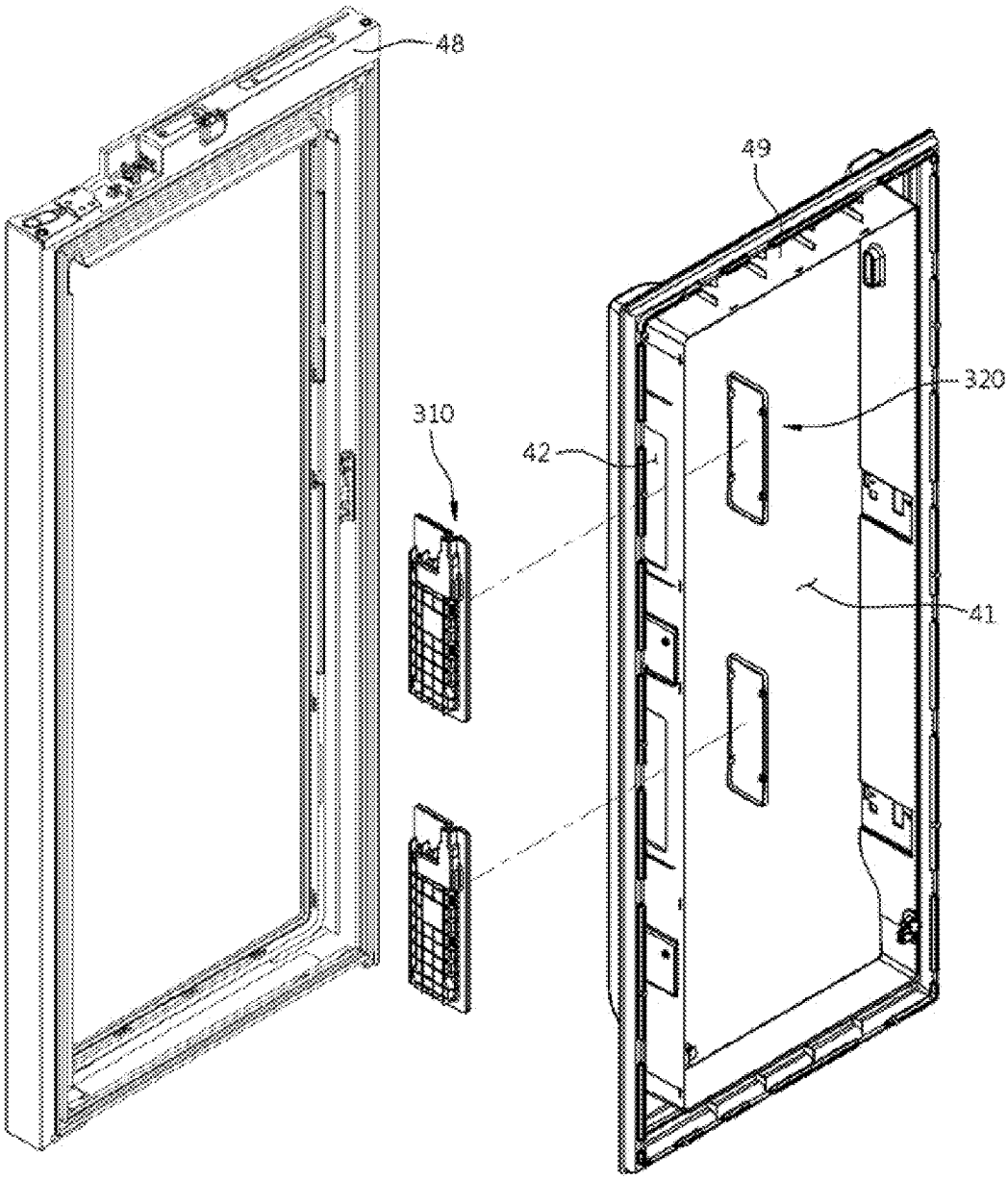
FIG. 42 is a schematic exploded perspective view of the first door in accordance with the embodiment of the present disclosure.
Figure 43:
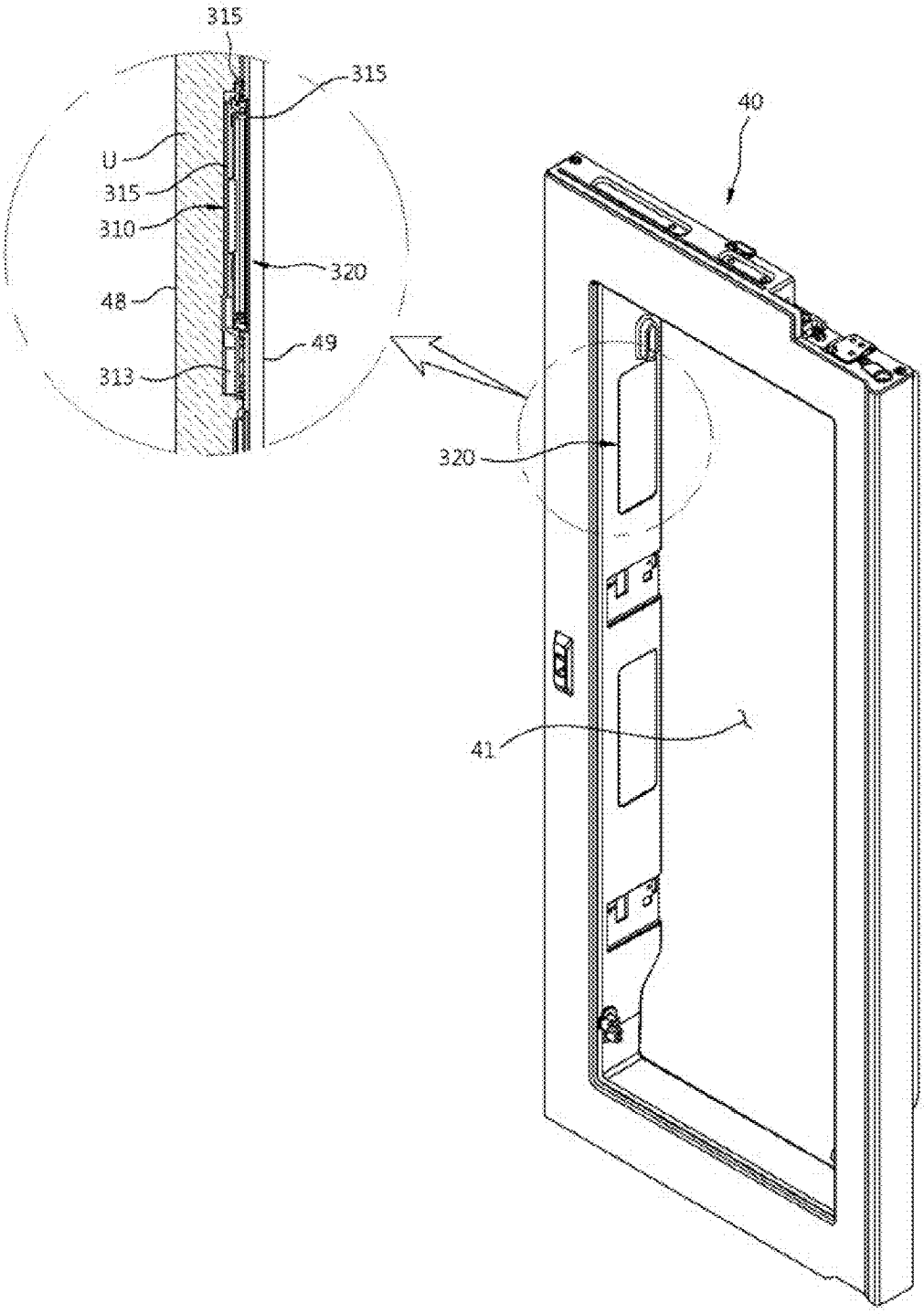
FIG. 43 is a cross-sectional view of a state in which a lamp fixing member is disposed in the first door in accordance with the embodiment of the present disclosure.

As illustrated in FIGS. 38 and 43, at least one lamp installation hole 42 is disposed in the internal injection-molded body 49 so as to install the lamp 320.

At least one lamp fixing member 310 is disposed between the cabinet 48 and the internal injection-molded body 49 so as to fix the lamp 320.

The lamp fixing member 310 is fixed to the internal injection-molded body 49 so as to correspond to the position of the lamp installation hole 42 disposed in the internal injection-molded body 49 before the insulating material U is foamed between the cabinet 48 and the internal injection-molded body 49. When the lamp fixing member 310 is fixed to the internal injection-molded body 49, the insulating material U is foamed between the cabinet 48 and the internal injection-molded body 49.

Figure 44:
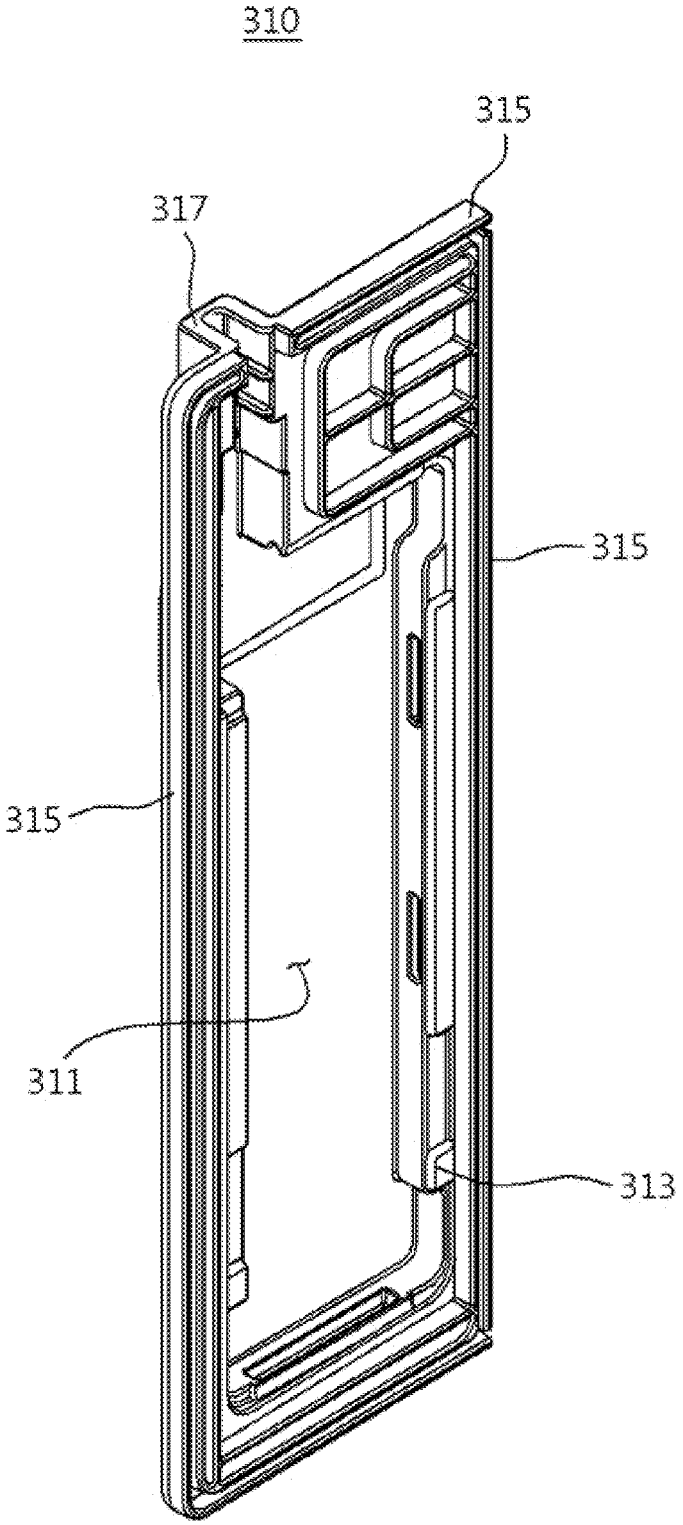
FIG. 44 is a perspective view of the lamp fixing member in accordance with the embodiment of the present disclosure.

The lamp fixing member 310 includes a seating portion 311 on which the lamp 320 is seated, a plurality of fixing hooks 313 that fix the lamp 320 seated on the seating portion 311, ribs 315 that are disposed on upper and right and left side edges of the lamp fixing member 310 and prevents the insulating material U from penetrating into the seating portion 311, and a wire guide portion 317 that guides a wire W for supplying power so that the lamp 320 may emit light, as illustrated in FIG. 44.

When the lamp fixing member 310 is fixed to the internal injection-molded body 49 and the insulating material U is foamed between the cabinet 48 and the internal injection-molded body 49, the lamp 320 is seated on the seating portion 311 of the lamp fixing member 310 through the lamp installation hole 42.

When the lamp 320 is seated on the seating portion 311, the lamp 320 is fixed to the seating portion 311 by using the plurality of fixing hooks 313.

The ribs 315 may be disposed on the upper and right and left side edges of the lamp fixing member 310 so as to prevent the insulating material U from penetrating into the seating portion 311 through a space between the lamp fixing member 310 and the internal injection-molded body 49 when the insulating material U is foamed between the cabinet 48 and the internal injection-molded body 49 after the lamp fixing member 310 is fixed to the internal injection-molded body 49.

Although the ribs 315 are disposed on the upper and right and left side edges of the lamp fixing member 310, embodiments of the present disclosure are not limited thereto. The ribs 315 may be disposed on the internal injection-molded body 49 in which the lamp fixing member 310 is disposed, and a separate structure may be disposed between the upper and right and left side edges of the lamp fixing member 310 and the internal injection-molded body 49 so as to prevent penetration of the insulating material U.

Figure 45:
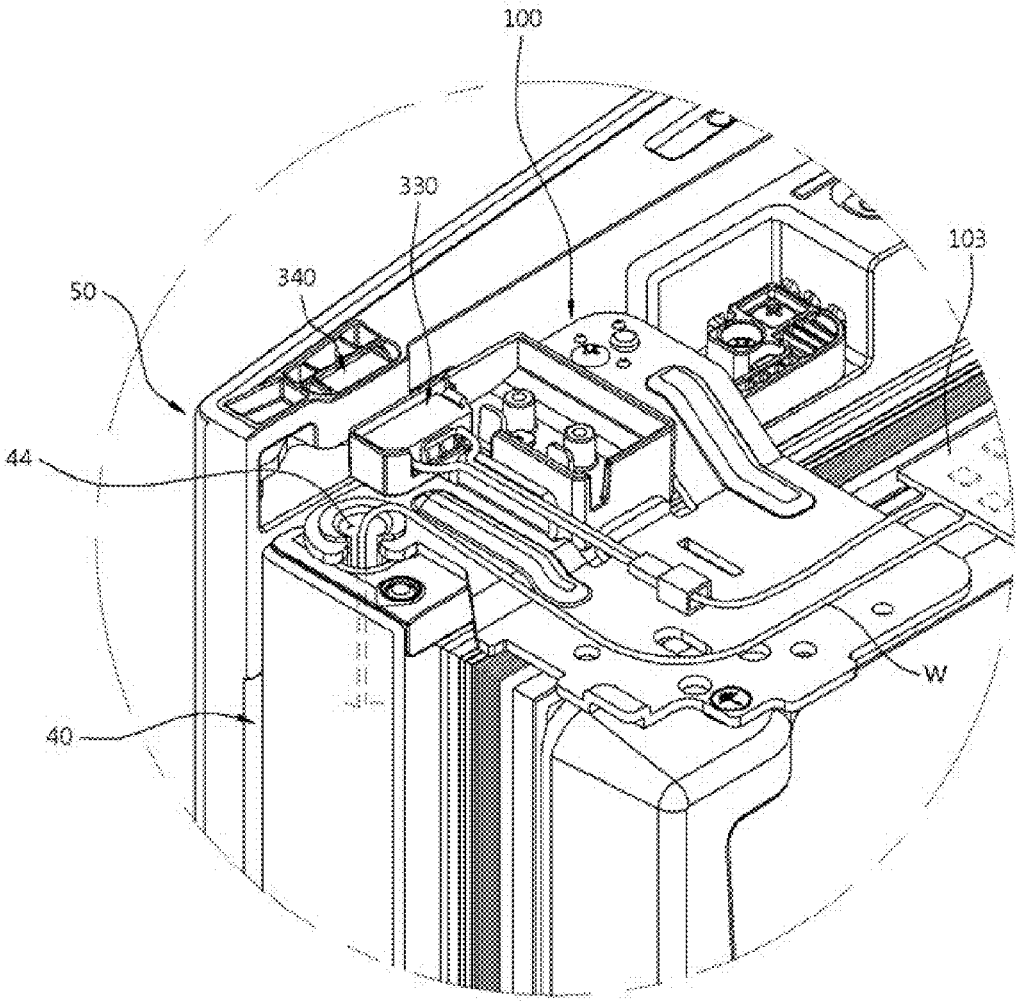
FIG. 45 is a view of a wire that connects electronic apparatus components and a lamp is guided toward a main body through a first hinge hole in accordance with an embodiment of the present disclosure.

As illustrated in FIG. 45, an opening/closing detection sensor 330 is disposed in the hinge unit 100 disposed in the upper portion of the main body 10 so as to detect opening/closing of the first door 40, and a sensor detection unit 340 is disposed in the upper portion of the second door 50 to correspond to the opening/closing detection sensor 330 so as to transfer the result of detection regarding whether the second door 50 is opened/closed, to the opening/closing detection sensor 330.

A hinge cover 101 (see FIG. 1) that covers the hinge unit 100 not to be exposed to the outside, is disposed in an upper portion of the hinge unit 100, and electronic apparatus components 103 are accommodated in the hinge cover 101 so as to control an operation of the refrigerator.

The opening/closing detection sensor 330 disposed in the hinge unit 100 is connected to the electronic apparatus components 103, and the electronic apparatus components 103 and the lamp 320 are connected to each other by using the wire W so that the opening/closing detection sensor 330 may detect whether the first door 40 is opened/closed and may transfer the result of detection to the electronic apparatus components 103 and the electronic apparatus components 103 supply power to the lamp 320 by using the wire W or cut off the supply of power.

Figure 46:
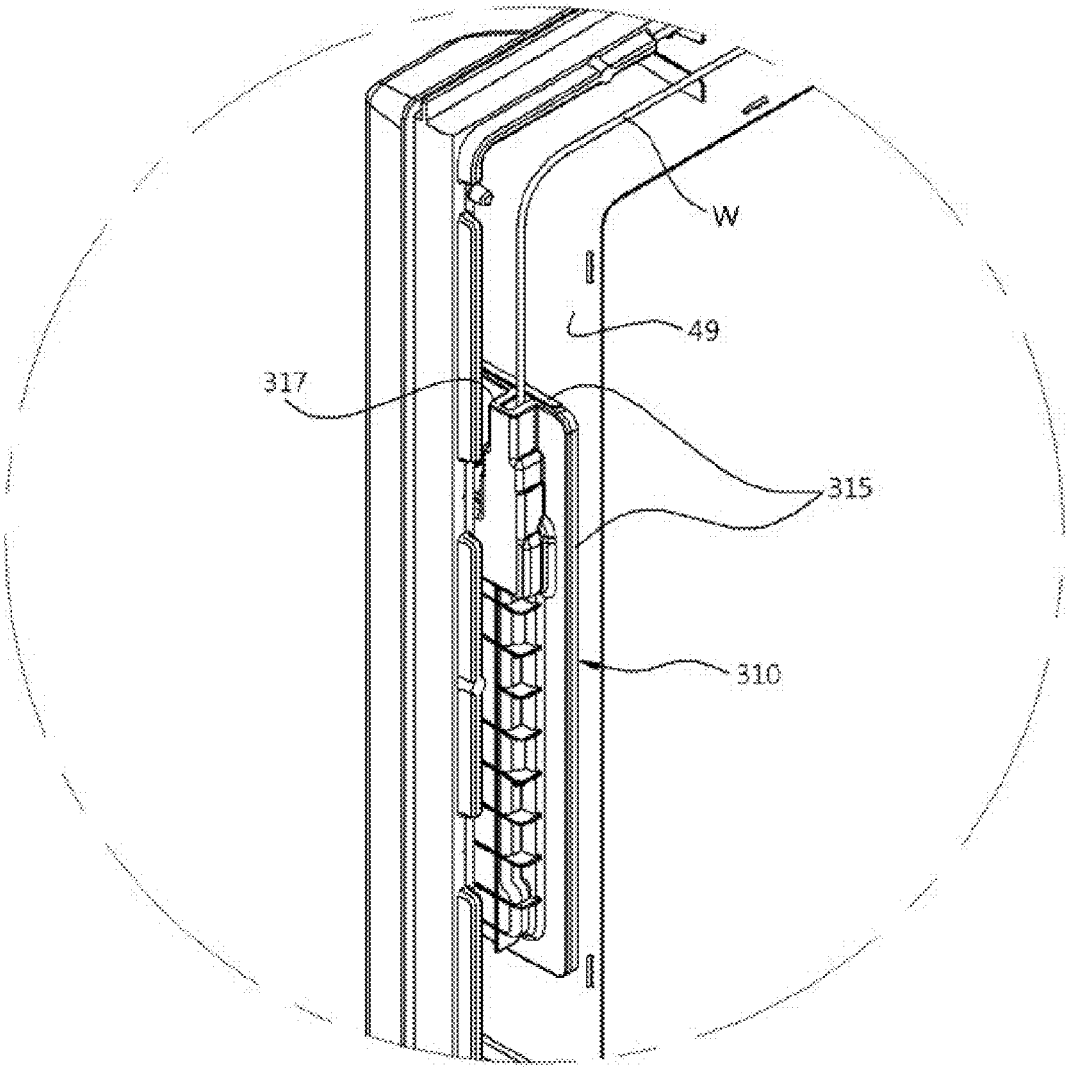
FIG. 46 is a view of a state in which the wire that connects the electronic apparatus components and the lamp is guided by a wire guide portion of the lamp fixing member in accordance with an embodiment of the present disclosure.

The wire W that connects the electronic apparatus components 103 and the lamp 320 is connected to the electronic apparatus components 103 and is guided into the main body 10 through the first hinge hole 44, as illustrated in FIG. 45. The wire W guided into the main body 10 is guided by the wire guide portion 317 disposed in the lamp fixing member 310 and is connected to the lamp 320, as illustrated in FIG. 46.

The sensor detection unit 340 is disposed in the upper portion of the second door 50, and the opening/closing detection sensor 330 detects a distance at which the sensor detection unit 340 is spaced apart from the opening/closing detection sensor 330, and causes power to be supplied to the lamp 320 or to cut off the supply of power depending on whether the second door 50 is opened/closed.

An operation of the lamp 320 depending on whether each of the first door 40 and the second door 50 is opened, will now be described.

When the first door 40 is opened, the opening/closing detection sensor 330 detects opening of the first door 40 and transfers the result of detection to the electronic apparatus components 103, and the electronic apparatus components 103 supply power to the lamp 320 by using the wire W so that the lamp 320 may emit light.

Since, when the first door 40 is opened, the first door 40 is distant from the refrigerator compartment 21, the user cannot easily identify food stored in the door guard 33 disposed in the opening 41 by using only light emitted from an inside of the refrigerator compartment 21. However, when the lamp 320 disposed on the sidewalls of the opening 41 emits light, the user may easily identify food stored in the door guard 33 disposed in the opening 41 so that, even when there is no light around the refrigerator, the user does not feel inconvenience.

When the first door 40 is closed, the opening/closing detection sensor 330 detects closing of the first door 40 and transfers the result of detection to the electronic apparatus components 103. The electronic apparatus components 103 cut off power supplied to the lamp 320 by using the wire W.

When the second door 50 is opened, the opening/closing detection sensor 330 detects a distance at which the sensor detection unit 340 is spaced apart from the opening/closing detection sensor 330, and transfers the result of detection that the second door 50 is opened, to the electronic apparatus components 103, and the electronic apparatus components 103 supply power to the lamp 320 by using the wire W so that the lamp 320 may emit light.

When the second door 50 is opened, the user may identify food stored in the door guard 33 disposed in the opening 41 of the first door 40 by using light emitted from the inside of the refrigerator compartment 21. However, when food or an article having a large height is disposed in the refrigerator compartment 21, light emitted from the inside of the refrigerator compartment 21 is cut off, and the user may not easily identify food stored in the door guard 33. However, when the lamp 320 disposed on the sidewalls of the opening 41 emits light, the user may easily identify food stored in the door guard 33.

When the second door 50 is closed, the opening/closing detection sensor 330 detects a distance between the opening/closing detection sensor 330 and the sensor detection unit 340 and transfers the result of detection that the second door 50 is closed, to the electronic apparatus components 103, and the electronic apparatus components 103 cut off power supplied to the lamp 320 by using the wire W.

As illustrated in FIG. 1, the freezer compartment door 60 is configured as a drawer type door that moves in the forward/backward direction by using the sliding method.

A storing unit 400 is coupled to a rear side of the freezer compartment door 60. The storing unit 400 is inserted into and drawn from the inside of the freezer compartment 23 by using the sliding method.

In order to guide the storing unit 400 to be inserted into and drawn from the inside of the freezer compartment 23, a guide rail 13 is coupled to both sidewalls of the inside of the freezer compartment 23 in which the storing unit 400 is accommodated.

Figure 47:
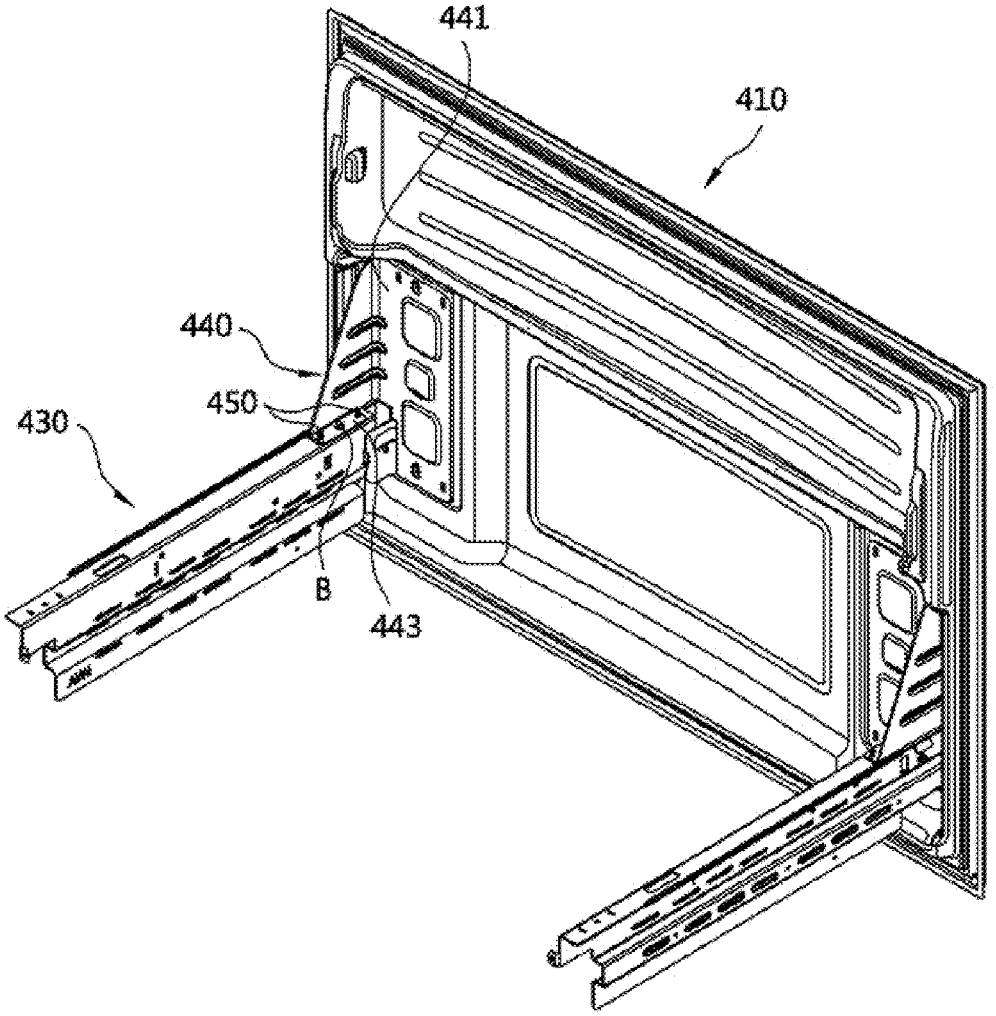
FIG. 47 is a view of a part of a storing unit in accordance with an embodiment of the present disclosure.
Figure 48:
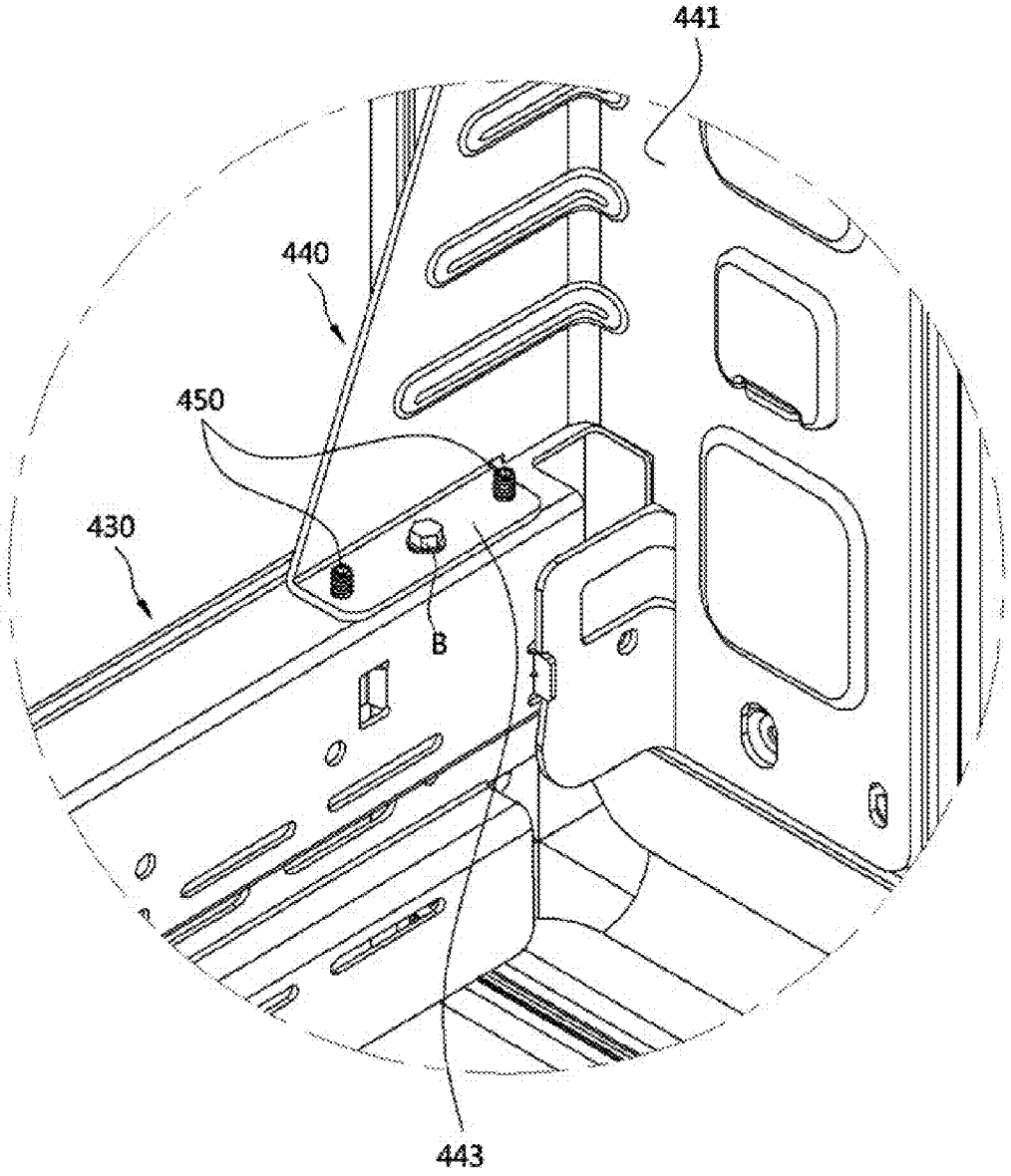
FIG. 48 is a view of a portion in which a slide rail and a hanger are coupled to each other, in accordance with an embodiment of the present disclosure.

As illustrated in FIG. 1 and FIGS. 47 and 48, the storing unit 400 includes a panel 410 coupled to the rear side of the freezer compartment door 60, a storage box 420 which is disposed at a rear side of the panel 410 and in which food is stored, a slide rail 430 that is coupled to the rear side of the panel 410, supports a lower portion of sides of the storage box 420, and is guided by the guide rail 13, a hanger 440 that connects the panel 410 and the slide rail 430, and at least one tilting adjustment unit 450 that adjusts the hanger 440 to be tilted from the slide rail 430.

The hanger 440 includes a panel coupling portion 441 coupled to the panel 410 and a rail coupling portion 443 coupled to the slide rail 430.

Figure 49:
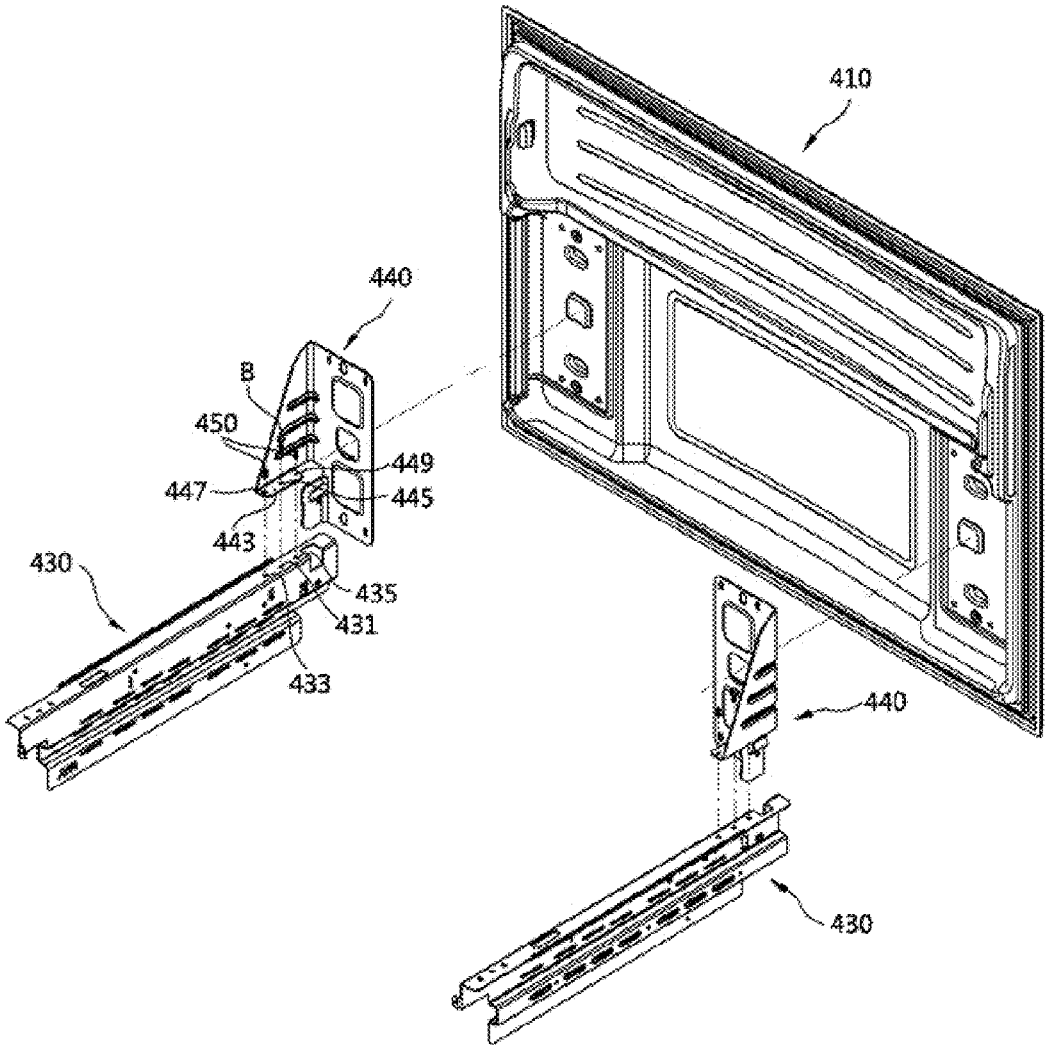
FIG. 49 is an exploded perspective view of the storing unit illustrated in FIG. 40.
Figure 50:
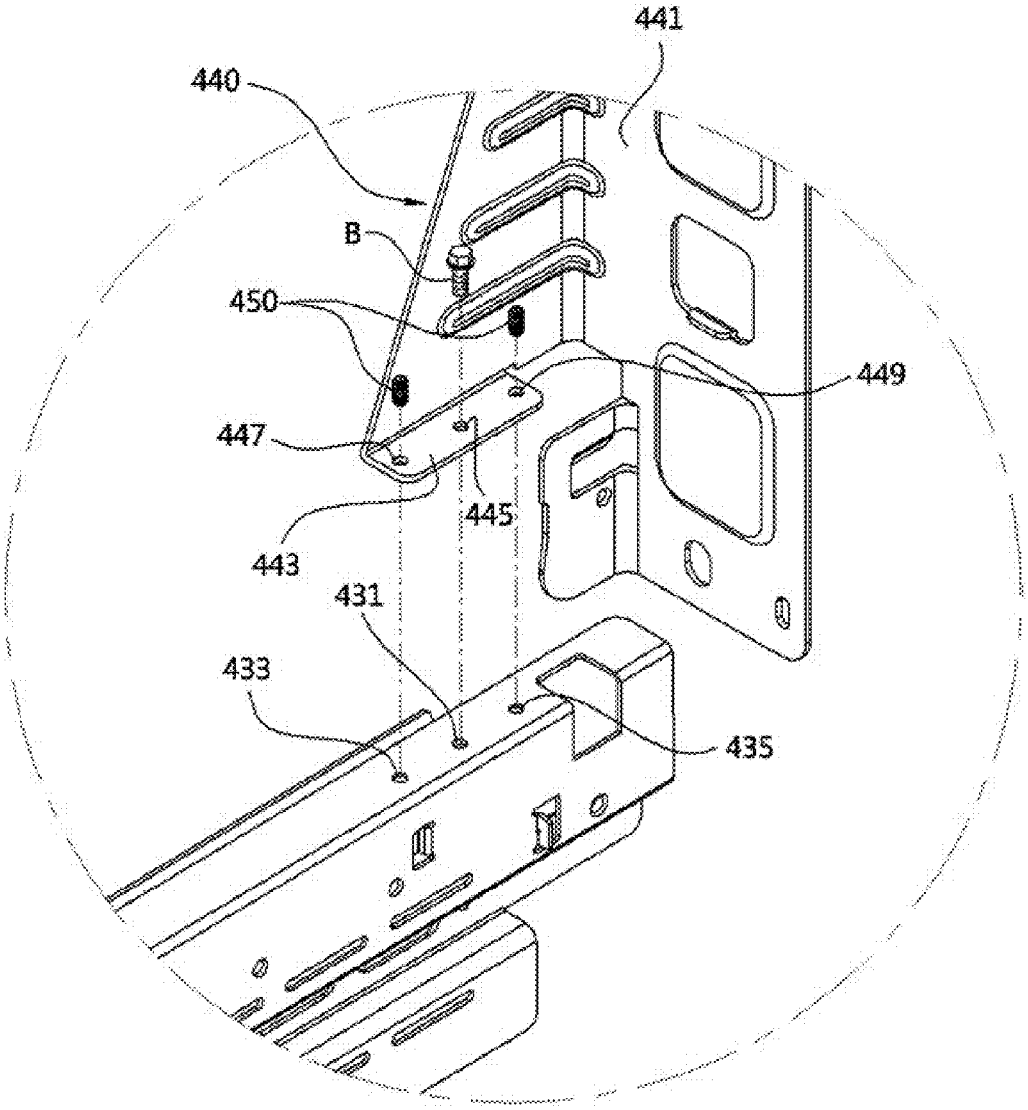
FIG. 50 is a view of a state in which the slide rail and the hanger are coupled to each other, in accordance with an embodiment of the present disclosure.

As illustrated in FIGS. 49 and 50, a first fastening member insertion hole 445 through which the hanger 440 and the slide rail 430 are coupled to each other, is disposed in the rail coupling portion 443. A second fastening member insertion hole 431 is disposed in the slide rail 430 to correspond to the first fastening member insertion hole 445, and the hanger 440 and the slide rail 430 are coupled to each other by using the fastening member B inserted into the first fastening member insertion hole 445 and the second fastening member insertion hole 431.

The first fastening member insertion hole 445 is disposed in the center of the rail coupling portion 443. A first tilting adjustment hole 447 and a second tilting adjustment hole 449 into which the tilting adjustment unit 450 is inserted, are disposed in a front end and a rear end of the rail coupling portion 443.

A first fixing groove 433 and a second fixing groove 435 into which the tilting adjustment unit 450 inserted into the first tilting adjustment hole 447 and the second tilting adjustment hole 449 is rotatably fixed to prevent from moving, are disposed in the slide rail 430 to correspond to the first tilting adjustment hole 447 and the second tilting adjustment hole 449.

Since the hanger 440 and the slide rail 430 are coupled in an upper portion of the slide rail 430, the tilting adjustment unit 450 inserted into the first tilting adjustment hole 447 and the second tilting adjustment hole 449 disposed in the rail coupling portion 443 is inserted in the upper portion of the rail coupling portion 443. The first fixing groove 433 and the second fixing groove 435 disposed in the slide rail 430 are disposed in a top surface of the slide rail 430, and a part of a bottom end of the tilting adjustment unit 450 inserted into the first tilting adjustment hole 447 and the second tilting adjustment hole 449 is inserted into the first fixing groove 433 and the second fixing groove 435 and is fixed thereto.

Figure 51:
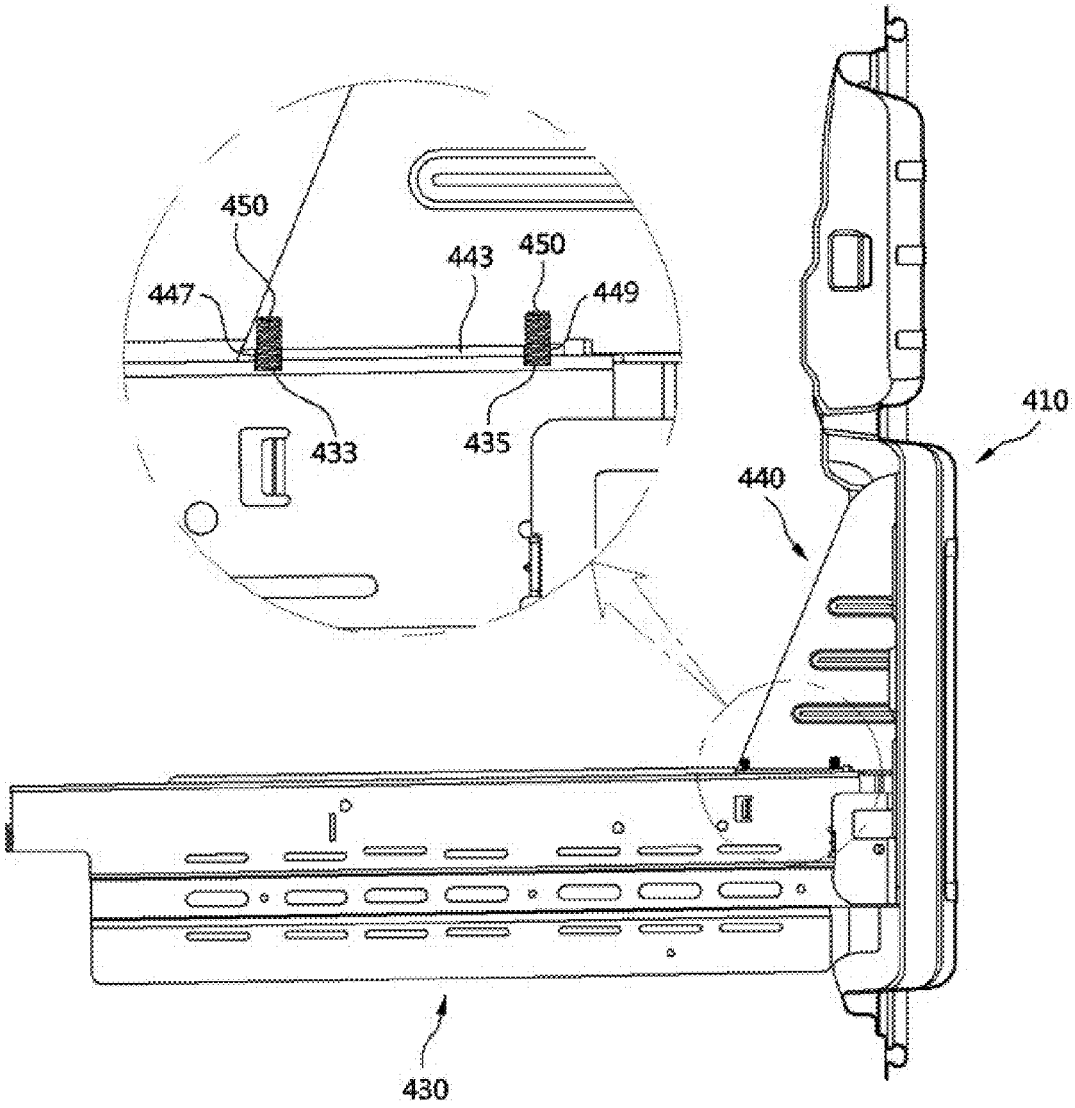
FIGS. 51 through 53 are views of an operation in which the hanger is tilted by a tilting adjustment unit, in accordance with an embodiment of the present disclosure.
Figure 52:
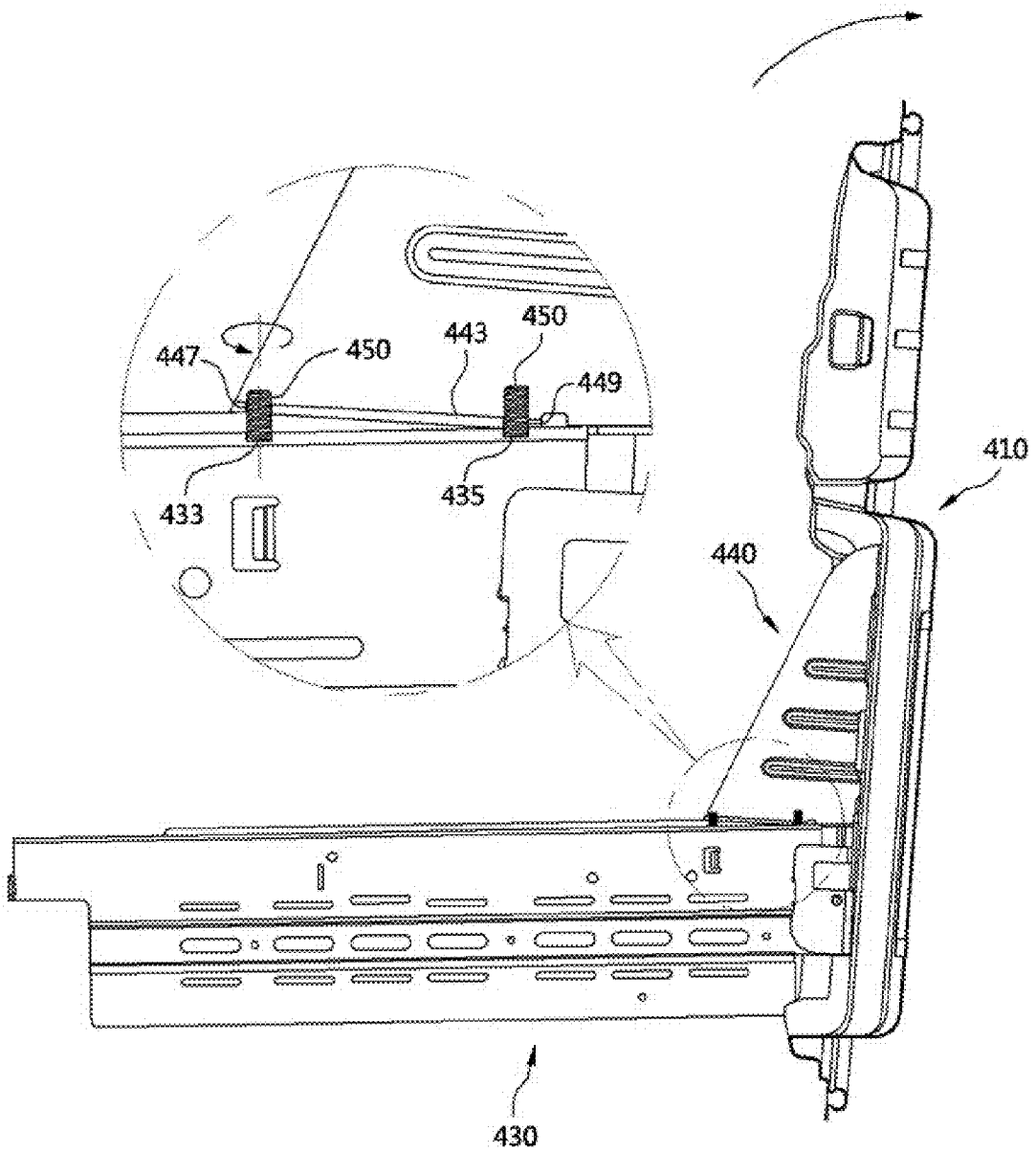
Figure 53:
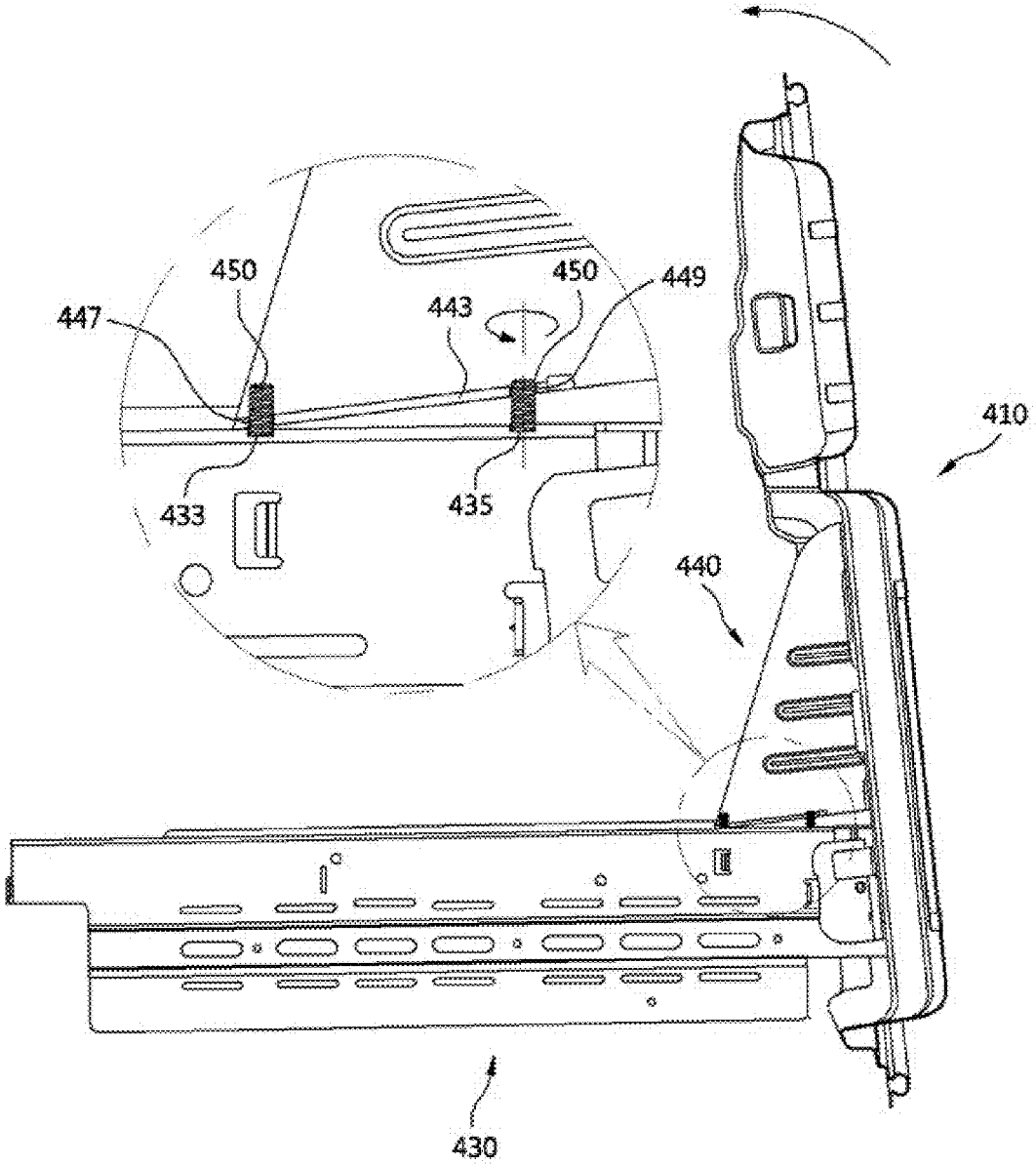

Next, an operation in which the hanger 440 is tilted from the slide rail 430 by using the tilting adjustment unit 450, will be described with reference to FIGS. 51 through 53.

In order to allow the hanger 440 to be tilted from the slide rail 430 by using the tilting adjustment unit 450, when tilting is finished after removing the fastening member B that couples the hanger 440 and the slide rail 430 each other, the fastening member B needs to be fastened again. Thus, in the drawings that illustrate an operation in which the hanger 440 is tilted from the slide rail 430 by using the tilting adjustment unit 450, the fastening member B, and the first fastening member insertion hole 445, and the second fastening member insertion hole 431 into which the fastening member B is inserted, are deleted.

When sealing of a bottom end of the freezer compartment door 60 is defective and cold air in the freezer compartment 23 leaks toward the outside, in order to improve defective sealing, when the tilting adjustment unit 450 inserted into the first tilting adjustment hole 447 is rotated in the state of FIG. 45, as illustrated in FIG. 46, the bottom end of the tilting adjustment unit 450 is rotatably fixed into the first fixing groove 433. Thus, the first tilting adjustment hole 447 is moved in an upward direction of the tilting adjustment unit 450 and thus, the front end of the rail coupling portion 443 is spaced apart from the slide rail 430 and is rotated about the second tilting adjustment hole 449 upward.

When the hanger 440 is rotated about the second tilting adjustment hole 449 upward, in the drawings, the panel 410 coupled to the hanger 440 is rotated clockwise.

When the panel 410 is rotated clockwise, the freezer compartment door 60 to which the panel 410 is coupled, is rotated clockwise. Thus, the bottom end of the freezer compartment door 60 is moved in a downward direction compared to a case before the freezer compartment door 60 is rotated so that defective sealing of the bottom end of the freezer compartment door 60 may be prevented.

When sealing of the top end of the freezer compartment door 60 is defective and cold air in the freezer compartment 23 leaks toward the outside, in order to improve defective sealing, when the tilting adjustment unit 450 inserted into the second tilting adjustment hole 449 is rotated in the state of FIG. 45, as illustrated in FIG. 47, the bottom end of the tilting adjustment unit 450 is rotatably fixed into the second fixing groove 435. Thus, the second tilting adjustment hole 449 is moved in the upward direction of the tilting adjustment unit 450 and thus, a rear end of the rail coupling portion 443 is spaced apart from the slide rail 430 and rotated about the first tilting adjustment hole 447 upward.

When the hanger 440 is rotated about the first tilting adjustment hole 447 upward, in the drawings, the panel 410 coupled to the hanger 440 is rotated counterclockwise.

When the panel 410 is rotated counterclockwise, since the freezer compartment door 60 to which the panel 410 is coupled, is rotated counterclockwise, the top end of the freezer compartment door 60 is moved in an upward direction compared to the case before the freezer compartment door 60 is rotated so that defective sealing of the top end of the freezer compartment door 60 may be prevented.

Next, another embodiment in which positions of the tilting adjustment hole and the fixing groove are changed, will be described.

Figure 54:
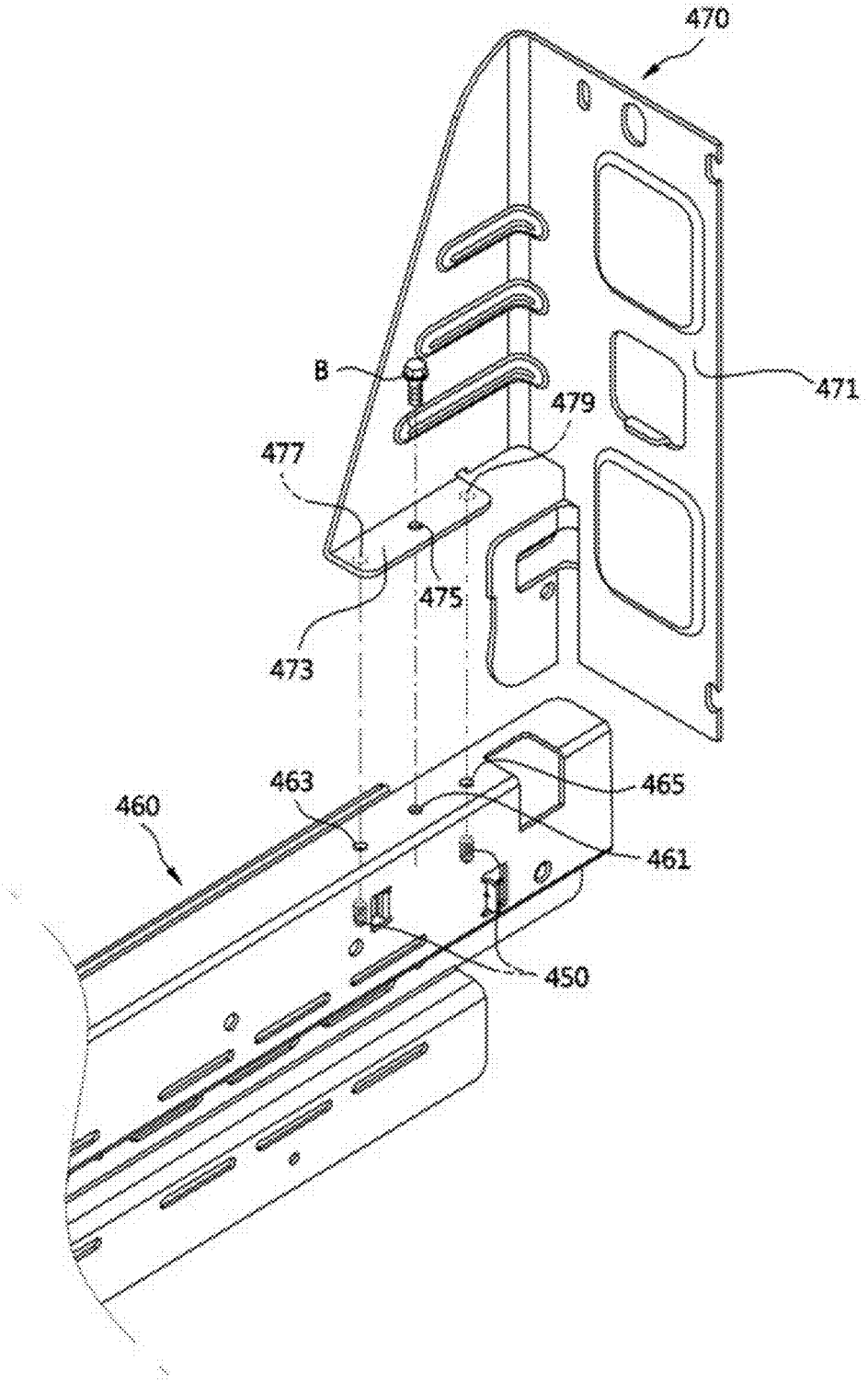
FIG. 54 is a view of a state in which the slide rail and the hanger are coupled to each other, in accordance with another embodiment of the present disclosure.

As illustrated in FIG. 54, a first fastening member insertion hole 475 through which a hanger 470 and a slide rail 460 are coupled to each other, is disposed in a rail coupling portion 473, and a second fastening member insertion hole 461 is disposed in the slide rail 460 to correspond to the first fastening member insertion hole 475 so that the hanger 470 and the slide rail 460 may be coupled to each other by using the fastening member B inserted into the first fastening member insertion hole 475 and the second fastening member insertion hole 461.

The first fastening member insertion hole 475 is disposed in the center of the rail coupling portion 473. A first tilting adjustment hole 463 and a second tilting adjustment hole 465 into which the tilting adjustment unit 450 is inserted, are disposed in the slide rail 460 in the position corresponding to the front end and the rear end of the rail coupling portion 473.

A first fixing groove 477 and a second fixing groove 479 into which the tilting adjustment unit 450 inserted into the first tilting adjustment hole 463 and the second tilting adjustment hole 465 is rotatably fixed to prevent movement, are disposed in the rail coupling portion 473 in positions corresponding to the first tilting adjustment hole 463 and the second tilting adjustment hole 465.

Since the hanger 470 and the slide rail 460 are coupled in an upper portion of the slide rail 460, the tilting adjustment unit 450 inserted into the first tilting adjustment hole 463 and the second tilting adjustment hole 465 disposed in the slide rail 460 is inserted in the lower portion of the slide rail 460. The first fixing groove 477 and the second fixing groove 479 disposed in the rail coupling portion 473 are disposed in a bottom surface of the rail coupling portion 473, and a part of a top end of the tilting adjustment unit 450 inserted into the first tilting adjustment hole 463 and the second tilting adjustment hole 465 is inserted into the first fixing groove 477 and the second fixing groove 479 and is fixed thereto.

An operation in which the hanger 470 is tilted from the slide rail 460 by using the tilting adjustment unit 450, is merely different from the operation illustrated in FIGS. 45 through 47 in positions of the first tilting adjustment hole 463 and the second tilting adjustment hole 465 and positions of the first fixing groove 477 and the second fixing groove 479. Since, when the tilting adjustment unit 450 inserted into the first tilting adjustment hole 463 is rotated, the hanger 470 is rotated about the second tilting adjustment hole 465 upward and when the tilting adjustment unit 450 inserted into the second tilting adjustment hole 465 is rotated, the hanger 470 is rotated about the first tilting adjustment hole 463 upward, a detailed description of the operation will be omitted.

Figure 55:
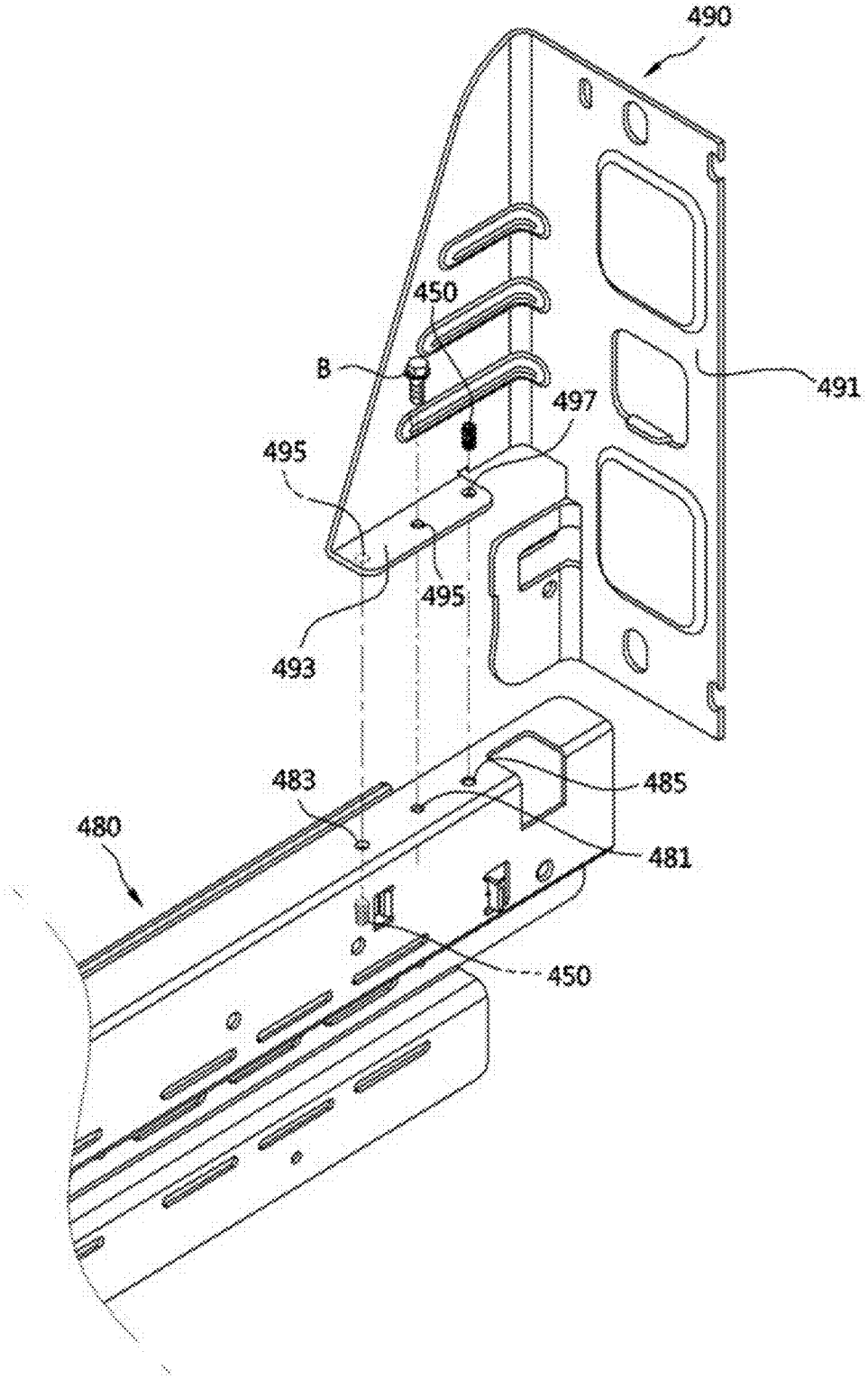
FIG. 55 is a view of a state in which the slide rail and the hanger are coupled to each other, in accordance with still another embodiment of the present disclosure.

As illustrated in FIG. 55, a first fastening member insertion hole 495 through which a hanger 490 and a slide rail 480 are coupled to each other, is disposed in a rail coupling portion 493. A second fastening member insertion hole 481 is disposed in the slide rail 480 to correspond to the first fastening member insertion hole 495 so that the hanger 490 and the slide rail 480 may be coupled to each other by using the fastening member B inserted into the first fastening member insertion hole 495 and the second fastening member insertion hole 481.

The first fastening member insertion hole 495 is disposed in the center of the rail coupling portion 493. A second tilting adjustment hole 497 into which the tilting adjustment unit 450 is inserted, is disposed in the rear end of the rail coupling portion 493, and a first tilting adjustment hole 483 into which the tilting adjustment unit 450 is inserted, is disposed in the slide rail 480 in a position corresponding to the front end of the rail coupling portion 493.

A first fixing groove 499 into which the tilting adjustment unit 450 inserted into the first tilting adjustment hole 483 is rotatably fixed, is disposed in the front end of the rail coupling portion 493 to correspond to a position corresponding to the first tilting adjustment hole 483. The second fixing groove 485 into which the tilting adjustment unit 450 inserted into the second tilting adjustment hole 497 is rotatably fixed, is disposed in the slide rail 480 in a position corresponding to the second tilting adjustment hole 497.

Since the hanger 490 is coupled in an upper portion of the slide rail 480, the tilting adjustment unit 450 is inserted into a lower portion of the first tilting adjustment hole 483 disposed in the slide rail 480, and the tilting adjustment unit 450 is inserted into an upper portion of the second tilting adjustment hole 497 disposed in the rail coupling portion 493.

The first fixing groove 499 disposed in the rail coupling portion 493 is disposed in a bottom surface of the rail coupling portion 493 so that a part of a top end of the tilting adjustment unit 450 inserted into the first tilting adjustment hole 483 may be inserted into and fixed into the first fixing groove 499. The second fixing groove 485 disposed in the slide rail 480 is disposed in a top surface of the slide rail 480 so that a part of a bottom end of the tilting adjustment unit 450 inserted into the second tilting adjustment hole 497 may be inserted into and fixed into the second fixing groove 485.

An operation in which the hanger 490 is tilted from the slide rail 480 by using the tilting adjustment unit 450, is merely different from the operation illustrated in FIGS. 45 through 47 in positions of the first tilting adjustment hole 483 and the second tilting adjustment hole 497 and positions of the first fixing groove 499 and the second fixing groove 485. Since, when the tilting adjustment unit 450 inserted into the first tilting adjustment hole 483 is rotated, the hanger 490 is rotated about the second tilting adjustment hole 497 upward and when the tilting adjustment unit 450 inserted into the second tilting adjustment hole 497 is rotated, the hanger 490 is rotated about the first tilting adjustment hole 483 upward, a detailed description of the operation will be omitted.

As described above, in accordance with embodiments of the present disclosure, when a door is opened, visibility of food stored in a door guard can be improved.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a main body having a storage compartment;

a first door rotatably disposed in front of the main body to open/close the storage compartment, the first door having an opening framed by sidewalls formed therein and at least one door guard disposed in the opening;

a second door rotatably disposed in front of the first door to open/close the opening, the second door being rotated in the same direction as the first door;

a hinge unit to rotatably couple the first door to the main body;

at least one lamp installation hole disposed in the sidewalls of the opening;

at least one lamp fixing member disposed in the sidewalls of the opening in a position corresponding to the at least one lamp installation hole;

at least one lamp fixed to the at least one lamp fixing member;

an opening/closing detection sensor that is disposed in the hinge unit; and a sensor detection unit that is disposed in the second door in a position corresponding to the opening/closing detection sensor, wherein the opening/closing detection sensor is configured to detect a distance the sensor detection unit is spaced apart from the opening/closing detection sensor and to cause the at least one lamp to emit light when the second door is opened.

2. The refrigerator of claim 1, wherein the first door comprises:

a cabinet that constitutes an exterior;

an internal injection-molded body that constitutes the sidewalls of the opening; and an insulating material foamed between the cabinet and the internal injection-molded body, wherein the insulating material is foamed between the cabinet and the internal injection-molded body after the at least one lamp fixing member is disposed in the sidewalls.

3. The refrigerator of claim 2, wherein the at least one lamp fixing member comprises:

a seating portion on which the at least one lamp is seated;

a plurality of fixing hooks that fix the at least one lamp seated on the seating portion;

ribs disposed on upper and right and left side edges of the at least one lamp fixing member so as to prevent the insulating material from penetrating into the seating portion; and a wire guide portion that guides a wire to supply power to the at least one lamp.

4. The refrigerator of claim 3, wherein the hinge unit comprises a first hinge shaft to rotatably couple the first door to the main body, and wherein a first hinge hole into which the first hinge shaft is inserted is disposed in an upper portion of the first door.

5. The refrigerator of claim 4, further comprising:

a hinge cover to cover the hinge unit disposed in a top end of the main body; and electronic apparatus components accommodated in the hinge cover.

6. The refrigerator of claim 5, wherein the wire to supply power to the at least one lamp is connected to the electronic apparatus components and is guided into the main body through the first hinge hole, and the wire guided into the main body is guided by the wire guide portion and is connected to the at least one lamp.

7. The refrigerator of claim 1, wherein, when the second door is opened, the sensor detection unit is spaced apart from the opening/closing detection sensor, and the opening/closing detection sensor detects that the sensor detection unit is spaced apart from the opening/closing detection sensor, and causes the at least one lamp to emit light so that food stored in the at least one door guard is illuminated, and when the second door is closed, the sensor detection unit approaches the opening/closing detection sensor, and the opening/closing detection sensor detects that the sensor detection unit approaches the opening/closing detection sensor, and cuts off power supplied to the at least one lamp.

8. The refrigerator door of claim 1, wherein the opening/closing detection sensor detects whether the first door is opened/closed, and causes the at least one lamp to emit light when the first door is opened.

9. A refrigerator door to open/close a storage compartment of a refrigerator, the refrigerator door comprising:

a first door rotatably coupled to the refrigerator by a hinge unit, the first door having a first door opening defined by a pair of sidewalls formed in the first door, a door guard disposed in the first door opening between the sidewalls, and a lamp configured to illuminate the door guard, the lamp being disposed in one of the sidewalls;

a second door rotatably coupled to the first door, the second door being configured to open/close the first door opening;

an opening/closing detection sensor disposed proximate to the hinge unit; and a sensor detection unit is disposed in an upper portion of the second door, wherein the opening/closing detection sensor is configured to detect a distance the sensor detection unit is spaced apart from the opening/closing detection sensor and to cause the lamp to emit light when the second door is opened.

10. The refrigerator door of claim 9, wherein the sidewall having the lamp disposed thereon comprises a lamp installation hole and a lamp fixing member disposed in a position corresponding to the lamp installation hole, the lamp being fixed to the lamp fixing member.

11. The refrigerator door of claim 10, wherein the first door comprises:

a cabinet that constitutes an exterior;

an internal injection-molded body that constitutes the pair of sidewalls;

an insulating material foamed between the cabinet and the internal injection-molded body, wherein the insulating material is foamed between the cabinet and the internal injection-molded body after the lamp fixing member is disposed in the sidewalls.

12. The refrigerator door of claim 10, wherein the at least one lamp fixing member comprises:

a seating portion on which the lamp is seated;

a plurality of fixing hooks to fix the lamp seated on the seating portion;

ribs disposed on upper and right and left side edges of the lamp fixing member so as to prevent the insulating material from penetrating into the seating portion; and a wire guide portion to guide a wire to supply power to the lamp.

13. The refrigerator door of claim 12, wherein the hinge unit comprises a first hinge shaft to rotatably couple the first door to the refrigerator, and wherein a first hinge hole into which the first hinge shaft is inserted is disposed in an upper portion of the first door.

14. The refrigerator door of claim 13, further comprising:

a hinge cover to cover the hinge unit; and electronic apparatus components accommodated in the hinge cover.

15. The refrigerator door of claim 14, wherein the wire to supply power to the lamp is connected to the electronic apparatus components through the first hinge hole.

* * * * *